US008484038B2

(12) United States Patent
Bessette et al.

(10) Patent No.: US 8,484,038 B2
(45) Date of Patent: Jul. 9, 2013

(54) AUDIO SIGNAL ENCODER, AUDIO SIGNAL DECODER, METHOD FOR ENCODING OR DECODING AN AUDIO SIGNAL USING AN ALIASING-CANCELLATION

(75) Inventors: Bruno Bessette, Sherbrooke (CA); Max Neuendorf, Nuremberg (DE); Ralf Geiger, Erlangen (DE); Philippe Gournay, Sherbrooke (CA); Roch Lefebvre, Quebec (CA); Bernhard Grill, Lauf (DE); Jeremie Lecomte, Fuerth (DE); Stefan Bayer, Nuremberg (DE); Nikolaus Rettelbach, Nuremberg (DE); Lars Villemoes, Jaerfaella (SE); Redwan Salami, St.-Laurent (CA); Albertus C. Den Brinker, Eindhoven (NL)

(73) Assignees: Fraunhofer-Gesellschaft zur Foerderung der Angewandten Forschung E.V., Munich (DE); Voiceage Corporation, Montreal, Quebec (CA); Koninklijke Philips Electronics N.V., Eindhoven (NL); Dolby International AB, Amsterdam Zuio-Oost (NL)

( * ) Notice: Subject to any disclaimer, the term of this patent is extended or adjusted under 35 U.S.C. 154(b) by 0 days.

(21) Appl. No.: 13/449,949

(22) Filed: Apr. 18, 2012

(65) Prior Publication Data

US 2012/0271644 A1 Oct. 25, 2012

Related U.S. Application Data

(63) Continuation of application No. PCT/EP2010/065752, filed on Oct. 19, 2010.

(60) Provisional application No. 61/253,468, filed on Oct. 20, 2009.

(51) Int. Cl.
*G10L 21/00* (2006.01)
*G10L 19/00* (2006.01)

(52) U.S. Cl.
USPC ..... 704/500; 704/219

(58) Field of Classification Search
USPC ..... 704/219, 500
See application file for complete search history.

(56) References Cited

U.S. PATENT DOCUMENTS 6,424,939 B1 * 7/2002 Herre et al. ..... 704/219
2006/0173675 A1 * 8/2006 Ojanpera ..... 704/203

(Continued)

OTHER PUBLICATIONS

Bessette, Bruno et al., "Alternatives for Windowing in USAC", International Organisation for Standardisation ; ISO/IEC JTC1/SC29/VVG11; MPEG2009/M16688; Jun.-Jul. 2009; London UK, Jun.-Jul. 2009, 1-64.

*Primary Examiner* — Talivaldis Ivars Smits
*Assistant Examiner* — Shaun Roberts
(74) *Attorney, Agent, or Firm* — Michael A. Glenn; Glenn Patent Group

(57) ABSTRACT

An audio signal decoder includes a transform domain path configured to obtain a time-domain representation of a portion of an audio content on the basis of a first set of spectral coefficients, a representation of an aliasing-cancellation stimulus signal and a plurality of linear-prediction-domain parameters. The transform domain path applies a spectrum shaping to the first set of spectral coefficients to obtain a spectrally-shaped version thereof. The transform domain path obtains a time-domain representation of the audio content on the basis of the spectrally-shaped version of the first set of spectral coefficients. The transform domain path includes an aliasing-cancellation stimulus filter to filter the aliasing-cancellation stimulus signal in dependence on at least a subset of the linear-prediction-domain parameters. The transform domain path also includes a combiner configured to combine the time-domain representation of the audio content with an aliasing-cancellation synthesis signal to obtain an aliasing reduced time-domain signal.

18 Claims, 25 Drawing Sheets

PROPOSED SYSTEM

U.S. PATENT DOCUMENTS

2007/0282603 A1* 12/2007 Bessette ..... 704/219
2009/0299757 A1* 12/2009 Guo et al. ..... 704/500
2010/0256980 A1* 10/2010 Oshikiri et al. ..... 704/500
2010/0262420 A1* 10/2010 Herre et al. ..... 704/201
2011/0153333 A1* 6/2011 Bessette ..... 704/500
2011/0320196 A1* 12/2011 Choo et al. ..... 704/229

* cited by examiner

WD4 OF USAC

PROPOSED SYSTEM

WINDOW TRANSITIONS IN WD4 OF USAC

OVERVIEW OVER ALL WINDOW TYPES

| length | overlap left (610) | TF length (612) | overlap right (614) | legacy name (616) | example (618) |
|---|---|---|---|---|---|
| | 128 | 128 | 128 | AAC short | 630 |
| | 128 | 256 | 128 | TCX256 | 632 |
| | 128 | 512 | 128 | TCX512 | 634 |
| | 128 | 1024 | 128 | TCX1024 stopstart | 636 |
| | 1024 | 1024 | 1024 | AAC long | 638 |
| | 1024 | 1024 | 128 | AAC start | 640 |
| | 128 | 1024 | 1024 | AAC stop | 642 |

FIG 6

ALLOWED WINDOW SEQUENCES

| window sequence<br>from ↓ to → | "AAC long" | "AAC start" | 8 x "AAC short" | "AAC stop" | "AAC stopstart" | "LPD TCX" | "LPD ACELP" |
|---|---|---|---|---|---|---|---|
| "AAC stop" | ☑ | ☑ | | | | | |
| "AAC long" | ☑ | ☑ | | | | | |
| "AAC start" | | | ☑ | ☑ | ☑ | ☑ | ☑ (FAC) |
| 8 x "AAC short" | | | ☑ | ☑ | ☑ | ☑ | ☑ (FAC) |
| "AAC stopstart" | | | ☑ | ☑ | ☑ | ☑ | ☑ (FAC) |
| "LPD TCX" | | | ☑ | ☑ | ☑ | ☑ | ☑ (FAC) |
| "LPD ACELP" | | | ☑ (FAC) | ☑ (FAC) | ☑ (FAC) | ☑ (FAC) | ☑ |

FIG 7

| FIG 8 | |
|---|---|
| FIG 8A FIG 8B | FIG 8C FIG 8D |

| FIG 9 | | | |
|---|---|---|---|
| FIG 9A | FIG 9B | FIG 9C | FIG 9D |

FAC DECODING OPERATIONS FOR TRANSITIONS FROM AND TO ACELP

COMPUTATION OF FAC TARGET AT THE ENCODER

QUANTISATION OF FAC TARGET IN THE CONTEXT OF FDNS

PRINCIPLE OF THE WEIGHTED ALGEBRAIC LPC INVERSE QUANTIZER

SYNTAX OF FD_CHANNEL_STREAM()

| Syntax | No. of bits | Mnemonic |
|---|---|---|
| fd_channel_stream(common_window, core_mode_last) | | |
| { | | |
| global_gain; | 8 | uimsbf |
| scale_factor_data(); | 1 | uimsbf |
| ac_spectral_data(); | | |
| if(core_mode_last==1 && last_lpd_mode==0) { | | |
| fac_data(1) | | |
| } | | |
| } | | |

FIG 14

SYNTAX OF LPD_CHANNEL_STREAM()

| Syntax | No. of bits | Mnemonic |
|---|---|---|
| lpd_channel_stream(core_mode_last) | | |
| { | | |
| acelp_core_mode | 3 | uimsbf |
| lpd_mode | 5 | uimsbf, Note 1 |
| first_tcx_flag=TRUE; | | |
| k=0; | | |
| if (first_lpd_flag){last_lpd_mode = -1} | | Note 2 |
| while (k<4){ | | |
| if (last_lpd_mode==0 && mod[k]>0) \|\| (last_lpd_mode>0 && mod [k]==0) ){ ~1510 | | |
| fac_data(0) | | |
| } | | |
| if (mod[k]==0) { | | |
| acelp_coding(acelp_core_mode); | | |
| last_lpd_mode=0; | | |
| k+=1 | | |
| } | | |

FIG 15A

| FIG 15 | |
|---|---|
| FIG 15A | FIG 15B |

```
    else{
        tcx_coding(lg(mod[k]), first_tcx_flag);          Note 3
        last_lpd_mode=mod[k];
        k+=(1<<(mod[k]-1));
        first_tcx_flag=FALSE;
    }
  }

  lpc_data(first_lpd_flag)

  if(core_mode_last==0 && mod[0]==0) {
    fac_data(1)
  }
}
```

Note 1: lpd_mode defines the contents of the array mod[]
Note 2: first_lpd_flag is defined
Note 3: The number of spectral coefficients, lg, depends on mod[k]

FIG 15B

SYNTAX OF FAC_DATA()

| Syntax | No. of bits | Mnemonic |
|---|---|---|
| fac_data(useGain) | | |
| { | | |
| if (useGain) { } ~1610 | | |
| fac_gain | 7 | uimsbf |
| } | | |
| for (i=0; i<fac_length/8;i++){ | | |
| nq[i] | 1..n | vlclbf, Note 1 |
| FAC[i] | 4*nq[i] | uimsbf |
| } | | |
| } | | |

Note 1: This value is encoded using a modified unary code, where qn=0 is represented by one "0" bit, and any value qn greater or equal to 2 is represented by qn-1 "1" bits followed by one "0" stop bit.
Note that qn=1 cannot be signaled, because the codebook Q1 is not defined.

FIG 16

AUDIO SIGNAL ENCODER, AUDIO SIGNAL DECODER, METHOD FOR ENCODING OR DECODING AN AUDIO SIGNAL USING AN ALIASING-CANCELLATION

CROSS-REFERENCE TO RELATED APPLICATIONS

This application is a continuation of copending International Application No. PCT/EP2010/065752, filed Oct. 19, 2010, which is incorporated herein by reference in its entirety, and additionally claims priority from U.S. Application No. 61/253,468, filed Oct. 20, 2009, which is also incorporated herein by reference in its entirety.

BACKGROUND OF THE INVENTION

Embodiments according to the invention create an audio signal decoder for providing a decoded representation of an audio content on the basis of an encoded representation of the audio content.

Embodiments according to the invention create an audio signal encoder for providing an encoded representation of an audio content comprising a first set of spectral coefficients, a representation of an aliasing-cancellation stimulus signal and a plurality of linear-prediction-domain parameters on the basis of an input representation of the audio content.

Embodiments according to the invention create a method for providing a decoded representation of an audio content on the basis of an encoded representation of the audio content.

Embodiments according to the invention create a method for providing an encoded representation of an audio content on the basis of an input representation of the audio content.

Embodiments according to the invention create a computer program for performing one of said methods.

Embodiments according to the invention create a concept for a unification of unified-speech-and-audio-coding (also designated briefly as USAC) windowing and frame transitions.

In the following some background of the invention will be explained in order to facilitate the understanding of the invention and advantages thereof.

During the past decade, big effort has been input on creating the possibility to digitally store and distribute audio content. One important achievement on this way is the definition of the International Standard ISO/IEC 14496-3. Part 3 of this Standard is related to a coding and decoding of audio contents, and sub-part 4 of part 3 is related to general audio coding. ISO/IEC 14496, part 3, sub-part 4 defines a concept for encoding and decoding of general audio content. In addition, further improvements have been proposed in order to improve the quality and/or reduce the necessitated bitrate. Moreover, it has been found that the performance of frequency-domain based audio coders is not optimal for audio contents comprising speech. Recently, a unified speech-and-audio codec has been proposed which efficiently combines techniques from both words, namely speech coding and audio coding. For some details, reference is made to the publication "A Novel Scheme for Low Bitrate Unified Speech and Audio Coding—MPEG-RM0" of M. Neuendorf et al. (presented at the 126$^{th}$ Convention of the Audio Engineering Society, May 7-10, 2009, Munich, Germany).

In such an audio coder, some audio frames are encoded in the frequency-domain and some audio frames are encoded in the linear-prediction-domain.

However, it has been found that it is difficult to transition between frames encoded in different domains without sacrificing a significant amount of bitrate.

In view of this situation, there is a desire to create a concept for encoding and decoding an audio content comprising both speech and general audio, which allows for efficient realization of transitions between portions encoded using different modes.

SUMMARY

According to an embodiment, an audio signal decoder for providing a decoded representation of an audio content on the basis of an encoded representation of the audio content may have: a transform domain path configured to obtain a time domain representation of a portion of the audio content encoded in a transform domain mode on the basis of a first set of spectral coefficients, a representation of an aliasing-cancellation stimulus signal and a plurality of linear-prediction-domain parameters, wherein the transform domain path includes a spectrum processor configured to apply a spectral shaping to the first set of spectral coefficients in dependence on at least a subset of the linear-prediction-domain parameters, to obtain a spectrally-shaped version of the first set of spectral coefficients, wherein the transform domain path includes a first frequency-domain-to-time-domain converter configured to obtain a time-domain representation of the audio content on the basis of the spectrally-shaped version of the first set of spectral coefficients; wherein the transform domain path includes an aliasing-cancellation stimulus filter configured to filter an aliasing-cancellation stimulus signal in dependence on at least a subset of the linear-prediction-domain parameters, to derive an aliasing-cancellation synthesis signal from the aliasing-cancellation stimulus signal; and wherein the transform domain path also includes a combiner configured to combine the time-domain representation of the audio content with the aliasing-cancellation synthesis signal, or a post-processed version thereof, to obtain an aliasing-reduced time-domain signal.

According to another embodiment, an audio signal encoder for providing an encoded representation of an audio content including a first set of spectral coefficients, a representation of an aliasing-cancellation stimulus signal and a plurality of linear-prediction-domain parameters on the basis of an input representation of the audio content may have: a time-domain-to-frequency-domain converter configured to process the input representation of the audio content, to obtain a frequency-domain representation of the audio content; a spectral processor configured to apply a spectral shaping to the frequency-domain representation of the audio content, or to a pre-processed version thereof, in dependence on a set of linear-prediction-domain parameters for a portion of the audio content to be encoded in the linear-prediction-domain, to obtain a spectrally-shaped frequency-domain representation of the audio content; and an aliasing-cancellation information provider configured to provide a representation of an aliasing-cancellation stimulus signal, such that a filtering of the aliasing-cancellation stimulus signal in dependence on at least a subset of the linear-prediction-domain parameters results in an aliasing-cancellation synthesis signal for cancelling aliasing artifacts in an audio signal decoder.

According to another embodiment, a method for providing a decoded representation of an audio content on the basis of an encoded representation of the audio content may have the steps of: obtaining a time-domain representation of a portion of the audio content encoded in a transform domain mode on the basis of a first set of spectral coefficients, a representation of an aliasing-cancellation stimulus signal and the plurality of linear-prediction-domain parameters, wherein a spectral shaping is supplied to the first set of spectral coefficients in dependence on at least a subset of the linear-prediction-domain parameters, to obtain a spectrally shaped version of the first set of spectral coefficients, and wherein a frequency-domain-to-time-domain conversion is applied to obtain a time-domain representation of the audio content on the basis of the spectrally-shaped version of the first set of spectral coefficients, and wherein the aliasing-cancellation stimulus signal is filtered in dependence of at least a subset of the linear-prediction-domain parameters, to derive an aliasing-cancellation synthesis signal from the aliasing-cancellation stimulus signal, and wherein the time-domain representation of the audio content is combined with the aliasing-cancellation synthesis signal, or a post-processed version thereof, to obtain an aliasing-reduced-time-domain signal.

According to another embodiment, a method for providing an encoded representation of an audio content including a first set of spectral coefficients, a representation of an aliasing-cancellation stimulus signal, and a plurality of linear-prediction-domain parameters on the basis of an input representation of the audio content may have the steps of performing a time-domain-to-frequency-domain conversion to process the input representation of the audio content, to obtain a frequency-domain representation of the audio content; applying a spectral shaping to the frequency-domain representation of the audio content, or to a pre-processed version thereof, in dependence of a set of linear-prediction-domain parameters for a portion of the audio content to be encoded in the linear-prediction-domain, to obtain a spectrally-shaped frequency-domain representation of the audio content; and providing a representation of an aliasing-cancellation stimulus signal, such that a filtering of the aliasing-cancellation stimulus signal in dependence on at least a subset of the linear-prediction-domain parameters results in an aliasing-cancellation synthesis signal for cancelling aliasing artifacts in an audio signal decoder.

Another embodiment may have a computer program for performing the inventive methods, when the computer program runs on a computer.

Embodiments according to the invention create an audio signal decoder for providing a decoded representation of an audio content on the basis of an encoded representation of an audio content. The audio signal decoder comprises a transform domain path (for example, a transform-coded excitation linear-prediction-domain-path) configured to obtain a time domain representation of the audio content encoded in a transform domain mode on the basis of a first set of spectral coefficients, a representation of an aliasing-cancellation stimulus signal, and a plurality of linear-prediction-domain parameters (for example, linear-prediction-coding filter coefficients). The transform domain path comprises a spectrum processor configured to apply a spectral shaping to the (first) set of spectral coefficients in dependence on at least a subset of linear-prediction-domain parameters to obtain a spectrally-shaped version of the first set of spectral coefficients. The transform domain path also comprises a (first) frequency-domain-to-time-domain-converter configured to obtain a time-domain representation of the audio content on the basis of the spectrally-shaped version of the first set of spectral coefficients. The transform domain path also comprises an aliasing-cancellation-stimulus filter configured to filter the aliasing-cancellation stimulus signal in dependence on at least a subset of the linear-prediction-domain parameters, to derive an aliasing-cancellation synthesis signal from the aliasing-cancellation stimulus signal. The transform domain path also comprises a combiner configured to combine the time-domain representation of the audio content with the aliasing-cancellation synthesis signal, or a post-processed version thereof, to obtain an aliasing-reduced time-domain signal.

This embodiment of the invention is based on the finding that an audio decoder which performs a spectral shaping of the spectral coefficients of the first set of spectral coefficients in the frequency-domain, and which computes an aliasing-cancellation synthesis signal by time-domain filtering an aliasing-cancellation stimulus signal, wherein both the spectral shaping of the spectral coefficients and the time-domain filtering of the aliasing-cancellation-stimulus signal are performed in dependence on linear-prediction-domain parameters, is well-suited for transitions from and to portions (for example, frames) of the audio signal encoded with different noise shaping and also for transitions from or to frames which are encoded in different domains. Accordingly, transitions (for example, between overlapping or non-overlapping frames) of the audio signal, which are encoded in different modes of a multi-mode audio signal coding, can be rendered by the audio signal decoder with good auditory quality and at a moderate level of overhead.

For example, performing the spectral shaping of the first set of coefficients in the frequency-domain allows having the transitions between portions (for example, frames) of the audio content encoded using different noise shaping concepts in the transform domain, wherein an aliasing-cancellation can be obtained with good efficiency between the different portions of the audio content encoded using different noise shaping methods (for example, scale-factor-based noise shaping and linear-prediction-domain-parameter-based noise-shaping). Moreover, the above-described concepts also allows for an efficient reduction of aliasing artifacts between portions (for example, frames) of the audio content encoded in different domains (for example, one in the transform domain and one in the algebraic-code-excited-linear-prediction-domain). The usage of a time-domain filtering of the aliasing-cancellation stimulus signal allows for an aliasing-cancellation at the transition from and to a portion of the audio content encoded in the algebraic-code-excited-linear-prediction mode even if the noise shaping of the current portion of the audio content (which may be encoded, for example, in a transform-coded-excitation linear prediction-domain mode) is performed in the frequency-domain, rather than by a time-domain filtering.

To summarize the above, embodiments according to the present invention allow for a good tradeoff between a necessitated side information and a perceptual quality of transitions between portions of the audio content encoded in three different modes (for example, frequency-domain mode, transform-coded-excitation linear-prediction-domain mode, and algebraic-code-excited-linear-prediction mode).

In an embodiment, the audio signal decoder is a multi-mode audio signal decoder configured to switch between a plurality of coding modes. In this case, the transform domain branch is configured to selectively obtain the aliasing cancellation synthesis signal for a portion of the audio content following a previous portion of the audio content which does not allow for an aliasing-cancelling overlap-and-add operation or followed by a subsequent portion of the audio content which does not allow for an aliasing-cancelling overlap-and-add operation. It has been found that the application of a noise shaping, which is performed by the spectral shaping of the spectral coefficients of the first set of spectral coefficients, allows for a transition between portions of the audio content encoded in the transform domain and using different noise shaping concepts (for example, a scale-factor-based noise shaping concept and a linear-prediction-domain-parameter-based noise shaping concept) without using the aliasing-cancellation signals, because the usage of the first frequency-domain-to-time-domain converter after the spectral shaping allows for an efficient aliasing-cancellation between subsequent frames encoded in the transform domain, even if different noise-shaping approaches are used in the subsequent audio frames. Thus, bitrate efficiency can be obtained by selectively obtaining the aliasing-cancellation synthesis signal only for transitions from or to a portion of the audio content encoded in a non-transform domain (for example, in an algebraic code-excited-linear-prediction-mode).

In an embodiment, the audio signal decoder is configured to switch between a transform-coded-excitation-linear-prediction-domain mode, which uses a transform-coded-excitation information and a linear-prediction-domain parameter information, and a frequency-domain mode, which uses a spectral coefficient information and a scale factor information. In this case, the transform-domain-path is configured to obtain the first set of spectral coefficients on the basis of the transform-coded-excitation information and to obtain the linear-prediction-domain parameters on the basis of the linear-prediction-domain-parameter information. The audio signal decoder comprises a frequency domain path configured to obtain a time-domain representation of the audio content encoded in the frequency-domain mode on the basis of a frequency-domain mode set of spectral coefficients described by the spectral coefficient information and in dependence on a set of scale factors described by the scale factor information. The frequency-domain path comprises a spectrum processor configured to apply a spectral shaping to the frequency-domain mode set of spectral coefficients, or to a pre-processed version thereof, in dependence on the scale factors to obtain a spectrally-shaped frequency-domain mode set of spectral coefficients. The frequency-domain path also comprises a frequency-domain-to-time-domain converter configured to obtain a time-domain representation of the audio content on the basis of the spectrally-shaped frequency-domain-mode set of spectral coefficients. The audio signal decoder is configured such that time-domain representations of two subsequent portions of the audio content, one of which two subsequent portions of the audio content is encoded in the transform-coded-excitation linear-prediction-domain mode, and one of which two subsequent portions of the audio content is encoded in the frequency-domain mode, comprise a temporal overlap to cancel a time-domain aliasing caused by the frequency-domain-to-time-domain conversion.

As already discussed, the concept according to the embodiments of the invention is well-suited for transitions between portions of the audio content encoded in the transform-coded-excitation-linear-predication-domain mode and in the frequency-domain mode. A very good quality aliasing-cancellation is obtained due to the fact that the spectral shaping is performed in the frequency-domain in the transform-coded-excitation-linear-prediction-domain mode.

In an embodiment, the audio signal decoder is configured to switch between a transform-coded-excitation-linear-prediction-domain-mode which uses a transform-coded-excitation information and a linear-prediction-domain parameter information, and an algebraic-code-excited-linear-prediction mode, which uses an algebraic-code-excitation-information and a linear-prediction-domain-parameter information. In this case, the transform-domain path is configured to obtain the first set of spectral coefficients on the basis of the transform-coded-excitation information and to obtain the linear-prediction-domain parameters on the basis of the linear-prediction-domain-parameter information. The audio signal decoder comprises an algebraic-code-excited-linear-prediction path configured to obtain a time-domain representation of the audio content encoded in the algebraic-code-excited-linear-prediction (also designated briefly with ACELP in the following) mode, on the basis of the algebraic-code-excitation information and the linear-prediction-domain parameter information. In this case, the ACELP path comprises an ACELP excitation processor configured to provide a time-domain excitation signal on the basis of the algebraic-code-excitation information and a synthesis filter configured to perform a time-domain filtering, to provide a reconstructed signal on the basis of the time-domain excitation signal and in dependence on linear-prediction-domain filter coefficients obtained on the basis of the linear-prediction-domain parameter information. The transform domain path is configured to selectively provide the aliasing-cancellation synthesis signal for a portion of the audio content encoded in the transform-coded-excitation linear-prediction-domain mode following a portion of the audio content encoded in the ACELP mode and for a portion of the content encoded in the transfer-coded-excitation-linear-prediction-domain mode preceding a portion of the audio content encoded in the ACELP mode. It has been found that the aliasing-cancellation synthesis signal is very well-suited for transitions between portions (for example, frames) encoded in the transform-coded-excitation-linear-prediction-domain (in the following also briefly designated as TCX-LPD) mode and the ACELP mode.

In an embodiment, the aliasing-cancellation stimulus filter is configured to filter the aliasing-cancellation stimulus signals in dependence on linear-prediction-domain filter parameters which correspond to a left-sided aliasing folding point of the first frequency-domain-to-time-domain converter for a portion of the audio content encoded in the TCX-LPD mode following a portion of the audio content encoded in the ACELP mode. The aliasing-cancellation stimulus filter is configured to filter the aliasing-cancellation stimulus signal in dependence on linear-prediction-domain filter parameters which correspond to a right-sided aliasing folding point of the second frequency-domain-to-time-domain converter for a portion of the audio content encoded in the transform-coded-excitation-linear-prediction-mode preceding a portion of the audio content encoded in the ACELP mode. By applying linear-prediction-domain filter parameters, which correspond to the aliasing folding points, an extremely efficient aliasing-cancellation can be obtained. Also, the linear-prediction-domain filter parameters, which correspond to the aliasing folding points, are typically easily obtainable as the aliasing folding points are often at the transition from one frame to the next, such that the transmission of said linear-prediction-domain filter parameters is necessitated anyway. Accordingly, overheads are kept to a minimum.

In a further embodiment, the audio signal decoder is configured to initialize memory values of the aliasing-cancellation stimulus filter to zero for providing the aliasing-cancellation synthesis signal, and to feed M samples of the aliasing-cancellation stimulus signal into the aliasing-cancellation stimulus filter to obtain corresponding non-zero input response samples of the aliasing-cancellation synthesis signal, and to further obtain a plurality of zero-input response samples of the aliasing-cancellation synthesis signal. The combiner is configured to combine the time-domain representation of the audio content with the non-zero input response samples and the subsequent zero-input response samples, to obtain an aliasing-reduced time-domain signal at a transition from a portion of the audio content encoded in the ACELP mode to a portion of the audio content encoded in the TCX-LPD mode following the portion of the audio content encoded in the ACELP mode. By exploiting both, the non-zero input response samples and the zero-input response samples, a very good usage can be made of the aliasing-cancellation stimulus filter. Also, a very smooth aliasing-cancellation synthesis signal can be obtained while keeping a number of necessitated samples of the aliasing-cancellation stimulus signal as small as possible. Moreover, it has been found that a shape of the aliasing-cancellation synthesis signal is very well-adapted to typical aliasing artifacts by using the above-mentioned concept. Thus, a very good tradeoff between coding efficiency and aliasing-cancellation can be obtained.

In an embodiment, the audio signal decoder is configured to combine a windowed and folded version of at least a portion of a time-domain representation obtained using the ACELP mode with a time-domain representation of a subsequent portion of the audio content obtained using the TCX-LPD mode, to at least partially cancel an aliasing. It has been found that the usage of such aliasing-cancellation mechanisms, in addition to the generation of the aliasing cancellation synthesis signal, provides the possibility of obtaining an aliasing-cancellation in a very bitrate efficient manner. In particular, the necessitated aliasing-cancellation stimulus signal can be encoded with high efficiency if the aliasing-cancellation synthesis signal is supported, in the aliasing-cancellation, by the windowed and folded version of at least a portion of a time-domain representation obtained using the ACELP mode.

In an embodiment, the audio signal decoder is configured to combine a windowed version of a zero impulse response of the synthesis filter of the ACELP branch with a time-domain representation of a subsequent portion of the audio content obtained using the TCX-LPD mode, to at least partially cancel an aliasing. It has been found that the usage of such a zero impulse response may also help to improve the coding efficiency of the aliasing-cancellation stimulus signal, because the zero impulse response of the synthesis filter of the ACELP branch typically cancels at least a part of the aliasing in the TCX-LPD-encoded portion of the audio content. Accordingly, the energy of the aliasing-cancellation synthesis signal is reduced, which, in turn, results in a reduction of the energy of the aliasing-cancellation stimulus signal. However, encoding signals with a smaller energy is typically possible with reduced bitrate requirements.

In an embodiment, the audio signal decoder is configured to switch between a TCX-LPD mode, in which a capped frequency-domain-to-time-domain transform is used, a frequency-domain mode, in which a tapped frequency-domain-to time-domain transform is used, as well as an algebraic-code-excited-linear-prediction mode. In this case, the audio signal decoder is configured to at least partially cancel an aliasing at a transition between a portion of the audio content encoded in the TCX-LPD mode and a portion of the audio content encoded in the frequency-domain mode by performing an overlap-and-add operation between time domain samples of subsequent overlapping portions of the audio content. Also, the audio signal decoder is configured to at least partially cancel an aliasing at a transition between a portion of the audio content encoded in the TCX-LPD mode and a portion of the audio content encoded in the ACELP mode using the aliasing-cancellation synthesis signal. It has been found that the audio signal decoder also is well-suited for switching between different modes of operation, wherein the aliasing cancels very efficiently.

In an embodiment, the audio signal decoder is configured to apply a common gain value for a gain scaling of a time-domain representation provided by the first frequency-domain-to-time-domain converter of the transform domain path (for example, TCX-LPD path) and for a gain scaling of the aliasing-cancellation stimulus signal or the aliasing-cancellation synthesis signal. It has been found that a reuse of this common gain value both for the scaling of the time-domain representation provided by the first frequency-domain-to-time-domain converter and for the scaling of the aliasing-cancellation stimulus signal or aliasing-cancellation synthesis signal allows for the reduction of bitrate necessitated at a transition between portions of the audio content encoded in different modes. This is very important, as a bitrate requirement is increased by the encoding of the aliasing-cancellation stimulus signal in the environment of a transition between portions of the audio content encoded in the different modes.

In an embodiment, the audio signal decoder is configured to apply, in addition to the spectral shaping performed in dependence on at least the subset of linear-prediction-domain parameters, a spectrum deshaping to at least a subset of the first set of spectral coefficients. In this case, the audio signal decoder is configured to apply the spectrum de-shaping to at least a subset of a set of aliasing-cancellation spectral coefficients from which the aliasing-cancellation stimulus signal is derived. Applying a spectral deshaping both, to the first set of spectral coefficients, and to the aliasing-cancellation spectral coefficients from which the aliasing cancellation stimulus signal is derived, ensures that the aliasing cancellation synthesis signal is well-adapted to the "main" audio content signal provided by the first frequency-domain-to-time-domain converter. Again, the coding efficiency for encoding the aliasing cancellation stimulus signal is improved.

In an environment, the audio signal decoder comprises a second frequency-domain-to-time-domain converter configured to obtain a time-domain representation of the aliasing-cancellation stimulus signal in dependence on a set of spectral coefficients representing the aliasing-cancellation stimulus signal. In this case, the first frequency-domain-to-time-domain converter is configured to perform a lapped transform, which comprises a time-domain aliasing. The second frequency-domain-to-time-domain converter is configured to perform a non-lapped transform. Accordingly, a high coding efficiency can be maintained by using the lapped transform for the "main" signal synthesis. Nevertheless, the aliasing-cancellation achieved using an additional frequency-domain-to-time-domain conversion, which is non-lapped. However, it has been found that the combination of the lapped frequency-domain-to-time-domain conversion and the non-lapped frequency-domain-to-time-domain conversion allows for a more efficient encoding of transitions that a single non-lapped frequency-domain-to-time-domain transition.

An embodiment according to the invention creates an audio signal encoder for providing an encoded representation of an audio content comprising a first set of spectral coefficients, a representation of an aliasing-cancellation stimulus signal and a plurality of linear-prediction-domain parameters on the basis of an input representation of the audio content. The audio signal encoder comprises a time-domain-to-frequency-domain converter configured to process the input representation of the audio content, to obtain a frequency-domain representation of the audio content. The audio signal encoder also comprises a spectral processor configured to apply a spectral shaping to a set of spectral coefficients, or to a pre-processed version thereof, in dependence on a set of linear-prediction-domain parameters for a portion of the audio content to be encoded in the linear-prediction-domain, to obtain a spectrally-shaped frequency-domain representation of the audio content. The audio signal encoder also comprises an aliasing-cancellation information provider configured to provide a representation of an aliasing-cancellation stimulus signal, such that a filtering of the aliasing-cancellation stimulus signal in dependence on at least a subset of the linear prediction domain parameters results in an aliasing-cancellation synthesis signal for cancelling aliasing artifacts in an audio signal decoder.

The audio signal encoder discussed here is well-suited for cooperation with the audio signal encoder described before. In particular, the audio signal encoder is configured to provide a representation of the audio content in which a bitrate overhead necessitated for cancelling aliasing at transitions between portions (for example, frames or sub-frames) of the audio content encoded in different modes is kept reasonably small.

Further embodiments according to the invention create a method for providing a decoded representation of the audio content and a method for providing an encoded representation of an audio content. Said methods are based on the same ideas as the apparatus discussed above.

Embodiments according to the invention create computer programs for performing one of said methods. The computer programs are also based on the same considerations.

BRIEF DESCRIPTION OF THE DRAWINGS

Embodiments of the present invention will be detailed subsequently referring to the appended drawings, in which:

FIG. 6 shows a schematic representation providing an overview over all window types used in an audio signal encoder according to an embodiment of the invention or an audio signal decoder according to an embodiment of the invention;

FIG. 7 shows a table representation of allowed window sequences, which may be used in an audio signal encoder according to an embodiment of the invention, or and audio signal decoder according to an embodiment of the invention;

FIG. 14 shows a representation of a syntax of a frequency-domain channel stream "fd_channel_stream( )";

FIG. 15 shows a representation of a syntax of a linear-prediction-domain channel stream "lpd_channel_stream( )"; and FIG. 16 shows a representation of a syntax of the forward aliasing-cancellation data "fac_data( )".

DETAILED DESCRIPTION OF THE INVENTION

1. Audio Signal Decoder According to FIG. 1

Figure 1:
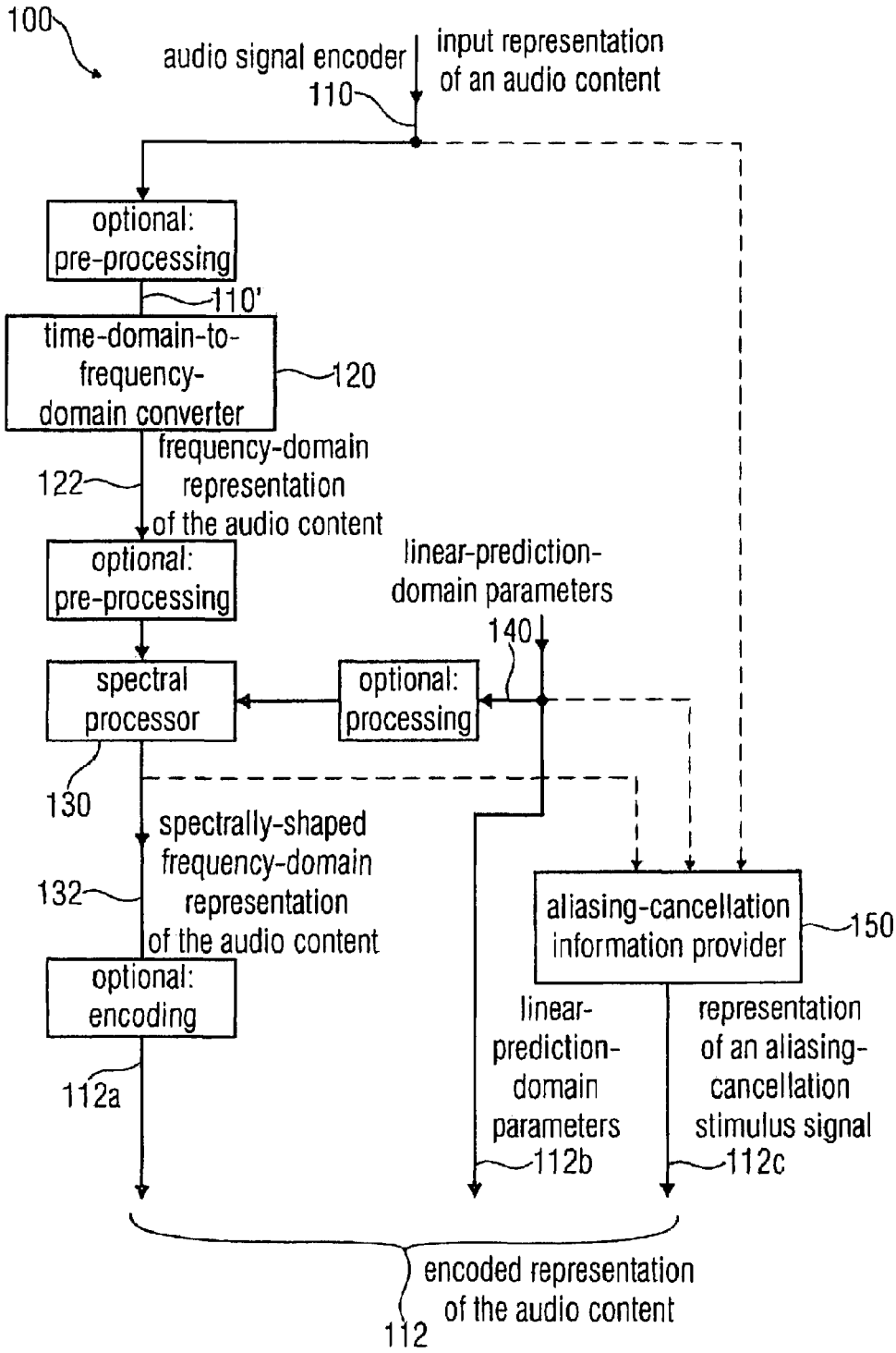
FIG. 1 shows a block schematic diagram of an audio signal encoder, according to an embodiment of the invention.

FIG. 1 shows a block schematic diagram of an audio signal encoder 100, according to an embodiment of the invention. The audio signal encoder 100 is configured to receive an input representation 110 of an audio content and to provide, on the basis thereof, an encoded representation 112 of the audio content. The encoded representation 112 of the audio content comprises a first set 112*a* of spectral coefficients, a plurality of linear-prediction-domain parameters 112*b* and a representation 112*c* of an aliasing-cancellation stimulus signal.

The audio signal encoder 100 comprises a time-domain-to-frequency-domain converter 120 which is configured to process the input representation 110 of the audio content (or, equivalently, a pre-processed version 110' thereof), to obtain a frequency-domain representation 122 of the audio content (which may take the form of a set of spectral coefficients).

The audio signal encoder 100 also comprises a spectral processor 130 which is configured to apply a spectral shaping to the frequency-domain representation 122 of the audio content, or to a pre-processed version 122' thereof, in dependence on a set 140 of linear-prediction-domain parameters for a portion of the audio content to be encoded in the linear-prediction-domain, to obtain a spectrally-shaped frequency-domain representation 132 of the audio content. The first set 112*a* of spectral coefficients may be equal to the spectrally-shaped frequency-domain representation 132 of the audio content, or may be derived from the spectrally-shaped frequency-domain representation 132 of the audio content.

The audio signal encoder 100 also comprises an aliasing-cancellation information provider 150, which is configured to provide a representation 112*c* of an aliasing-cancellation stimulus signal, such that a filtering of the aliasing-cancellation stimulus signal in dependence on at least a subset of the linear-prediction-domain parameters 140 results in an aliasing-cancellation synthesis signal for cancelling aliasing artifacts in an audio signal decoder.

It should also be noted that the linear-prediction-domain parameters 112*b* may, for example, be equal to the linear-prediction-domain parameters 140.

The audio signal encoder 110 provides information which is well-suited for a reconstruction of the audio content, even if different portions (for example, frames or sub-frames) of the audio content are encoded in different modes. For a portion of the audio content encoded in the linear-prediction-domain, for example, in a transform-coded-excitation linear-prediction-domain mode, the spectral shaping, which brings along a noise shaping and therefore allows a quantization of the audio content with a comparatively small bitrate, is performed after the time-domain-to-frequency-domain conversion. This allows for an aliasing cancelling overlap-and-add of a portion of the audio content encoded in the linear-prediction-domain with a preceding or subsequent portion of the audio content encoded in a frequency-domain mode. By using the linear-prediction-domain parameters 140 for the spectral shaping, the spectral shaping is well-adapted to speech-like audio contents, such that a particularly good coding efficiency can be obtained for speech-like audio contents. Moreover, the representation of the aliasing-cancellation stimulus signal allows for an efficient aliasing-cancellation at transitions from or towards a portion (for example, frame or sub-frame) of the audio content encoded in the algebraic-code-excited-linear-prediction mode. By providing the representation of the aliasing-cancellation stimulus signal in dependence on the linear prediction domain parameters, a particularly efficient representation of the aliasing-cancellation stimulus signal is obtained, which can be decoded at the side of the decoder taking into consideration the linear-prediction-domain parameters, which are known at the decoder anyway.

To summarize, the audio signal encoder 100 is well-suited for enabling transitions between portions of the audio content encoded in different coding modes and is capable of providing an aliasing-cancellation information in a particularly compact form.

2. Audio Signal Decoder According to FIG. 2

Figure 2A:
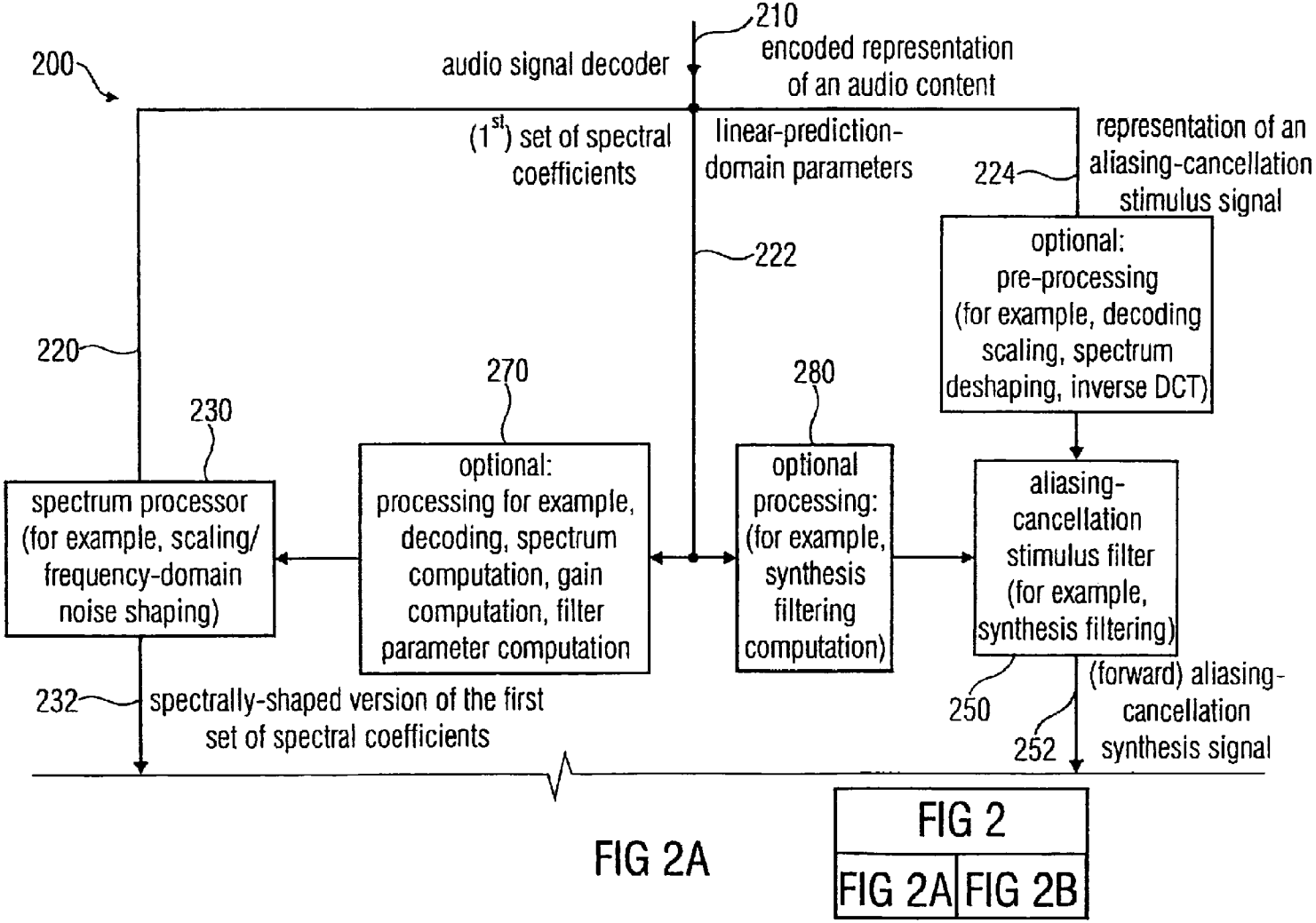
FIG. 2 shows a block schematic diagram of an audio signal decoder, according to an embodiment of the invention.
Figure 2B:
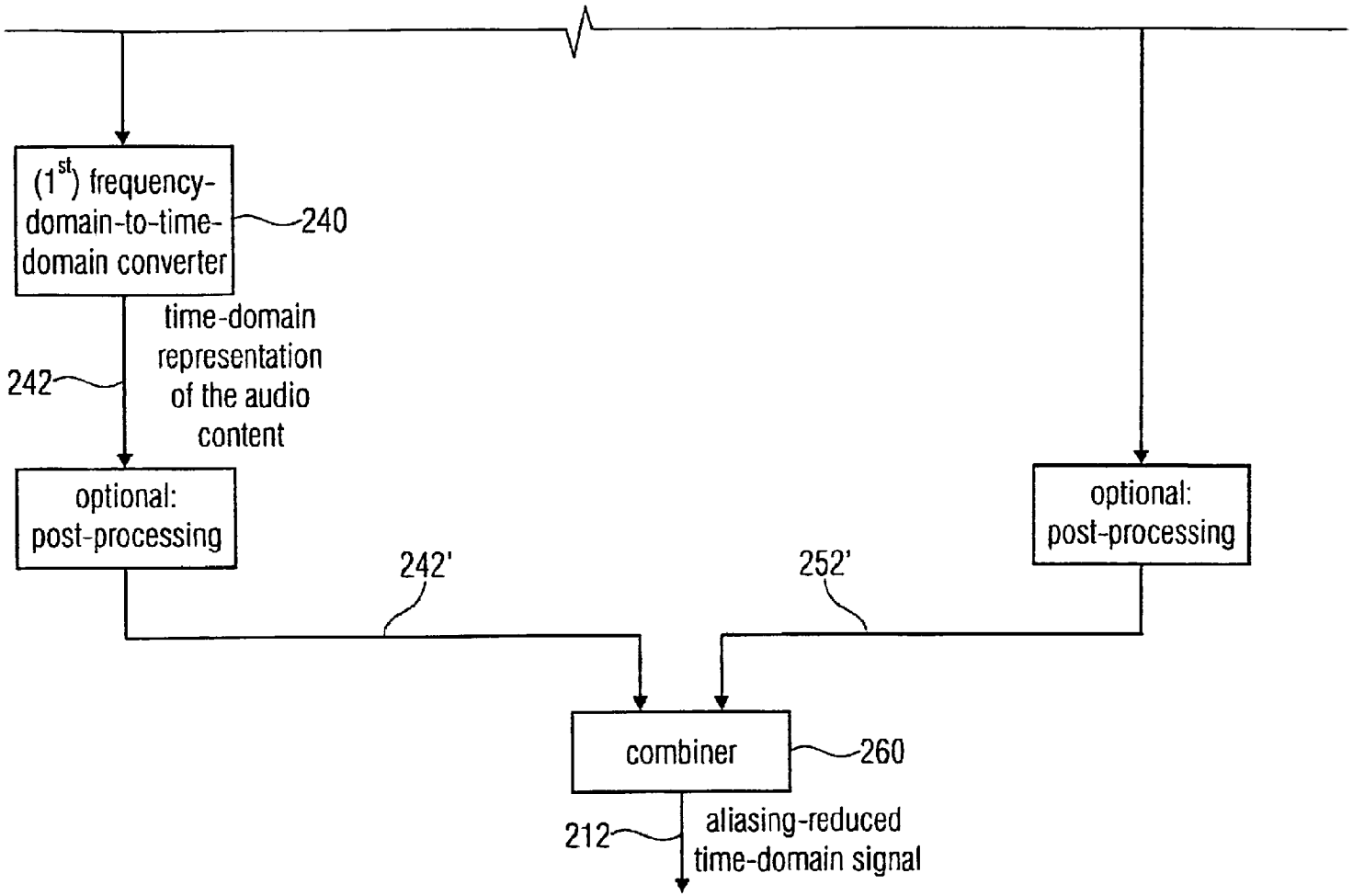

FIG. 2 shows a block schematic diagram of an audio signal decoder 200 according to an embodiment of the invention. The audio signal decoder 200 is configured to receive an encoded representation 210 of the audio content and to provide, on the basis thereof, the decoded representation 212 of the audio content, for example, in the form of an aliasing-reduced-time-domain signal.

The audio signal decoder 200 comprises a transform domain path (for example, a transform-coded-excitation linear-prediction-domain path) configured to obtain a time-domain representation 212 of the audio content encoded in a transform domain mode on the basis of a (first) set 220 of spectral coefficients, a representation 224 of an aliasing-cancellation stimulus signal and a plurality of linear-prediction-domain parameters 222. The transform domain path comprises a spectrum processor 230 configured to apply a spectral shaping to the (first) set 220 of spectral coefficients in dependence on at least a subset of the linear-prediction-domain parameters 222, to obtain a spectrally-shaped version 232 of the first set 220 of spectral coefficients. The transform domain path also comprises a (first) frequency-domain-to-time-domain converter 240 configured to obtain a time-domain representation 242 of the audio content on the basis of the spectrally-shaped version 232 of the (first) set 220 of spectral coefficients. The transform domain path also comprises an aliasing-cancellation stimulus filter 250, which is configured to filter the aliasing-cancellation stimulus signal (which is represented by the representation 224) in dependence on at least a subset of the linear-prediction-domain parameters 222, to derive an aliasing-cancellation synthesis signal 252 from the aliasing-cancellation stimulus signal. The transform domain path also comprises a combiner 260 configured to combine the time-domain representation 242 of the audio content (or, equivalently, a post-processed version 242' thereof) with the aliasing-cancellation synthesis signal 252 (or, equivalently, a post-processed version 252' thereof), to obtain the aliasing-reduced time-domain signal 212.

The audio signal decoder 200 may comprise an optional processing 270 for deriving the setting of the spectrum processor 230, which performs, for example, a scaling and/or frequency-domain noise shaping, from at least a subset of the linear-prediction-domain parameters.

The audio signal decoder 200 also comprises an optional processing 280, which is configured to derive the setting of the aliasing-cancellation stimulus filter 250, which may, for example, perform a synthesis filtering for synthesizing the aliasing-cancellation synthesis signal 252, from at least a subset of the linear-prediction-domain parameters 222.

The audio signal decoder 200 is configured to provide an aliasing-reduced time domain signal 212, which is well-suited for a combination both, with a time-domain signal representing an audio content and obtained in a frequency-domain mode of operation, and to/in combination with a time-domain signal representing an audio content and encoded in an ACELP mode of operation. Particularly good overlap-and-add characteristics exist between portions (for example, frames) of the audio content decoded using a frequency-domain mode of operation (using a frequency-domain path not shown in FIG. 2) and portions (for example, a frame or sub-frame) of the audio content decoded using the transform domain path of FIG. 2, as the noise shaping is performed by the spectrum processor 230 in the frequency-domain, i.e. before the frequency-domain-to-time-domain conversion 240. Moreover, particularly good aliasing-cancellations can also be obtained between a portion (for example, a frame or sub-frame) of the audio content decoded using the transform domain path of FIG. 2 and a portion (for example, a frame or sub-frame) of the audio content decoded using an ACELP decoding path due to the fact that the aliasing-cancellation synthesis signal 252 is provided on the basis of a filtering of an aliasing-cancellation stimulus signal in dependence on linear-prediction-domain parameters. An aliasing-cancellation synthesis signal 252, which is obtained in this manner, is typically well-adapted to the aliasing artifacts which occur at the transition between a portion of the audio content encoded in the TCX-LPD mode and a portion of the audio content encoded in the ACELP mode. Further optional details regarding the operation of the audio signal decoding will be described in the following.

3. Switched Audio Decoders According to FIGS. 3*a* and 3*b*

In the following, the concept of a multi-mode audio signal decoder will briefly be discussed taking reference to FIGS. 3*a* and 3*b*.

Figure 3A:
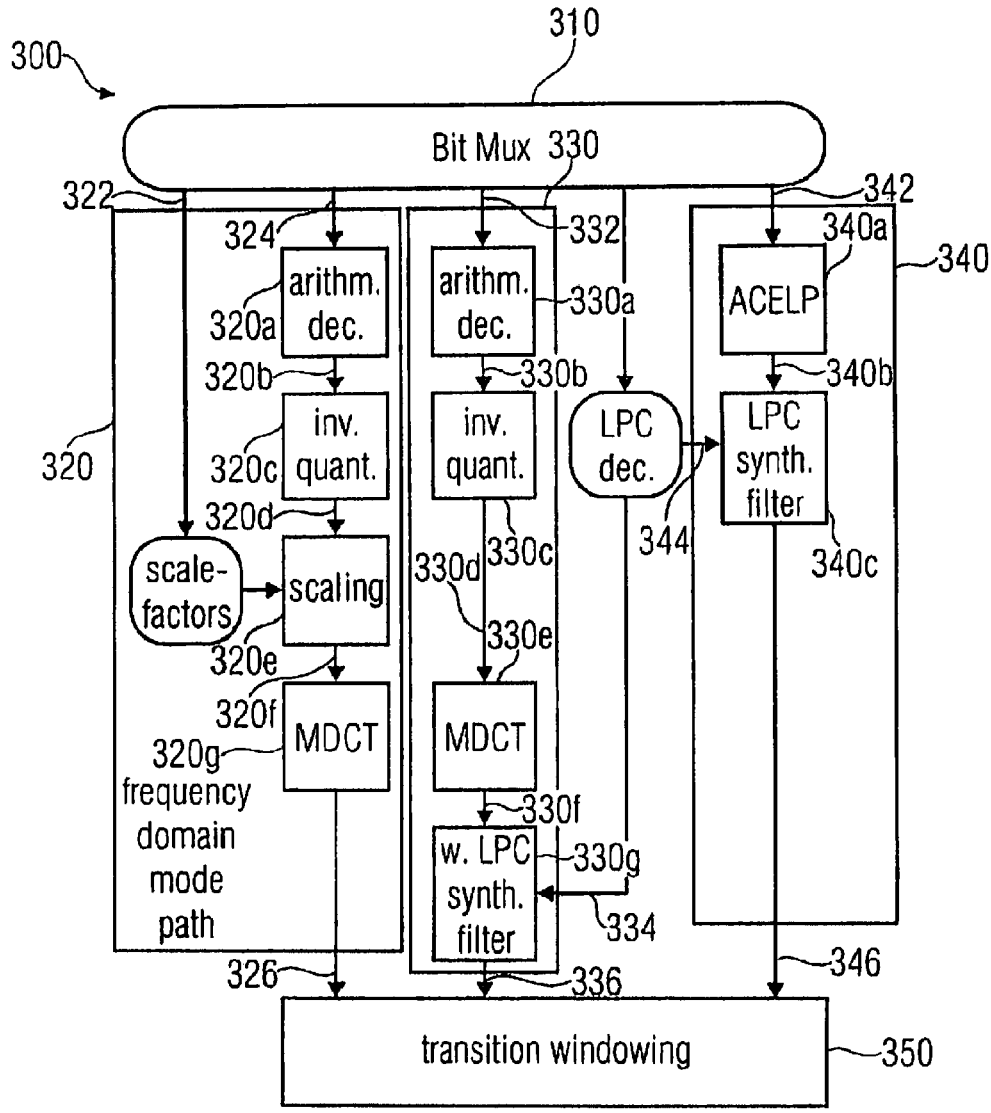
FIG. 3*a* shows a block schematic diagram of a reference audio signal decoder according to working draft 4 of the Unified Speech and Audio Coding (USAC) draft standard.

3.1 Audio Signal Decoder 300 According to FIG. 3*a*

Figure 3B:
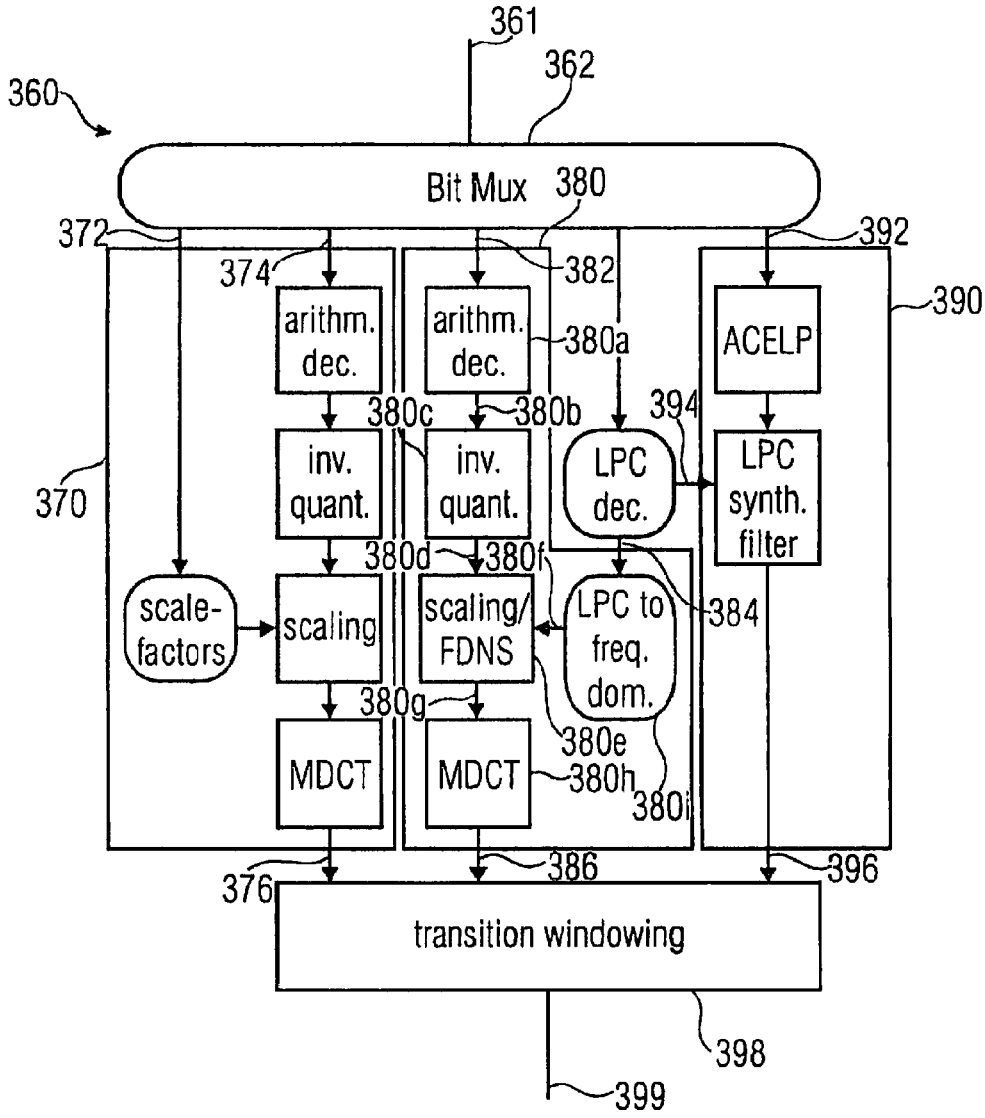
FIG. 3*b* shows a block schematic diagram of an audio signal decoder, according to another embodiment of the invention.

FIG. 3*a* shows a block schematic diagram of a reference multi-mode audio signal decoder, and FIG. 3*b* shows a block schematic diagram of a multi-mode audio signal decoder, according to an embodiment of the invention. In other words, FIG. 3*a* shows a basic decoder signal flow of a reference system (for example, according to working draft 4 of the USAC draft standard), and FIG. 3*b* shows a basic decoder signal flow of a proposed system according to an embodiment of the invention.

The audio signal decoder 300 will be described first taking reference to FIG. 3*a*. The audio signal decoder 300 comprises a bit multiplexer 310, which is configured to receive an input bitstream and to provide the information included in the bitstream to the appropriate processing units of the processing branches.

The audio signal decoder 300 comprises a frequency-domain mode path 320, which is configured to receive a scale factor information 322 and an encoded spectral coefficient information 324, and to provide, on the basis thereof, a time-domain representation 326 of an audio frame encoded in the frequency-domain mode. The audio signal decoder 300 also comprises a transform-coded-excitation-linear-prediction-domain path 330, which is configured to receive an encoded transform-coded-excitation information 332 and a linear-prediction coefficient information 334, (also designated as a linear-prediction coding information, or as a linear-prediction-domain information or as a linear-prediction-coding filter information) and to provide, on the basis thereof, a time-domain representation of an audio frame or audio sub-frame encoded in the transform-coded-excitation-linear-prediction-domain (TCX-LPD) mode. The audio signal decoder 300 also comprises an algebraic-code-excited-linear-prediction (ACELP) path 340, which is configured to receive an encoded excitation information 342 and a linear-prediction-coding information 344 (also designated as a linear prediction coefficient information or as a linear prediction domain information or as a linear-prediction-coding filter information) and to provide, on the basis thereof, a time-domain linear-prediction-coding information, to as representation of an audio frame or audio sub-frame encoded in the ACELP mode. The audio signal decoder 300 also comprises a transition windowing, which is configured to receive the time-domain representations 326, 336, 346 of frames or sub-frames of the audio content encoded in the different modes and to combine the time domain representation using a transition windowing.

The frequency-domain path 320 comprises an arithmetic decoder 320*a* configured to decode the encoded spectral representation 324, to obtain a decoded spectral representation 320*b*, an inverse quantizer 320*d* configured to provide an inversely quantized spectral representation 320*e* on the basis of the decoded spectral representation 320*b*, a scaling 320*e* configured to scale the inversely quantized spectral representation 320*d* in dependence on scale factors, to obtain a scaled spectral representation 320*f* and a (inverse) modified discrete cosine transform 320*g* for providing a time-domain representation 326 on the basis of the scaled spectral representation 320*f*.

The TCX-LPD branch 330 comprises an arithmetic decoder 330*a* configured to provide a decoded spectral representation 330*b* on the basis of the encoded spectral representation 332, an inverse quantizer 330*c* configured to provide an inversely quantized spectral representation 330*d* on the basis of the decoded spectral representation 330*b*, a (inverse) modified discrete cosine transform 330*e* for providing an excitation signal 330*f* on the basis of the inversely quantized spectral representation 330*d*, and a linear-prediction-coding synthesis filter 330*g* for providing the time-domain representation 336 on the basis of the excitation signal 330*f* and the linear-prediction-coding filter coefficients 334 (also sometimes designated as linear-prediction-domain filter coefficients).

The ACELP branch 340 comprises an ACELP excitation processor 340*a* configured to provide an ACELP excitation signal 340*b* on the basis of the encoded excitation signal 342 and a linear-prediction-coding synthesis filter 340*c* for providing the time-domain representation 346 on the basis of the ACELP excitation signal 340*b* and the linear-prediction-coding filter coefficients 344.

Figure 4:
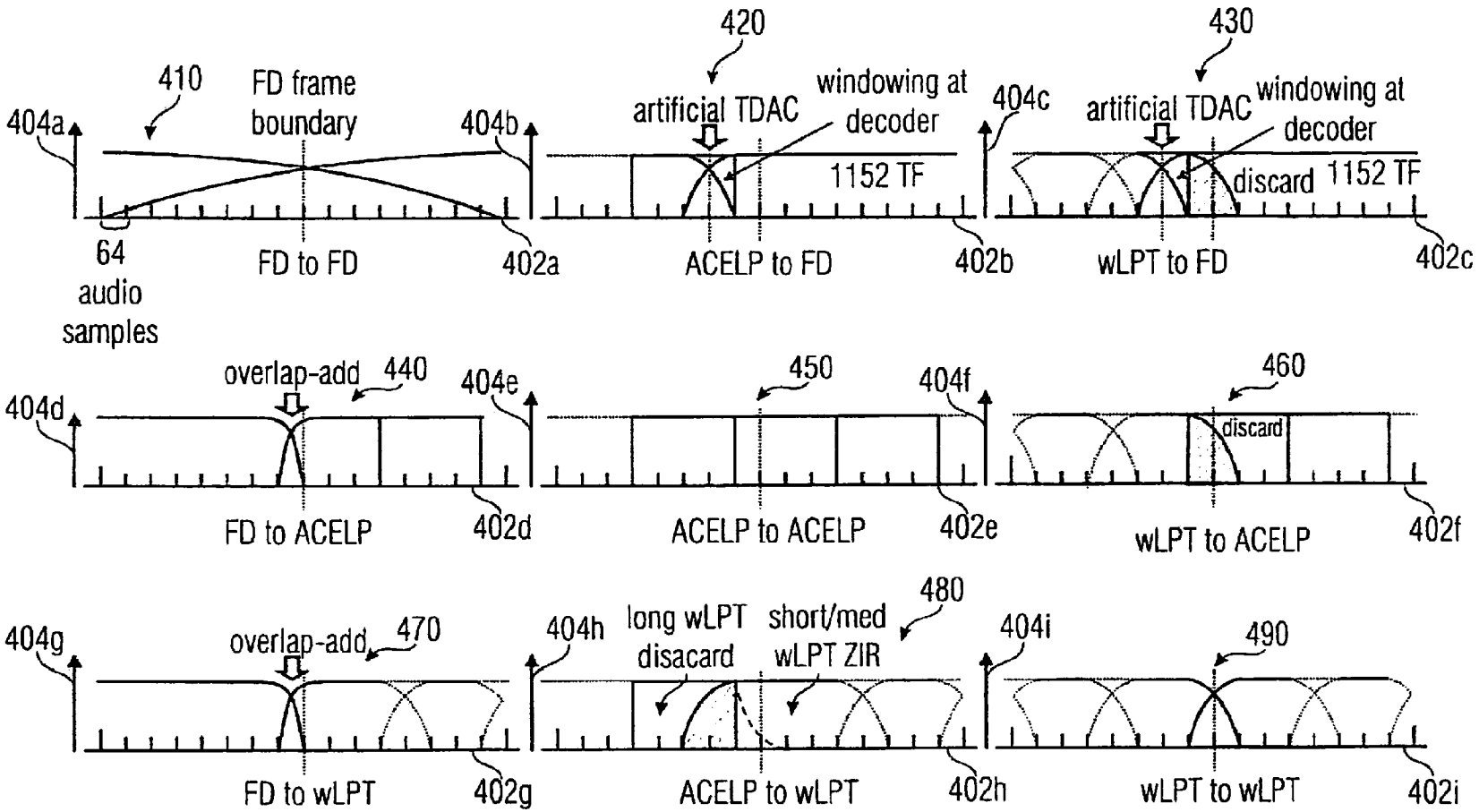
FIG. 4 shows a graphical representation of a reference window transition according to working draft 4 of the USAC draft standard.

3.2 Transition Windowing According to FIG. 4

Taking reference now to FIG. 4, the transition windowing 350 will be described in more detail. First of all, the general framing structure of an audio signal decoder 300 will be described. However, it should be noted that a very similar framing structure with only minor differences, or even an identical general framing structure, will be used in the other audio signal encoders or decoders described herein. It should also be noted that audio frames typically comprise a length of N samples, wherein N may be equal to 2048. Subsequent frames of the audio content may be overlapping by approximately 50%, for example, by N/2 audio samples. An audio frame may be encoded in the frequency-domain, such that the N time-domain samples of an audio frame are represented by a set of, for example, N/2 spectral coefficients. Alternatively, the N time-domain samples of an audio frame may also be represented by a plurality of, for example, eight sets of, for example, 128 spectral coefficients. Accordingly, a higher temporal resolution can be obtained.

If the N time-domain samples of an audio frame are encoded in the frequency-domain mode using a single set of spectral coefficients, a single window such as, for example, a so-called "STOP_START" window, a so-called "AAC Long" window, a so-called "AAC Start" window, or a so-called "AAC Stop" window may be applied to window the time domain samples 326 provided by the inverse modified discrete cosine transform 320*g*. In contrast, a plurality of shorter windows, for example of the type "AAC Short", may be applied to window the time-domain representations obtained using different sets of spectral coefficients, if the N time-domain samples of an audio frame are encoded using a plurality of sets of spectral coefficients. For example, separate short windows may be applied to time-domain representations obtained on the basis of individual sets of spectral coefficients associated with a single audio frame.

An audio frame encoded in the linear-prediction-domain mode may be sub-divided into a plurality of sub-frames, which are sometimes designated as "frames". Each of the sub-frames may be encoded either in the TCX-LPD mode or in the ACELP mode. Accordingly, however, in the TCX-LPD mode, two or even four of the sub-frames may be encoded together using a single set of spectral coefficients describing the transform encoded excitation.

A sub-frame (or a group of two or four sub-frames) encoded in the TCX-LPD mode may be represented by a set of spectral coefficients and one or more sets of linear-prediction-coding filter coefficients. A sub-frame of the audio content encoded in the ACELP domain may be represented by an encoded ACELP excitation signal and one or more sets of linear-prediction-coding filter coefficients.

Taking reference now to FIG. 4, the implementation of transitions between frames or sub-frames will be described. In the schematic representation of FIG. 4, abscissas 402*a* to 402*i* describe a time in terms of audio samples, and ordinates 404*a* to 404*i* describe windows and/or temporal regions for which time domain samples are provided.

At reference numeral 410, a transition between two overlapping frames encoded in the frequency-domain is represented. At reference numeral 420, a transition from a sub-frame encoded in the ACELP mode to a frame encoded in the frequency-domain mode is shown. At reference numeral 430, a transition from a frame (or a sub-frame) encoded in the TCX-LPD mode (also designated as "wLPT" mode) to a frame encoded in the frequency-domain mode as illustrated. At reference numeral 440, a transition between a frame encoded in the frequency-domain mode and a sub-frame encoded in the ACELP mode is shown. At reference numeral 450, a transition between sub-frames encoded in the ACELP mode is shown. At reference numeral 460, a transition from a sub-frame encoded in the TCX-LPD mode to a sub-frame encoded in the ACELP mode is shown. At reference numeral 470, a transition from a frame encoded in the frequency-domain mode to a sub-frame encoded in the TCX-LPD mode is shown. At reference numeral 480, a transition between a sub-frame encoded in the ACELP mode and a sub-frame encoded in the TCX-LPD mode is shown. At reference numeral 490, a transition between sub-frames encoded in the mode is shown.

Interestingly, the transition from the TCX-LPD mode to the frequency-domain mode, which is shown at reference numeral 430, is somewhat inefficient or even TCX-LPD very inefficient due to the fact that a part of the information transmitted to the decoder is discarded. Similarly, transitions between the ACELP mode and the TCX-LPD mode, which are shown at reference numerals 460 and 480, are implemented inefficiently due to the fact that a part of the information transmitted to the decoder is discarded.

3.3 Audio Signal Decoder 360 According to FIG. 3*b*

In the following, the audio signal decoder 360, according to an embodiment of the invention will be described.

The audio signal 360 comprises a bit multiplexer or bitstream parser 362, which is configured to receive a bitstream representation 361 of an audio content and to provide, on the basis thereof, information elements to a different branches of the audio signal decoder 360.

The audio signal decoder 360 comprises a frequency-domain branch 370 which receives an encoded scale factor information 372 and an encoded spectral information 374 from the bitstream multiplexer 362 and to provide, on the basis thereof, a time-domain representation 376 of a frame encoded in the frequency-domain mode. The audio signal decoder 360 also comprises a TCX-LPD path 380 which is configured to receive an encoded spectral representation 382 and encoded linear-prediction-coding filter coefficients 384 and to provide, on the basis thereof, a time-domain representation 386 of an audio frame or audio sub-frame encoded in the TCX-LPD mode.

The audio signal decoder 360 comprises an ACELP path 390 which is configured to receive an encoded ACELP excitation 392 and encoded linear-prediction-coding filter coefficients 394 and to provide, on the basis thereof, a time-domain representation 396 of an audio sub-frame encoded in the ACELP mode.

The audio signal decoder 360 also comprises a transition windowing 398, which is configured to apply an appropriate transition windowing to the time-domain representations 376, 386, 396 of the frames and sub-frames encoded in the different modes, to derive a contiguous audio signal.

It should be noted here that the frequency-domain branch 370 may be identical in its general structure and functionality to the frequency-domain branch 320, even though there may be different or additional aliasing-cancellation mechanisms in the frequency-domain branch 370. Moreover, the ACELP branch 390 may be identical to the ACELP branch 340 in its general structure and functionality, such that the above description also applies.

However, the TCX-LPD branch 380 differs from the TCX-LPD branch 330 in that the noise-shaping is performed before the inverse-modified-discrete-cosine-transform in the TCX-LPD branch 380. Also, the TCX-LPD branch 380 comprises additional aliasing cancellation functionalities.

The TCX-LPD branch 380 comprises an arithmetic decoder 380*a* which is configured to receive an encoded spectral representation 382 and to provide, on the basis thereof, a decoded spectral representation 380*b*. The TCX-LPD branch 380 also comprises an inverse quantizer 380*c* configured to receive the decoded spectral representation 380*b* and to provide, on the basis thereof, an inversely quantized spectral representation 380*d*. The TCX-LPD branch 380 also comprises a scaling and/or frequency-domain noise-shaping 380*e* which is configured to receive the inversely quantized spectral representation 380*d* and a spectral shaping information 380*f* and to provide, on the basis thereof, a spectrally shaped spectral representation 380*g* to an inverse modified-discrete-cosine-transform 380*h*, which provides the time-domain representation 386 on the basis of the spectrally shaped spectral representation 380*g*. The TCX-LPD branch 380 also comprises a linear-prediction-coefficient-to-frequency-domain transformer 380*i* which is configured to provide the spectral scaling information 380*f* on the basis of the linear-prediction-coding filter coefficients 384.

Regarding the functionality of the audio signal decoder 360 it can be said that the frequency-domain branch 370 and the TCX-LPD branch 380 are very similar in that each of them comprises a processing chain having an arithmetic decoding, an inverse quantization, a spectrum scaling and an inverse modified-discrete-cosine-transform in the same processing order. Accordingly, the output signals 376, 386 of the frequency-domain branch 370 and of the TCX-LPD branch 380 are very similar in that they may both be unfiltered (with the exception of a transition windowing) output signals of the inverse modified-discrete-cosine-transforms. Accordingly, the time-domain signals 376, 386 are very well-suited for an overlap-and-add operation, wherein a time-domain aliasing-cancellation is achieved by the overlap-and-add operation. Thus, transitions between an audio frame encoded in the frequency-domain mode and an audio frame or audio sub-frame encoded in the TCX-LPD mode can be efficiently performed by a simple overlap-and-add operation without necessitating any additional aliasing-cancellation information and without discarding any information. Thus, a minimum amount of side information is sufficient.

Moreover, it should be noted that the scaling of the inversely quantized spectral representation, which is performed in the frequency-domain path 370 in dependence on a scale factor information, effectively brings along a noise-shaping of the quantization noise introduced by the encoder-sided quantization and the decoder-sided inverse quantization 320*c*, which noise-shaping is well-adapted to general audio signals such as, for example, music signals. In contrast, the scaling and/or frequency-domain noise-shaping 380*e*, which is performed in dependence on the linear-prediction-coding filter coefficients, effectively brings along a noise-shaping of a quantization noise caused by an encoder-sided quantization and the decoder-sided inverse quantization 380*c*, which is well-adapted to speech-like audio signals. Accordingly, the functionality of the frequency-domain branch 370 and of the TCX-LPD branch 380 merely differs in that different noise-shaping is applied in the frequency-domain, such that a coding efficiency (or audio quality) is particularly good for general audio signals when using the frequency-domain branch 370, and such that a coding efficiency or audio quality is particularly high for speech-like audio signals when using the TCX-LPD branch 380.

It should be noted that the TCX-LPD branch 380 comprises additional aliasing-cancellation mechanisms for transitions between audio frames or audio sub-frames encoded in the TCX-LPD mode and in the ACELP mode. Details will be described below.

Figure 5:
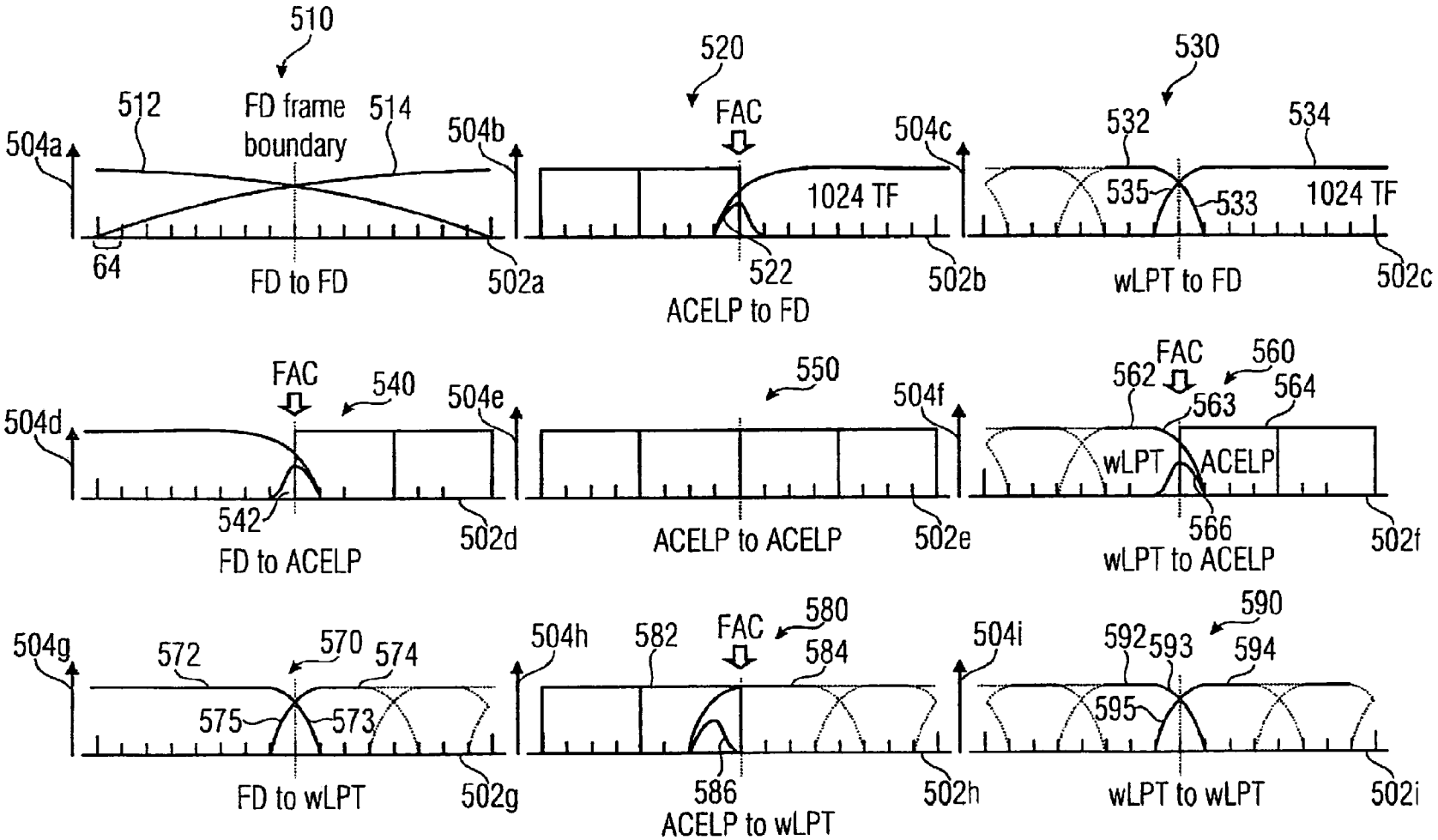
FIG. 5 shows a schematic representation of window transitions which can be used in an audio signal coding, according to an embodiment of the invention.
Figure 8A:
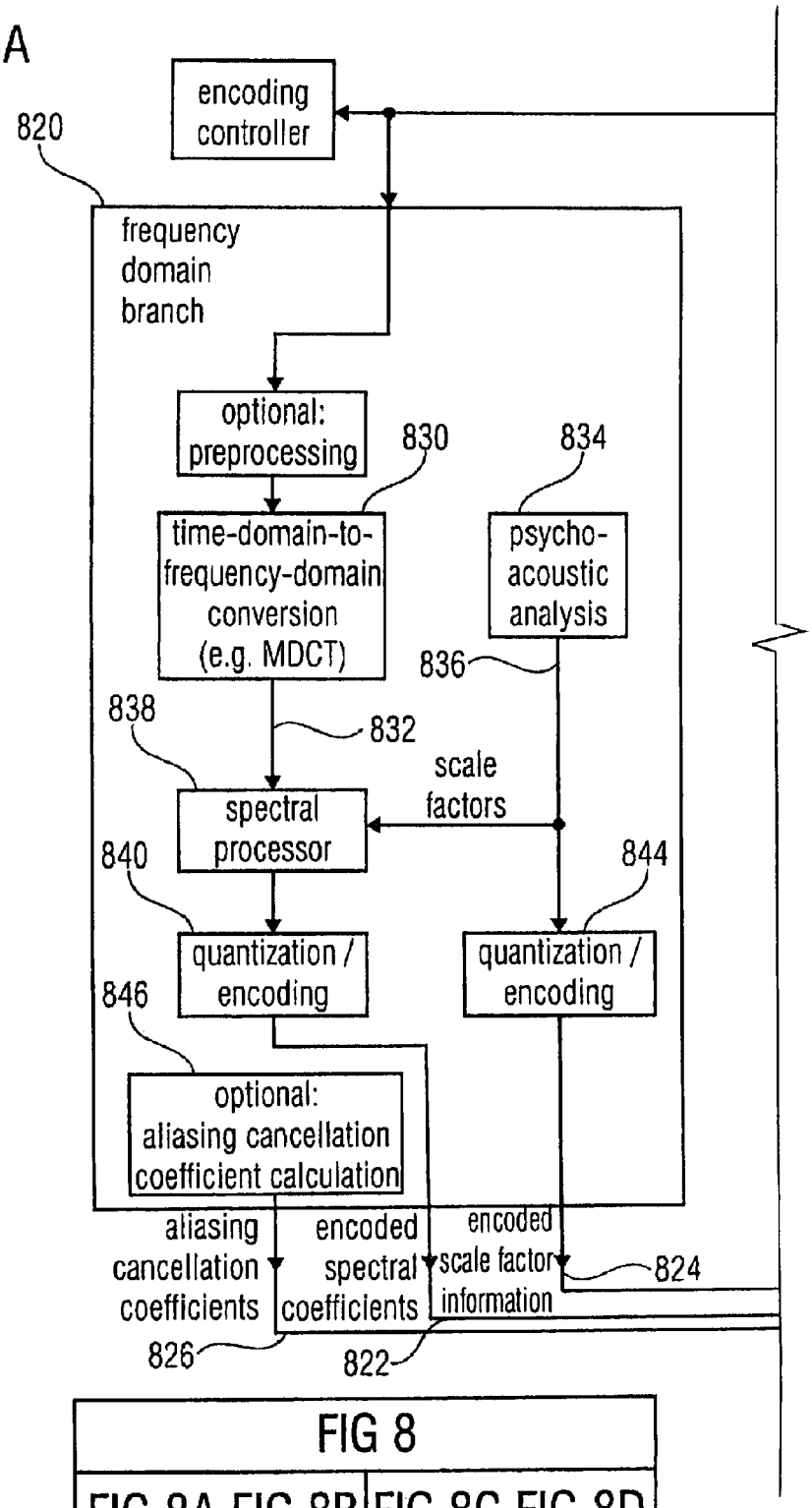
FIG. 8 shows a detailed block schematic diagram of an audio signal encoder, according to an embodiment of the invention.
Figure 8B:
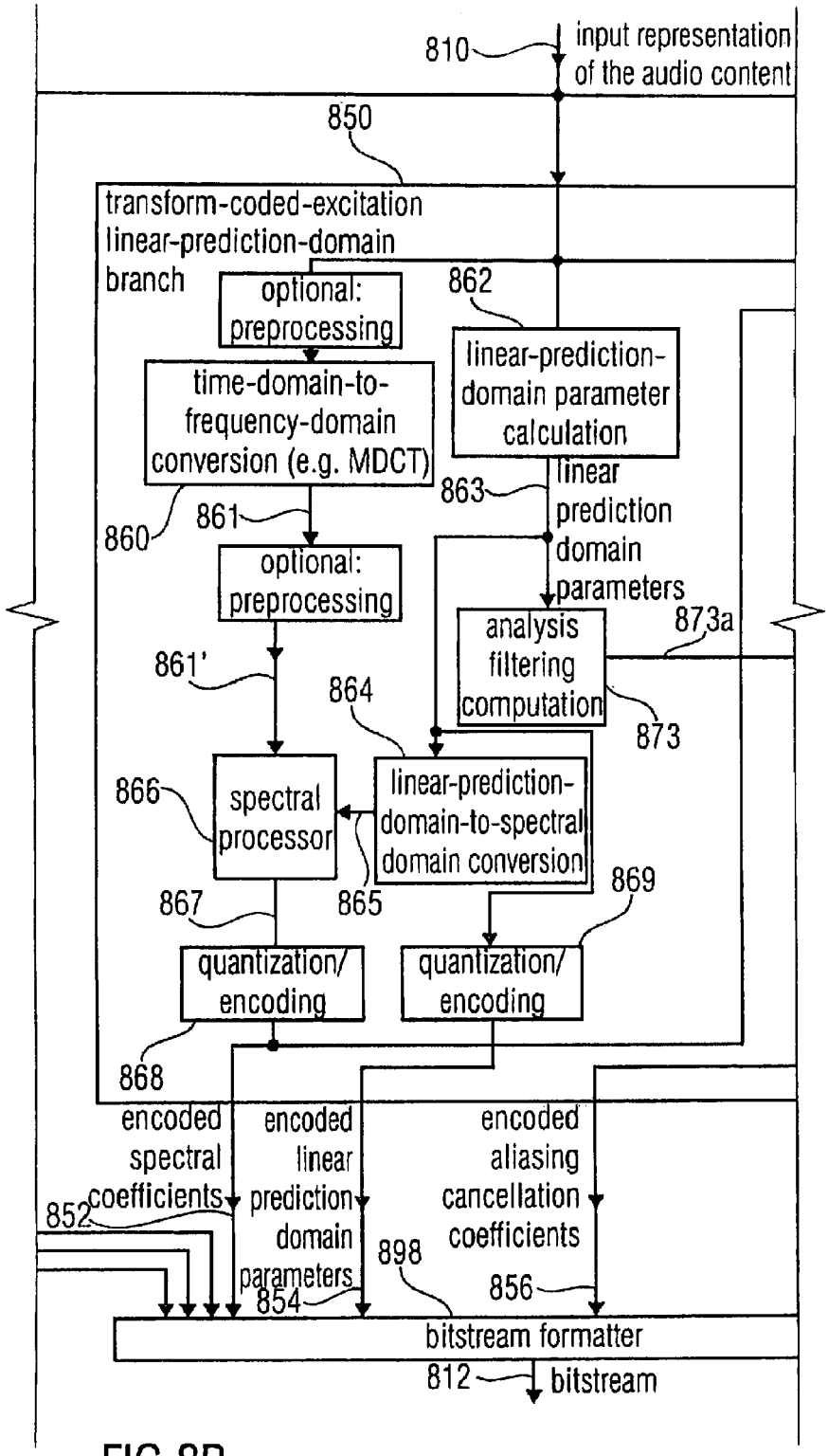
Figure 8C:
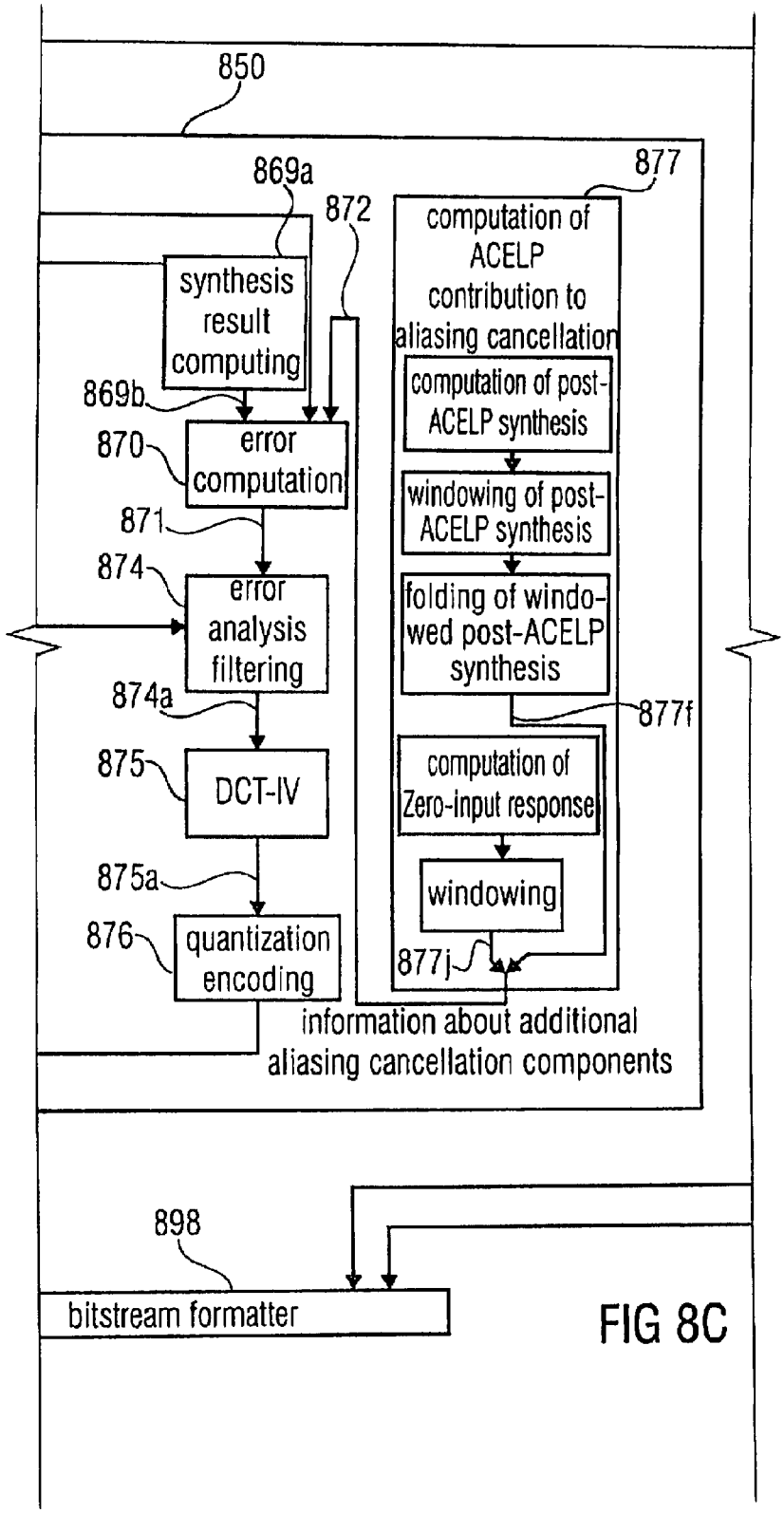
Figure 8D:
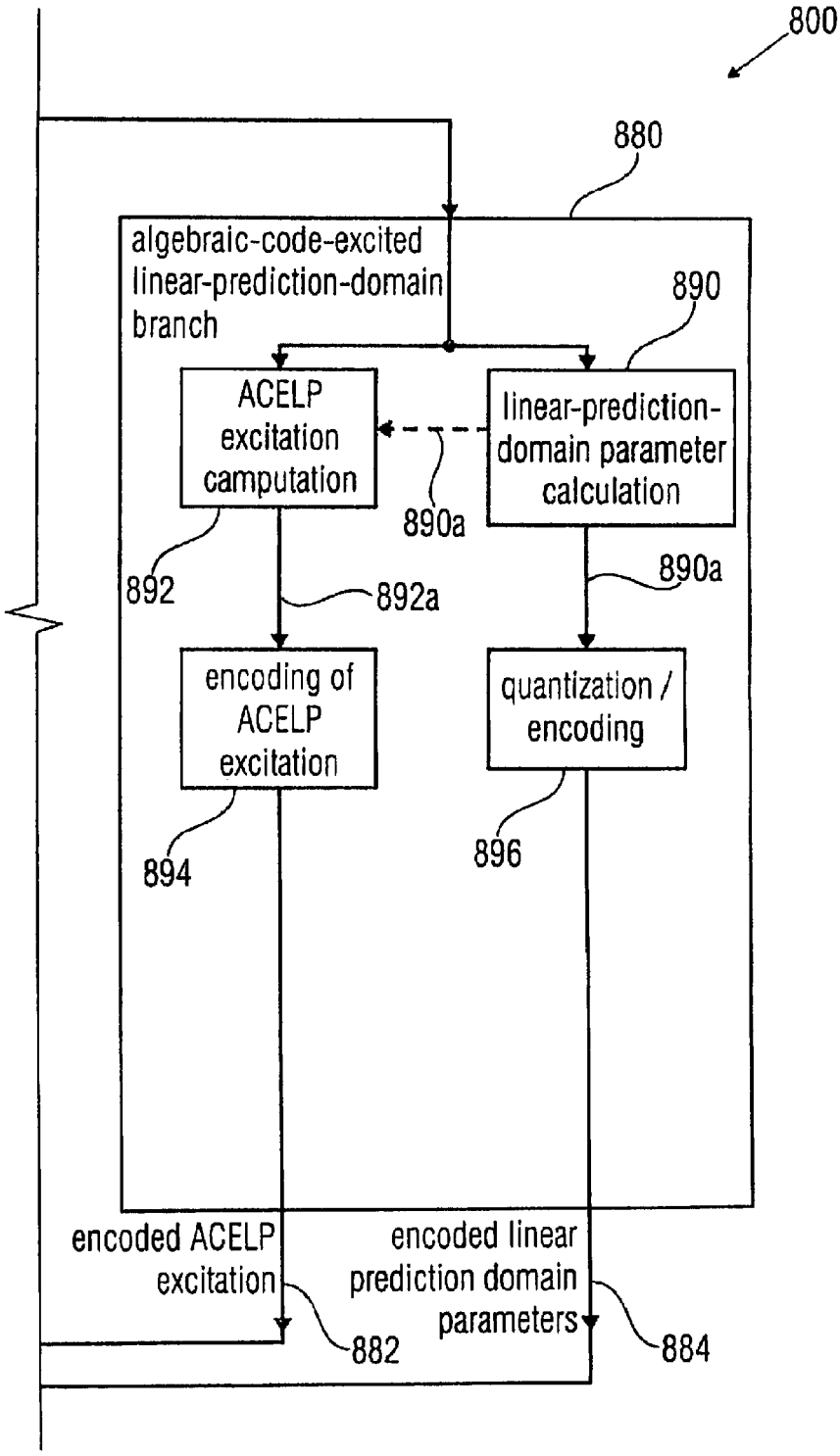
Figure 9A:
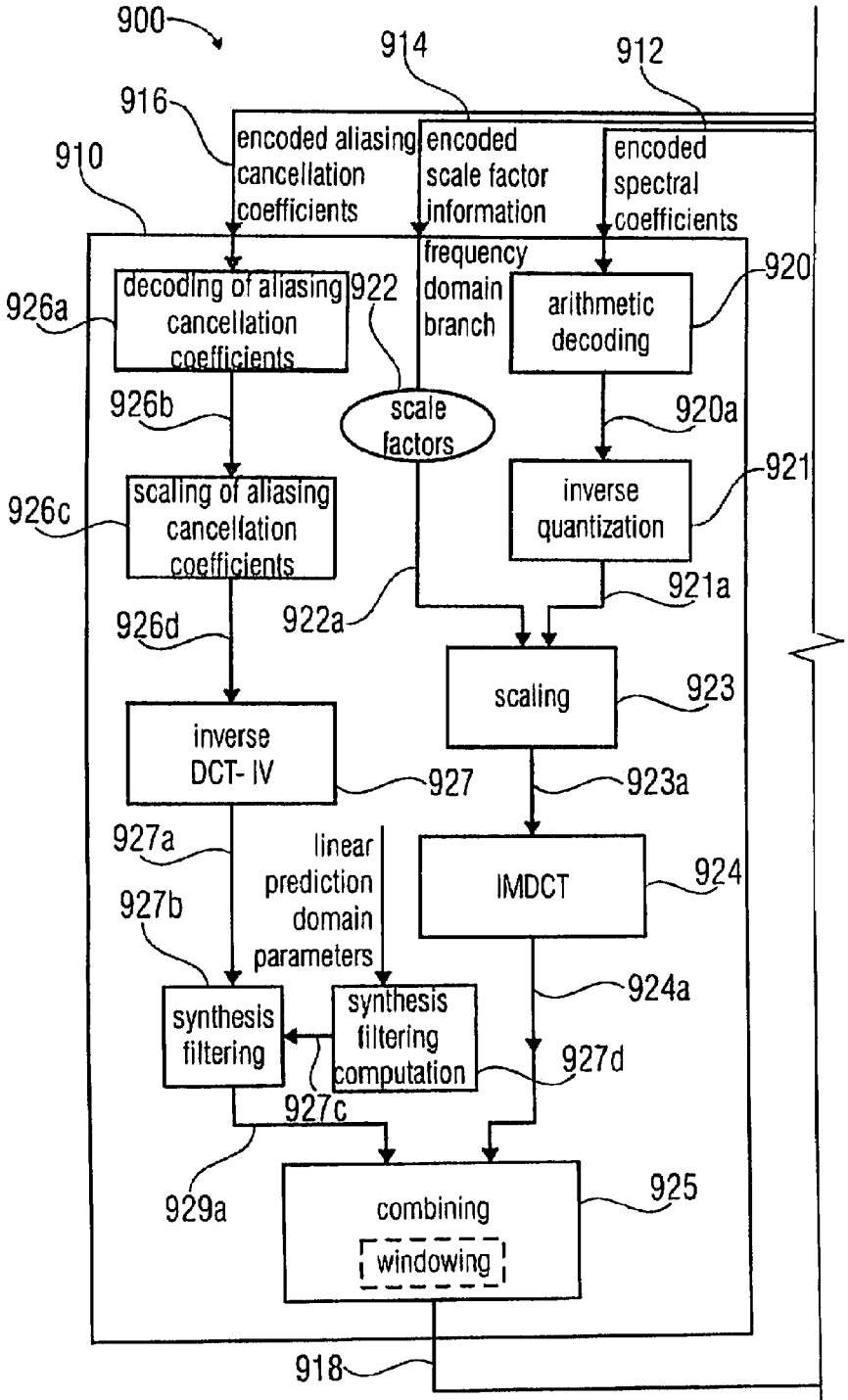
FIG. 9 shows a detailed block schematic diagram of an audio signal decoder according to an embodiment of the invention.
Figure 9B:
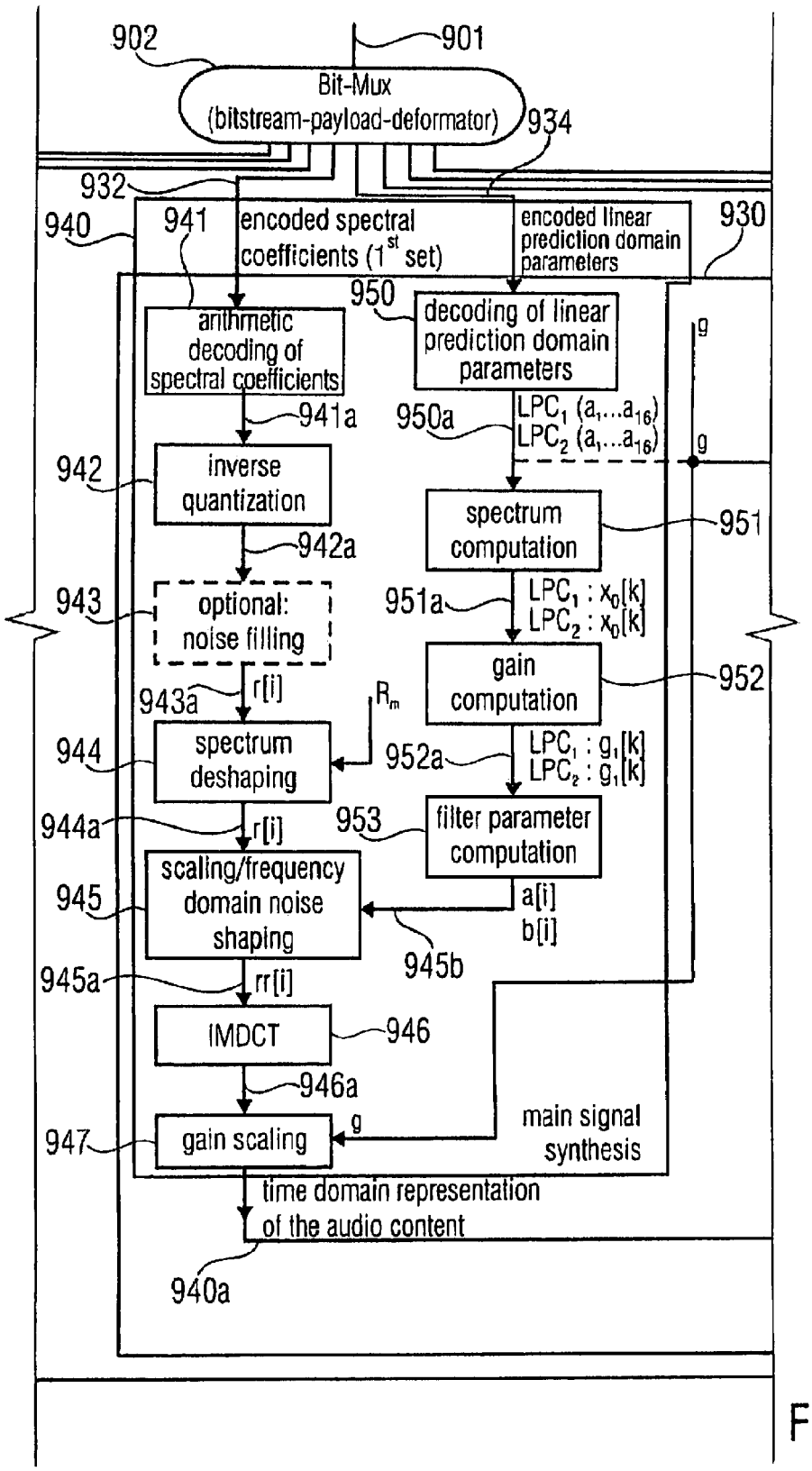
Figure 9C:
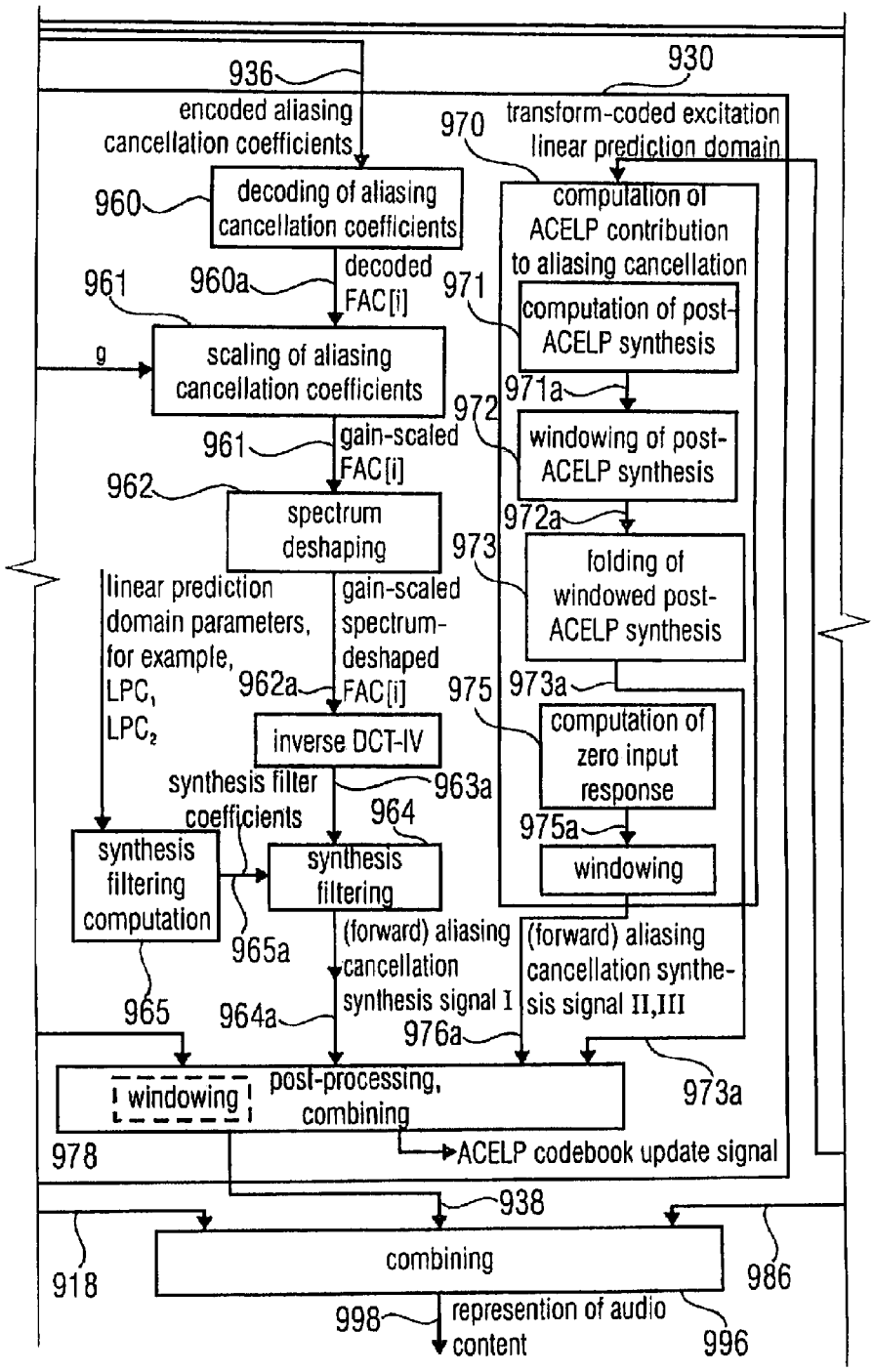
Figure 9D:
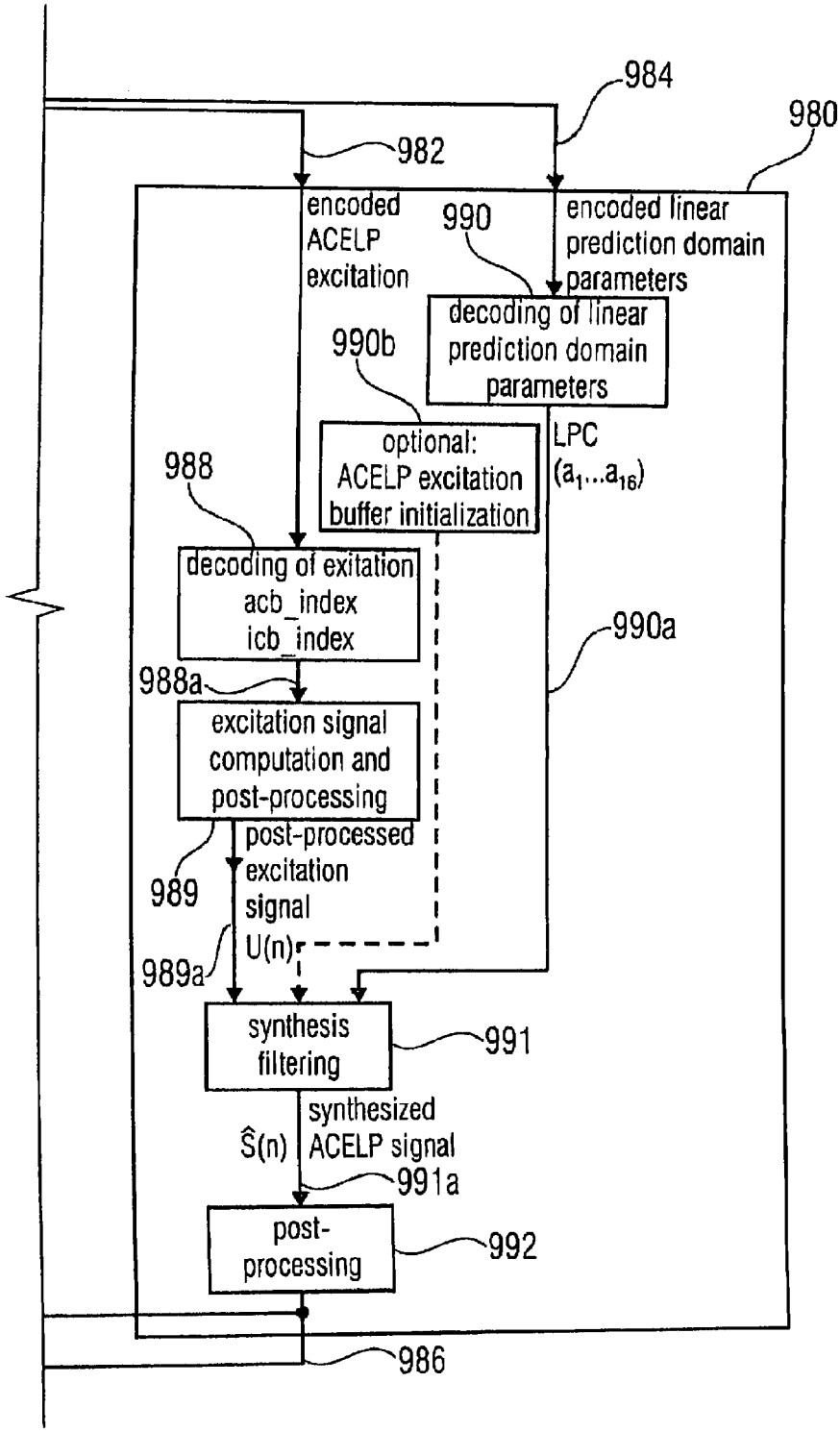

3.4 Transition Windowing According to FIG. 5

FIG. 5 shows a graphic representation of an example of an envisioned windowing scheme, which may be applied in the audio signal decoder 360 or in any other audio signal encoders and decoders according to the present invention. FIG. 5 represents a windowing at possible transitions between frames or sub-frames encoded in different of the nodes. Abscissas 502*a* to 502*i* describe a time in terms of audio samples and ordinates 504*a* to 504*i* describe windows or sub-frames for providing a time-domain representation of an audio content.

A graphical representation at reference numeral 510 shows a transition between subsequent frames encoded in the frequency-domain mode. As can be seen, a time-domain samples provided for a first right half of a frame (for example, by an inverse modified discrete cosine transform (MDCT) 320*g*) are windowed by a right half 512 of a window, which may, for example, be of window type "AAC Long" or of window type "AAC Stop". Similarly, the time-domain samples provided for a left half of a subsequent second frame (for example, by the MDCT 320*g*) may be windowed using a left half 514 of a window, which may, for example, be of window type "AAC Long" or "AAC Start". The right half 512 may, for example, comprise a comparatively long right sided transition slope and the left half 514 of the subsequent window may comprise a comparatively long left sided transition slope. A windowed version of the time-domain representation of the first audio frame (windowed using the right window half 512) and a windowed version of the time-domain representation of the subsequent second audio frame (windowed using the left window half 514) may be overlapped and added. Accordingly, aliasing, which arises from the MDCT, may be efficiently cancelled.

A graphical representation at reference numeral 520 shows a transition from a sub-frame encoded in the ACELP mode to a frame encoded in the frequency-domain mode. A forward-aliasing-cancellation may be applied to reduce aliasing artifacts at such a transition.

A graphical representation at reference numeral 530 shows a transition from a sub-frame encoded in the TCX-LPD mode to a frame encoded in the frequency-domain mode. As can be seen, a window 532 is applied to the time-domain samples provided by the inverse MDCT 380*h* of the TCX-LPD path, which window 532 may, for example, be of window type "TCX256", "TCX512", or "TCX1024.". The window 532 may comprise a right-sided transition slope 533 of length 128 time-domain samples. A window 534 is applied to time-domain samples provided by the MDCT of the frequency-domain path 370 for the subsequent audio frame encoded in the frequency-domain mode. The window 534 may, for example, be of window type "Stop Start" or "AAC Stop", and may comprise a left-sided transition slope 535 having a length of, for example, 128 time-domain samples. The time-domain samples of the TCX-LPD mode sub-frame which are windowed by the right-sided transition slope 533 are overlapped and added with the time-domain samples of the subsequent audio frame encoded in the frequency-domain mode which are windowed by the left-sided transition slope 535. The transition slopes 533 and 535 are matched, such that an aliasing-cancellation is obtained at the transition from the TCX-LPD-mode-encoded sub-frame and the subsequent frequency-domain-mode-encoded sub-frame. The aliasing-cancellation is made possible by the execution of the scaling/frequency-domain noise-shaping 380*e* before the execution of the inverse MDCT 380*h*. In other words, the aliasing-cancellation is caused by the fact that both, the inverse MDCT 320*g* of the frequency-domain path 370 and the inverse MDCT 380*h* of the TCX-LPD path 380 are fed with spectral coefficients to which the noise-shaping has already been applied (for example, in the form of the scaling factor-dependent scaling and the LPC filter coefficient dependent scaling).

A graphical representation at reference numeral 540 shows a transition from an audio frame encoded in the frequency-domain mode to a sub-frame encoded in the ACELP mode. As can be seen, a forward aliasing-cancellation (FAC) is applied in order to reduce, or even eliminate, aliasing artifacts at said transition.

A graphical representation at reference numeral 550 shows a transition from an audio sub-frame encoded in the ACELP mode to another audio sub-frame encoded in the ACELP mode. No specific aliasing-cancellation processing is necessitated here in some embodiments.

A graphical representation at reference numeral 560 shows a transition from a sub-frame encoded in the TCX-LPD mode (also designated as wLPT mode) to an audio sub-frame encoded in the ACELP mode. As can be seen, time-domain samples provided by the MDCT 380*h* of the TCX-LPD branch 380 are windowed using a window 562, which may, for example, be of window type "TCX256", "TCX512" or "TCX1024". Window 562 comprises a comparatively short right-sided transition slope 563. Time-domain samples provided for the subsequent audio sub-frame encoded in the ACELP mode comprise a partial temporal overlap with audio samples provided for the preceding TCX-LPD-mode-encoded audio sub-frame which are windowed by the right-sided transition slope 563 of the window 562. Time-domain audio samples provided for the audio sub-frame encoded in the ACELP mode are illustrated by a block at reference numeral 564.

As can be seen, a forward aliasing-cancellation signal 566 is added at the transition from the audio frame encoded in the TCX-LPD mode to the audio frame encoded in the ACELP mode in order to reduce or even eliminate aliasing artifacts. Details regarding the provision of the aliasing-cancellation signal 566 will be described below.

A graphical representation at reference numeral 570 shows a transition from a frame encoded in the frequency-domain mode to a subsequent frame encoded in the TCX-LPD mode. Time-domain samples provided by the inverse MDCT 320*g* of the frequency-domain branch 370 may be windowed by a window 572 having a comparatively short right-sided transition slope 573, for example, by a window of type "Stop Start" or a window of type "AAC Start". A time-domain representation provided by the inverse MDCT 380*h* of the TCX-LPD branch 380 for the subsequent audio sub-frame encoded in the TCX-LPD mode may be windowed by a window 574 comprising a comparatively short left-sided transition slope 575, which window 574 may, for example, be of window type "TCX256", TCX512", or "TCX1024". Time-domain samples windowed by the right-sided transition slope 573 and time-domain samples windowed by the left-sided transition slope 575 are overlapped and added by the transition windowing 398, such that aliasing artifacts are reduced, or even eliminated. Accordingly, no additional side information is necessitated for performing a transition from an audio frame encoded in the frequency-domain mode to an audio sub-frame encoded in the TCX-LPD mode.

A graphical representation at reference numeral 580 shows a transition from an audio frame encoded in the ACELP mode to an audio frame encoded in the TCX-LPD mode (also designated as wLPT mode). A temporal region for which time-domain samples are provided by the ACELP branch is designated with 582. A window 584 is applied to time-domain samples provided by the inverse MDCT 380*h* of the TCX-LPD branch 380. Window 584, which may be of type "TCX256", TCX512", or "TCX1024", may comprise a comparatively short left-sided transition slope 585. The left-sided transition slope 585 of the window 584 partially overlaps with the time-domain samples provided by the ACELP branch, which are represented by the block 582. In addition, an aliasing-cancellation signal 586 is provided to reduce, or even eliminate, aliasing artifacts which occur at the transition from the audio sub-frame encoded in the ACELP mode to the audio sub-frame encoded in the TCX-LPD mode. Details regarding the provision of the aliasing-cancellation signal 586 will be discussed below.

A schematic representation at reference numeral 590 shows a transition from an audio sub-frame encoded in the TCX-LPD mode to another audio sub-frame encoded in the TCX-LPD mode. Time-domain samples of a first audio sub-frame encoded in the TCX-LPD mode are windowed using a window 592, which may, for example, be of type "TCX256", TCX512", or "TCX1024", and which may comprise a comparatively short right-sided transition slope 593. Time-domain audio samples of a second audio sub-frame encoded in the TCX-LPD mode, which are provided by the inverse MDCT 380*h* of the TCX-LPD branch 380 are windowed, for example, using a window 594 which may be of the window type "TCX256", TCX512", or "TCX1024" and which may comprise a comparatively short left-sided transition slope 595. Time-domain samples windowed using the right-sided transitional slope 593 and time-domain samples windowed using the left-sided transition slope 595 are overlapped and added by the transitional windowing 398. Accordingly, aliasing, which is caused by the (inverse) MDCT 380*h* is reduced, or even eliminated.

4. Overview Over all Window Types

In the following, an overview of all window types will be provided. For this purpose, reference is made to FIG. 6, which shows a graphical representation of the different window types and their characteristics. In the table of FIG. 6, a column 610 describes a left-sided overlap length, which may be equal to a length of a left-sided transition slope. The column 612 describes a transform length, i.e. a number of spectral coefficients used to generate the time-domain representation which is windowed by the respective window. The column 614 describes a right-sided overlap length, which may be equal to a length of a right-sided transition slope. A column 616 describes a name of the window type. The column 618 shows a graphical representation of the respective window.

A first row 630 shows the characteristics of a window of type "AAC Short". A second row 632 shows the characteristics of a window of type "TCX256". A third row 634 shows the characteristics of a window of type "TCX512". A fourth row 636 shows the characteristics of windows of types "TCX1024" and "Stop Start". A fifth row 638 shows the characteristics of a window of type "AAC Long". A sixth row 640 shows the characteristics of a window of type "AAC Start", and a seventh row 642 shows the characteristics of a window of type "AAC Stop".

Notably, the transition slopes of the windows of types "TCX256", TCX512", and "TCX1024" are adapted to the right-sided transition slope of the window of type "AAC Start" and to the left-sided transition slope of the window of type "AAC Stop", in order to allow for a time-domain aliasing-cancellation by overlapping and adding time-domain representations windowed using different types of windows. In an embodiment, the left-sided window slopes (transition slopes) of all of the window types having identical left-sided overlap lengths may be identical, and the right-sided transition slopes of all window types having identical right-sided overlap lengths may be identical. Also, left-sided transition slopes and right-sided transition slopes having an identical overlap lengths may be adapted to allow for an aliasing-cancellation, fulfilling the conditions for the MDCT aliasing-cancellation.

5. Allowed Window Sequences

In the following, allowed window sequences will be described, taking reference to FIG. 7, which shows a table representation of such allowed windowed sequences. As can be seen from the table of FIG. 7, an audio frame encoded in the frequency-domain mode, the time-domain samples of which are windowed using a window of type "AAC Stop", may be followed by an audio frame encoded in the frequency-domain mode, the time-domain samples of which are windowed using a window of type "AAC Long" or a window of type "AAC Start".

An audio frame encoded in the frequency-domain mode, the time-domain samples of which are windowed using a window of type "AAC Long" may be followed by an audio frame encoded in the frequency-domain mode, the time-domain samples of which are windowed using a window of type "AAC Long" or "AAC Start".

Audio frames encoded in the linear prediction mode, the time-domain samples of which are windowed using a window of type "AAC Start", using eight windows of type "AAC Short" or using a window of type "AAC StopStart", may be followed by an audio frame encoded in the frequency-domain mode, the time-domain samples of which are windowed using eight windows of type "AAC Short", using a window of type "AAC Short" or using a window of type "AAC StopStart". Alternatively, audio frames encoded in the frequency-domain mode, the time-domain samples of which are windowed using a window of type "AAC Start", using eight windows of type "AAC Short" or using a window of type "AAC StopStart" may be followed by an audio frame or sub-frame encoded in the TCX-LPD mode (also designated as LPD-TCX) or by an audio frame or audio sub-frame encoded in the ACELP mode (also designated as LPD ACELP).

An audio frame or audio sub-frame encoded in the TCX-LPD mode may be followed by audio frames encoded in the frequency-domain mode, the time-domain samples of which are windowed using eight "AAC Short" windows, and using "AAC Stop" window or using an "AAC StopStart" window, or by an audio frame or audio sub-frame encoded in the TCX-LPD mode or by an audio frame or audio sub-frame encoded in the ACELP mode.

An audio frame encoded in the ACELP mode may be followed by audio frames encoded in the frequency-domain mode, the time-domain samples of which are windowed using eight "AAC Short" windows, using an "AAC Stop" window, using an "AAC StopStart" window, by an audio frame encoded in the TCX-LPD mode or by an audio frame encoded in the ACELP mode.

For transitions from an audio frame encoded in the ACELP mode towards an audio frame encoded in the frequency-domain mode or towards an audio frame encoded in the TCX-LPD mode, a so-called forward-aliasing-cancellation (FAC) is performed. Accordingly, an aliasing-cancellation synthesis signal is added to the time-domain representation at such a frame transition, whereby aliasing artifacts are reduced, or even eliminated. Similarly, a FAC is also performed when switching from a frame or sub-frame encoded in the frequency-domain mode, or from a frame or sub-frame encoded in the TCX-LPD mode, to a frame or sub-frame encoded in the ACELP mode.

Details regarding the FAC will be discussed below.

6. Audio Signal Encoder According to FIG. 8

In the following, a multi-mode audio signal encoder 800 will be described taking reference to FIG. 8.

The audio signal encoder 800 is configured to receive an input representation 810 of an audio content and to provide, on the basis thereof, a bitstream 812 representing the audio content. The audio signal encoder 800 is configured to operate in different modes of operation, namely a frequency-domain mode, a transform-coded-excitation-linear-prediction-domain mode and an algebraic-code-excited-linear-prediction-domain mode. The audio signal encoder 800 comprises and encoding controller 814 which is configured to select one of the modes for encoding a portion of the audio content in dependence on characteristics of the input representation 810 of the audio content and/or in dependence on an achievable encoding efficiency or quality.

The audio signal encoder 800 comprises a frequency-domain branch 820 which is configured to provide encoded spectral coefficients 822, encoded scale factors 824, and optionally, encoded aliasing-cancellation coefficients 826, on the basis of the input representation 810 of the audio content. The audio signal encoder 800 also comprises a TCX-LPD branch 850 configured to provide encoded spectral coefficients 852, encoded linear-prediction-domain parameters 854 and encoded aliasing-cancellation coefficients 856, in dependence on the input representation 810 of the audio content. The audio signal decoder 800 also comprises an ACELP branch 880 which is configured to provide an encoded ACELP excitation 882 and encoded linear-prediction-domain parameters 884 in dependence on the input representation 810 of the audio content.

The frequency-domain branch 820 comprises a time-domain-to-frequency-domain conversion 830 which is configured to receive the input representation 810 of the audio content, or a pre-processed version thereof, and to provide, on the basis thereof, a frequency-domain representation 832 of the audio content. The frequency-domain branch 820 also comprises a psychoacoustic analysis 834, which is configured to evaluate frequency masking effects and/or temporal masking effects of the audio content, and to provide, on the basis thereof, a scale factor information 836 describing scale factors. The frequency-domain branch 820 also comprises a spectral processor 838 configured to receive the frequency-domain representation 832 of the audio content and the scale factor information 836 and to apply a frequency-dependent and time-dependent scaling to the spectral coefficients of the frequency-domain representation 832 in dependence on the scale factor information 836, to obtain a scaled frequency-domain representation 840 of the audio content. The frequency-domain branch also comprises a quantization/encoding 842 configured to receive the scaled frequency-domain representation 840 and to perform a quantization and an encoding in order to obtain the encoded spectral coefficients 822 on the basis of the scaled frequency-domain representation 840. The frequency-domain branch also comprises a quantization/encoding 844 configured to receive the scale factor information 836 and to provide, on the basis thereof, an encoded scale factor information 824. Optionally, the frequency-domain branch 820 also comprises an aliasing-cancellation coefficient calculation 846 which may be configured to provide the aliasing-cancellation coefficients 826.

The TCX-LPD branch 850 comprises a time-domain-to-frequency-domain conversion 860, which may be configured to receive the input representation 810 of the audio content, and to provide on the basis thereof, a frequency-domain representation 861 of the audio content. The TCX-LPD branch 850 also comprises a linear-prediction-domain-parameter calculation 862 which is configured to receive the input representation 810 of the audio content, or a pre-processed version thereof, and to derive one or more linear-prediction-domain parameters (for example, linear-prediction-coding-filter-coefficients) 863 from the input representation 810 of the audio content. The TCX-LPD branch 850 also comprises a linear-prediction-domain-to-spectral domain conversion 864, which is configured to receive the linear-prediction-domain parameters (for example, the linear-prediction-coding filter coefficients) and to provide a spectral-domain representation or frequency-domain representation 865 on the basis thereof. The spectral-domain representation or frequency-domain representation of the linear-prediction-domain parameters may, for example, represent a filter response of a filter defined by the linear-prediction-domain parameters in a frequency-domain or spectral-domain. The TCX-LPD branch 850 also comprises a spectral processor 866, which is configured to receive the frequency-domain representation 861, or a pre-processed version 861' thereof, and the frequency-domain representation or spectral domain representation of the linear-prediction-domain parameters 863. The spectral processor 866 is configured to perform a spectral shaping of the frequency-domain representation 861, or of the pre-processed version 861' thereof, wherein the frequency-domain representation or spectral domain representation 865 of the linear-prediction-domain parameters 863 serves to adjust the scaling of the different spectral coefficients of the frequency-domain representation 861 or of the pre-processed version 861' thereof. Accordingly, the spectral processor 866 provides a spectrally shaped version 867 of the frequency-domain representation 861 or of the pre-processed version 861' thereof, in dependence on the linear-prediction-domain parameters 863. The TCX-LPD branch 850 also comprises a quantization/encoding 868 which is configured to receive the spectrally shaped frequency-domain representation 867 and to provide, on the basis thereof, encoded spectral coefficients 852. The TCX-LPD branch 850 also comprises another quantization/encoding 869, which is configured to receive the linear-prediction-domain parameters 863 and to provide, on the basis thereof, the encoded linear-prediction-domain parameters 854.

The TCX-LPD branch 850 further comprises an aliasing-cancellation coefficient provision which is configured to provide the encoded aliasing-cancellation coefficients 856. The aliasing cancellation coefficient provision comprises an error computation 870 which is configured to compute an aliasing error information 871 in dependence on the encoded spectral coefficients, as well as in dependence on the input representation 810 of the audio content. The error computation 870 may optionally take into consideration an information 872 regarding additional aliasing-cancellation components, which can be provided by other mechanisms. The aliasing-cancellation coefficient provision also comprises an analysis filter computation 873 which is configured to provide an information **873*a* describing an error filtering in dependence on the linear-prediction-domain parameters 863. The aliasing-cancellation coefficient provision also comprises an error analysis filtering 874, which is configured to receive the aliasing error information 871 and the analysis filter configuration information 873*a*, and to apply an error analysis filtering, which is adjusted in dependence on the analysis filtering information 873*a*, to the aliasing error information 871, to obtain a filtered aliasing error information 874*a*. The aliasing-cancellation coefficient provision also comprises a time-domain-to-frequency-domain conversion 875, which may take the functionality of a discrete cosine transform of type IV, and which is configured to receive the filtered aliasing error information 874*a* and to provide, on the basis thereof, a frequency-domain representation 875*a* of the filtered aliasing error information 874*a*. The aliasing-cancellation coefficient provision also comprises a quantization/encoding 876 which is configured to receive the frequency-domain representation 875*a* and, to provide on the basis thereof, encoded aliasing-cancellation coefficients 856, such that the encoded aliasing-cancellation coefficients 856 encode the frequency-domain representation 875*a***.

The aliasing-cancellation coefficient provision also comprises an optional computation 877 of an ACELP contribution to an aliasing-cancellation. The computation 877 may be configured to compute or estimate a contribution to an aliasing-cancellation which can be derived from an audio sub-frame encoded in the ACELP mode which precedes an audio frame encoded in the TCX-LPD mode. The computation of the ACELP contribution to the aliasing-cancellation may comprise a computation of a post-ACELP synthesis, a windowing of the post-ACELP synthesis and a folding of the windowed post-ACELP synthesis, to obtain the information 872 regarding the additional aliasing-cancellation components, which may be derived from a preceding audio sub-frame encoded in the ACELP mode. In addition, or alternatively, the computation 877 may comprise a computation of a zero-input response of a filter initialized by a decoding of a preceding audio sub-frame encoded in the ACELP mode and a windowing of said zero-input response, to obtain the information 872 about the additional aliasing-cancellation components.

In the following, the ACELP branch 880 will briefly be discussed. The ACELP branch 880 comprises a linear-prediction-domain parameter calculation 890 which is configured to compute linear-prediction-domain parameters 890*a* on the basis of the input representation 810 of the audio content. The ACELP branch 880 also comprises an ACELP excitation computation 892 configured to compute an ACELP excitation information 892 in dependence on the input representation 810 of the audio content and the linear-prediction-domain parameters 890*a*. The ACELP branch 880 also comprises an encoding 894 configured to encode the ACELP excitation information 892, to obtain the encoded ACELP excitation 882. In addition, the ACELP branch 880 also comprises a quantization/encoding 896 configured to receive the linear-prediction-domain parameters 890*a* and to provide, on the basis thereof, the encoded linear-prediction-domain parameters 884.

The audio signal decoder 800 also comprises a bitstream formatter 898 which is configured to provide the bitstream 812 on the basis of the encoded spectral coefficients 822, the encoded scale factor information 824, the aliasing-cancellation coefficients 826, the encoded spectral coefficients 852, the encoded linear-prediction-domain parameters 852, the encoded aliasing-cancellation coefficients 856, the encoded ACELP excitation 882, and the encoded linear-prediction-domain parameters 884.

Details regarding the provision of the encoded aliasing-cancellation coefficients 852 will be described below.

7. Audio Signal Decoder According to FIG. 9

In the following, an audio signal decoder 900 according to FIG. 9 will be described.

The audio signal decoder 900 according to FIG. 9 is similar to the audio signal decoder 200 according to FIG. 2 and also to the audio signal decoder 360 according to FIG. 3*b*, such that the above explanations also hold.

The audio signal decoder 900 comprises a bit multiplexer 902 which is configured to receive a bitstream and to provide information extracted from the bitstream to the corresponding processing paths.

The audio signal decoder 900 comprises a frequency-domain branch 910, which is configured to receive encoded spectral coefficients 912 and an encoded scale factor information 914. The frequency-domain branch 910 is optionally configured to also receive encoded aliasing-cancellation coefficients, which allow for a so-called forward-aliasing-cancellation, for example, at a transition between an audio frame encoded in the frequency-domain mode and an audio frame encoded in the ACELP mode. The frequency-domain path 910 provides a time-domain representation 918 of the audio content of the audio frame encoded in the frequency-domain mode.

The audio signal decoder 900 comprises a TCX-LPD branch 930, which is configured to receive encoded spectral coefficients 932, encoded linear-prediction-domain parameters 934 and encoded aliasing-cancellation coefficients 936, and to provide, on the basis thereof, a time-domain representation of an audio frame or a sub-frame encoded in the TCX-LPD mode. The audio signal decoder 900 also comprises an ACELP branch 980, which is configured to receive an encoded ACELP excitation 982 and encoded linear-prediction-domain parameters 984, and to provide, on the basis thereof, a time-domain representation 986 of an audio frame or audio sub-frame encoded in the ACELP mode.

7.1 Frequency Domain Path

In the following, details regarding the frequency domain path 910 will be described. It should be noted that the frequency-domain path is similar to the frequency-domain path 320 of the audio decoder 300, such that reference is made to the above description. The frequency-domain branch 910 comprises an arithmetic decoding 920, which receives the encoded spectral coefficients 912 and provides, on the basis thereof, the coded spectral coefficients 920*a*, and an inverse quantization 921 which receives the decoded spectral coefficients 920*a*, and provides, on the basis thereof, inversely quantized spectral coefficients 921*a*. The frequency-domain branch 910 also comprises a scale factor decoding 922, which receives the encoded scale factor information and provides, on the basis thereof, a decoded scale factor information 922*a*. The frequency-domain branch comprises a scaling 923 which receives the inversely quantized spectral coefficients 921*a* and scales the inversely quantized spectral coefficients in accordance with the scale factors 922*a*, to obtain scaled spectral coefficients 923*a*. For example, scale factors 922*a* may be provided for a plurality of frequency bands, wherein a plurality of frequency bins of the spectral coefficients 921*a* are associated to each frequency-band. Accordingly, frequency band-wise scaling of the spectral coefficients 921*a* may be performed. Thus, a number of scale factors associated with an audio frame is typically smaller than a number of spectral coefficients 921*a* associated with the audio frame. The frequency-domain branch 910 also comprises an inverse MDCT 924, which is configured to receive the scaled spectral coefficients 923*a* and to provide, on the basis thereof, a time-domain representation 924*a* of the audio content of the current audio frame. The frequency domain, branch 910 also, optionally, comprises a combining 925, which is configured to combine the time-domain representation 924*a* with an aliasing-cancellation synthesis signal 929*a*, to obtain the time-domain representation 918. However, in some other embodiments the combining 925 may be omitted, such that the time-domain representation 924*a* is provided as the time-domain representation 918 of the audio content.

In order to provide the aliasing-cancellation synthesis signal 929*a*, the frequency-domain path comprises a decoding 926*a*, which provides decoded aliasing-cancellation coefficients 926*b*, on the basis of the encoded aliasing-cancellation coefficients 916, and a scaling 926*c* of aliasing-cancellation coefficients, which provides scaled aliasing-cancellation coefficients 926*d* on the basis of the decoded aliasing-cancellation coefficients 926*b*. The frequency-domain path also comprises an inverse discrete-cosine-transform of type IV 927, which is configured to receive the scaled aliasing-cancellation coefficients 926*d*, and to provide, on the basis thereof, an aliasing-cancellation stimulus signal 927*a*, which is input into a synthesis filtering 927*b*. The synthesis filtering 927*b* is configured to perform a synthesis filtering operation on the basis of the aliasing-cancellation stimulus signal 927*a* and in dependence on synthesis filtering coefficients 927*c*, which are provided by a synthesis filter computation 927*d*, to obtain, as a result of the synthesis filtering, the aliasing-cancellation signal 929*a*. The synthesis filter computation 927*d* provides the synthesis filter coefficients 927*c* in dependence on the linear-prediction-domain parameters, which may be derived, for example, from linear-prediction-domain parameters provided in the bitstream for a frame encoded in the TCX-LPD mode, or for a frame provided in the ACELP mode (or may be equal to such linear-prediction-domain parameters).

Accordingly, the synthesis filtering 927*b* is capable of providing the aliasing-cancellation synthesis signal 929*a*, which may be equivalent to the aliasing-cancellation synthesis signal 522 shown in FIG. 5, or to the aliasing-cancellation synthesis signal 542 shown in FIG. 5.

7.2 TCX-LPD Path

In the following, the TCX-LPD path of the audio signal decoder 900 will briefly be discussed. Further details will be provided below.

The TCX-LPD path 930 comprises a main signal synthesis 940 which is configured to provide a time-domain representation 940*a* of the audio content of an audio frame or audio sub-frame on the basis of the encoded spectral coefficients 932 and the encoded linear-prediction-domain parameters 934. The TCX-LPD branch 930 also comprises an aliasing-cancellation processing which will be described below.

The main signal synthesis 940 comprises an arithmetic decoding 941 of spectral coefficients, wherein the decoded spectral coefficients 941*a* are obtained on the basis of the encoded spectral coefficients 932. The main signal synthesis 940 also comprises an inverse quantization 942, which is configured to provide inversely quantized spectral coefficients 942*a* on the basis of the decoded spectral coefficients 941*a*. An optional noise filling 943 may be applied to the inversely quantized spectral coefficients 942*a* to obtain noise-filled spectral coefficients. The inversely quantized and noise-filled spectral coefficient 943*a* may also be designated with r[i]. The inversely quantized and noise-filled spectral coefficients 943*a*, r[i] may be processed by a spectrum de-shaping 944, to obtain spectrum de-shaped spectral coefficients 944*a*, which are also sometimes designated with r[i]. A scaling 945 may be configured as a frequency-domain noise shaping 945. In the frequency-domain noise-shaping 945, a spectrally shaped set of spectral coefficients 945*a* are obtained, which are also designated with rr[i]. In the frequency-domain noise-shaping 945, contributions of the spectrally de-shaped spectral coefficients 944*a* onto the spectrally shaped spectral coefficients 945*a* are determined by frequency-domain noise-shaping parameters 945*b*, which are provided by a frequency-domain noise-shaping parameter provision which will be discussed in the following. By means of the frequency-domain noise-shaping 945, spectral coefficients of the spectrally de-shaped set of spectral coefficients 944*a* are given a comparatively large weight, if a frequency-domain response of a linear-prediction filter described by the linear-prediction-domain parameters 934 takes a comparatively small value for the frequency associated with the respective spectral coefficient (out of the set 944*a* of spectral coefficients) under consideration. In contrast, a spectral coefficient out of the set 944*a* of spectral coefficient is given a comparatively larger weight when obtaining the corresponding spectral coefficients of the set 945*a* of spectrally shaped spectral coefficients, if the frequency-domain response of a linear-prediction filter described by the linear-prediction-domain parameters 934 takes a comparatively small value for the frequency associated with the spectral coefficient (out of the set 944*a*) under consideration. Accordingly, a spectral shaping, which is defined by the linear-prediction-domain parameters 934, is applied in the frequency-domain when deriving the spectrally-shaped spectral coefficient 945*a* from the spectrally de-shaped spectral coefficient 944*a*.

The main signal synthesis 940 also comprises an inverse MDCT 946, which is configured to receive the spectrally-shaped spectral coefficients 945*a*, and to provide, on the basis thereof, a time-domain representation 946*a*. A gain scaling 947 is applied to the time-domain representation 946*a*, to derive the time-domain representation 940*a* of the audio content from the time-domain signal 946*a*. A gain factor g is applied in the gain scaling 947, which is a frequency-independent (non-frequency selective) operation.

The main signal synthesis also comprises a processing of the frequency-domain noise-shaping parameters 945*b*, which will be described in the following. For the purpose of providing the frequency-domain noise-shaping parameters 945*b*, the main signal synthesis 940 comprises a decoding 950, which provides decoded linear-prediction-domain parameters 950*a* on the basis of the encoded linear-prediction-domain parameters 934. The decoded linear-prediction-domain parameters may, for example, take the form of a first set LPC1 of decoded linear-prediction-domain parameters and a second set LPC2 of linear-prediction-domain parameters. The first set LPC1 of the linear-prediction-domain parameters may, for example, be associated with a left-sided transition of a frame or sub-frame encoded in the TCX-LPD mode, and the second set LPC2 of linear-prediction-domain parameters may be associated with a right-sided transition of the TCX-LPD encoded audio frame or audio sub-frame. The decoded linear-prediction-domain parameters are fed into a spectrum computation 951, which provides a frequency-domain representation of an impulse response defined by the linear-prediction-domain parameters 950*a*. For example, separate sets of frequency-domain coefficients $X_0[k]$ may be provided for the first set LPC1 and for the second set LPC2 of decoded linear-prediction-domain parameters 950.

A gain computation 952 maps the spectral values $X_0[k]$ onto gain values, wherein a first set of –gain values $g_1[k]$ is associated with the first set LPC1 of spectral coefficients and wherein a second set of gain values $g_2[k]$ is associated with the second set LPC2 of spectral coefficients. For example, the gain values may be inversely proportional to a magnitude of the corresponding spectral coefficients. A filter parameter computation 953 may receive the gain values 952*a* and provide, on the basis thereof, filter parameters 945*b* for the frequency-domain shaping 945. For example, filter parameters a[i] and b[i] may be provided. The filter parameters 945*d* determine the contribution of spectrally de-shaped spectral coefficients 944*a* onto the spectrally-scaled spectral coefficients 945*a*. Details regarding a possible computation of the filter parameters will be provided below.

The TCX-LPD branch 930 comprises a forward-aliasing-cancellation synthesis signal computation, which comprises two branches. A first branch of the (forward) aliasing-cancellation synthesis signal generation comprises a decoding 960, which is configured to receive encoded aliasing-cancellation coefficients 936, and to provide on the basis thereof, decoded aliasing-cancellation coefficients 960*a*, which are scaled by a scaling 961 in dependence on a gain value g to obtain a scaled aliasing-cancellation coefficients 961*a*. The same gain value g may be used for the scaling 961 of the aliasing-cancellation coefficients 960*a* and for the gain scaling 947 of the time-domain signal 946*a* provided by the inverse MDCT 946 in some embodiments. The aliasing-cancellation synthesis signal generation also comprises a spectrum de-shaping 962, which may be configured to apply a spectrum de-shaping to the scaled aliasing-cancellation coefficients 961*a*, to obtain gain scaled and spectrum de-shaped aliasing-cancellation coefficients 962*a*. The spectrum de-shaping 962 may be performed in a similar manner to the spectrum de-shaping 944, which shall be described in more detail below. The gain-scaled and spectrum de-shaped aliasing-cancellation coefficients 962*a* are input into an inverse discrete-cosine-transform of type IV, which is designated with reference numeral 963, and which provides an aliasing-cancellation stimulus signal 963*a* as a result of the inverse-discrete-cosine-transform which is performed on the basis of the gain-scaled spectrally de-shaped aliasing-cancellation coefficients 962*a*. A synthesis filtering 964 receives the aliasing-cancellation stimulus signal 963*a* and provides a first forward aliasing-cancellation synthesis signal 964*a* by synthesis filtering the aliasing-cancellation stimulus signal 963*a* using a synthesis filter configured in dependence on synthesis filter coefficients 965*a*, which are provided by the synthesis filter computation 965 in dependence on the linear-prediction-domain parameters LPC1, LPC2. Details regarding the synthesis filtering 964 and the computation of the synthesis filter coefficients 965*a* will be described below.

The first aliasing-cancellation synthesis signal 964*a* is consequently based on the aliasing-cancellation coefficients 936 as well as on the linear-prediction-domain-parameters. A good consistency between the aliasing-cancellation synthesis signal 964*a* and the time-domain representation 940*a* of the audio content is reached by applying the same scaling factor g both in the provision of the time-domain representation 940*a* of the audio content and in the provision of the aliasing-cancellation synthesis signal 964, and by applying similar, or even identical, spectrum de-shaping 944, 962 in the provision of the time-domain representation 940*a* of the audio content and in the provision of the aliasing-cancellation synthesis signal 964.

The TCX-LPD branch 930 further comprises a provision of additional aliasing-cancellation synthesis signals 973*a*, 976*a* in dependence on a preceding ACELP frame or sub-frame. This computation 970 of an ACELP contribution to the aliasing-cancellation is configured to receive ACELP information such as, for example a time-domain representation 986 provided by the ACELP branch 980 and/or a content of an ACELP synthesis filter. The computation 970 of the ACELP contribution to aliasing-cancellation comprises a computation 971 of a post-ACELP synthesis 971*a*, a windowing 972 of the post-ACELP synthesis 971*a* and a folding 973 of the post-ACELP synthesis 972*a*. Accordingly, a windowed and folded post-ACELP synthesis 973*a* is obtained by the folding of the windowed post-ACELP synthesis 972*a*. In addition, the computation 970 of an ACELP contribution to the aliasing cancellation also comprises a computation 975 of a zero-input response, which may be computed for a synthesis filter used for synthesizing a time-domain representation of a previous ACELP sub-frame, wherein the initial state of said synthesis filter may be equal to the state of the ACELP synthesis filter at the end of the previous ACELP sub-frame. Accordingly, a zero-input response 975*a* is obtained, to which a windowing 976 is applied in order to obtain a windowed zero-input response 976*a*. Further details regarding the provision of the windowed zero-input response 976*a* will be described below.

Finally, a combining 978 is performed to combine the time-domain representation 940*a* of the audio content, the first forward-aliasing-cancellation synthesis signal 964*a*, the second forward-aliasing-cancellation synthesis signal 973*a* and the third forward-aliasing-cancellation synthesis signal 976*a*. Accordingly, the time-domain representation 938 of the audio frame or audio sub-frame encoded in the TCX-LPD mode is provided as a result of the combining 978, as will be described in more detail below.

7.3 ACELP Path

In the following, the ACELP branch 980 of the audio signal decoder 900 will briefly be described. The ACELP branch 980 comprises a decoding 988 of the encoded ACELP excitation 982, to obtain a decoded ACELP excitation 988*a*. Subsequently, an excitation signal computation and post-processing 989 of the excitation are performed to obtain a post-processed excitation signal 989*a*. The ACELP branch 980 comprises a decoding 990 of linear-prediction-domain parameters 984, to obtain decoded linear-prediction-domain parameters 990*a*. The post-processed excitation signal 989*a* is filtered, and the synthesis filtering 991 performed, in dependence on the linear-prediction-domain parameters 990*a* to obtain a synthesized ACELP signal 991*a*. The synthesized ACELP signal 991*a* is then processed using a post-processing 992 to obtain the time-domain representation 986 of an audio sub-frame encoded in the ACELP load.

7.4 Combining

Finally, a combining 996 is performed in order to obtain the time-domain representation 918 of an audio frame encoded in the frequency-domain mode, the time-domain representation 938 of an audio frame encoded in the TCX-LPD mode, and the time-domain representation 986 of an audio frame encoded in the ACELP mode, to obtain a time-domain representation 998 of the audio content.

Further details Will be described in the following.

8. Encoder and Decoder Details 8.1 LPC Filter 8.1.1 Tool Description.

In the following, details regarding the encoding and decoding using linear-prediction coding filter coefficients will be described.

In the ACELP mode, transmitted parameters include LPC filters 984, adaptive and fixed-codebook indices 982, adaptive and fixed-codebook gains 982.

In the TCX mode, transmitted parameters include LPC filters 934, energy parameters, and quantization indices 932 of MDCT coefficients. This section describes the decoding of the LPC filters, for example of the LPC filter coefficients $a_1$ to $a_{16}$, 950*a*, 990*a*.

8.1.2 Definitions

In the following, some definitions will be given.

The parameter "nb_lpc" describes an overall number of LPC parameters sets which are decoded in the bit stream.

The bitstream parameter "mode_lpc" describes a coding mode of the subsequent LPC parameters set.

The bitstream parameter "lpc[k][x]" describes an LPC parameter number x of set k.

The bitstream parameter "qn k" describes a binary code associated with the corresponding codebook numbers $n_k$.

8.1.3 Number of LPC Filters

The actual number of LPC filters "nb_lpc" which are encoded within the bitstream depends on the ACELP/TCX mode combination of the superframe, wherein a super frame may be identical to a frame comprising a plurality of sub-frames. The ACELP/TCX mode combination is extracted from the field "lpd_mode" which in turn determines the coding modes, "mod [k]" for k=0 to 3, for each of the 4 frames (also designated as sub-frames) composing the superframe. The mode value is 0 for ACELP, 1 for short TCX (256 samples), 2 for medium size TCX (512 samples), 3 for long TCX (1024 samples). It should be noted here that the bitstream parameter "lpd_mode" which may be considered as a bit-field "mode" defines the coding modes for each of the four frames within the one superframe of the linear-prediction-domain channel stream (which corresponds to one frequency-domain mode audio frame such as, for example, an advanced-audio-coding frame or an AAC frame). The coding modes are stored in an array "mod [ ]" and take values from 0 to 3. The mapping from the bitstream parameter "LPD_mode" to the array "mod [ ]" can be determined from table 7.

Regarding the array "mod [0 . . . 3]" it can be said that the array "mod [ ]" indicates the respective coding modes in each frame. For details reference is made to table 8, which describes the coding modes indicated by the array "mod [ ].

TABLE 7

MAPPING OF CODING MODES FOR LPD_CHANNEL_STREAM( )

| | meaning of bits in bit-field mode | | | | | remaining |
|---|---|---|---|---|---|---|
| lpd_mode | bit 4 | bit 3 | bit 2 | bit 1 | bit 0 | mod[ ] enties |
| 0 . . . 15 | 0 | mod[3] | mod[2] | mod[1] | mod[0] | |
| 16 . . . 19 | 1 | 0 | 0 | mod[3] | mod[2] | mod[1] = 2 |
| | | | | | | mod[0] = 2 |
| 20 . . . 23 | 1 | 0 | 1 | mod[1] | mod[0] | mod[3] = 2 |
| | | | | | | mod[2] = 2 |
| 24 | 1 | 1 | 0 | 0 | 0 | mod[3] = 2 |
| | | | | | | mod[2] = 2 |
| | | | | | | mod[1] = 2 |
| | | | | | | mod[0] = 2 |
| 25 | 1 | 1 | 0 | 0 | 1 | mod[3] = 3 |
| | | | | | | mod[2] = 3 |
| | | | | | | mod[1] = 3 |
| | | | | | | mod[0] = 3 |
| 26 . . . 31 | | | | | | reserved |

TABLE 8

| value of mod[x] | coding mode in frame | bitstream element |
|---|---|---|
| 0 | ACELP | acelp_coding( ) |
| 1 | one frame of TCX | tcx_coding( ) |
| 2 | TCX covering half a superframe | tcx_coding( ) |
| 3 | TCX covering entire a superframe | tcx_coding( ) |

In addition to the 1 to 4 LPC filters of the superframe, an optional LPC filter LPC0 is transmitted for the first superframe of each segment encoded using the LPD core codec. This is indicated to the LPC decoding procedure by a flag "first_lpd_flag" set to 1.

The order in which the LPC filters are normally found in the bitstream is: LPC4, the optional LPC0, LPC2, LPC1, and LPC3. The condition for the presence of a given LPC filter within the bitstream is summarized in Table 1. Table 1 shows conditions for the presence of a given LPC filter in a bitstream.

TABLE 1

CONDITIONS FOR THE PRESENCE OF A GIVEN LPC FILTER IN THE BITSTREAM

| LPC filter | present if |
|---|---|
| LPC 0 | first_lpd_flag = 1 |
| LPC 1 | mod[0] < 2 |
| LPC 2 | mod[2] < 3 |
| LPC 3 | mod[2] < 2 |
| LPC 4 | always |

The bitstream is parsed to extract the quantization indices corresponding to each of the LPC filters necessitated by the ACELP/TCX mode combination. The following describes the operations needed to decode one of the LPC filters.

8.1.4 General Principle of the Inverse Quantizer

Figure 13:
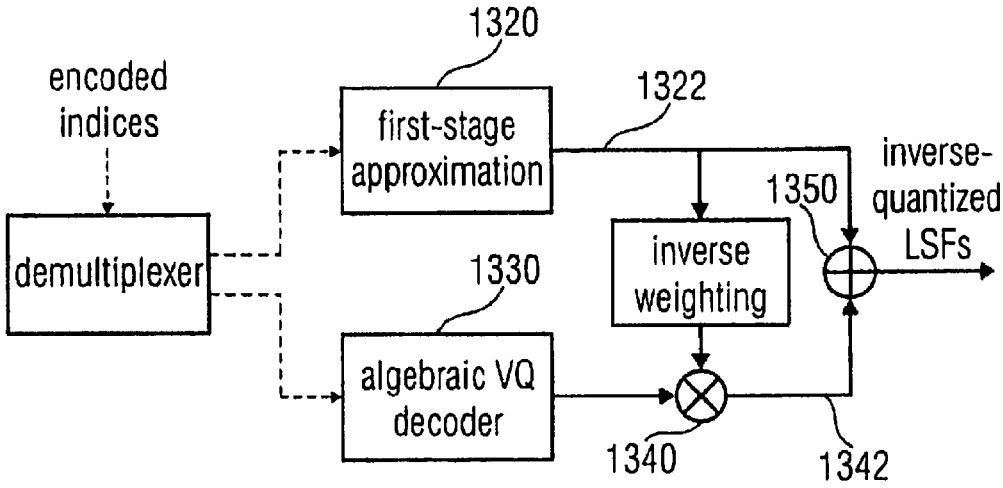
FIG. 13 shows a schematic representation of a principle of a weighted algebraic LPC inverse quantizer.

Inverse quantization of an LPC filter, which may be performed in the decoding 950 or in the decoding 990, is performed as described in FIG. 13. The LPC filters are quantized using the line-spectral-frequency (LSF) representation. A first-stage approximation is first computed as described in section 8.1.6. An optional algebraic vector quantized (AVQ) refinement 1330 is then calculated as described in section 8.1.7. The quantized LSF vector is reconstructed by adding 1350 the first-stage approximation and the inverse-weighted AVQ contribution 1342. The presence of an AVQ refinement depends on the actual quantization mode of the LPC filter, as explained in section 8.1.5. The inverse-quantized LSF vector is later on converted into a vector of LSP (line spectral pair) parameters, then interpolated and converted again into LPC parameters.

8.1.5 Decoding of the LPC Quantization Mode

In the following, the decoding of the LPC quantization mode will be described, which may be part of the decoding 950 of or the decoding 990.

LPC4 is quantized using an absolute quantization approach. The other LPC filters can be quantized using either an absolute quantization approach, or one of several relative quantization approaches. For these LPC filters, the first information extracted from the bitstream is the quantization mode. This information is denoted "mode_lpc" and is signaled in the bitstream using a variable-length binary code as indicated in the last column of Table 2. Table 2 shows a representation of possible absolute and relative quantization modes and corresponding bitstream signaling of "mode_lpc."

TABLE 2

POSSIBLE ABSOLUTE AND RELATIVE QUANTIZATION MODES AND CORRESPONDING BITSTREAM SIGNALLING OF MODE_LPC

| filter | quantization mode | mode_ipc | binary code |
|---|---|---|---|
| LPC4 | absolute | 0 | (none) |
| LPC0 | absolute | 0 | 0 |
| | relative LPC4 | 1 | 1 |
| LPC2 | absolute | 0 | 0 |
| | relative LPC4 | 1 | 1 |
| LPC1 | absolute | 0 | 10 |
| | relative (LPC0 + LPC2)/2 (Note 1) | 1 | 11 |
| | relative LPC2 | 2 | 0 |
| LPC3 | absolute | 0 | 10 |
| | relative (LPC2 + LPC4)/2 | 1 | 0 |
| | relative LPC2 | 2 | 110 |
| | relative LPC4 | 3 | 111 |

Note 1:
in this mode, there is no second-stage AVQ quantizer 8.1.6 First-Stage Approximation For each LPC filter, the quantization mode determines how the first-stage approximation of FIG. 13 is computed.

For the absolute quantization mode (mode_lpc=0), an 8-bit index corresponding to a stochastic VQ-quantized first stage approximation is extracted from the bitstream. The first-stage approximation 1320 is then computed by a simple table look-up.

For relative quantization modes, the first-stage approximation is computed using already inverse-quantized LPC filters, as indicated in the second column of Table 2. For example, for LPC0 there is only one relative quantization mode for which the inverse-quantized LPC4 filter constitutes the first-stage approximation. For LPC1, there are two possible relative quantization modes, one where the inverse-quantized LPC2 constitutes the first-stage approximation, the other for which the average between the inverse-quantized LPC0 and LPC2 filters constitutes the first-stage approximation. As all other operations related to LPC quantization, computation of the first-stage approximation is done in the line spectal frequency (LSF) domain.

8.1.7 AVQ Refinement 8.1.7.1 General

The next information extracted from the bitstream is related to the AVQ refinement needed to build the inverse-quantized LSF vector. The only exception is for LPC1: the bitstream contains no AVQ refinement when this filter is encoded relatively to (LPC0+LPC2)/2.

The AVQ is based on the 8-dimensional $RE_8$ lattice vector quantizer used to quantize the spectrum in TCX modes in AMR-WB+. Decoding the LPC filters involves decoding the two 8-dimensional sub-vectors $\hat{B}_k$, k=1 and 2, of the weighted residual LSF vector.

The AVQ information for these two subvectors is extracted from the bitstream. It comprises two encoded codebook numbers "qn1" and "qn2", and the corresponding AVQ indices. These parameters are decoded as follows.

8.1.7.2 Decoding of Codebook Numbers

The first parameters extracted from the bitstream in order to decode the AVQ refinement are the two codebook numbers $n_k$, k=1 and 2, for each of the two subvectors mentioned above. The way the codebook numbers are encoded depends on the LPC filter (LPC0 to LPC4) and on its quantization mode (absolute or relative). As shown in Table 3, there are four different ways to encode $n_k$. Table 3 shows a table representation of coding modes for codebook numbers $n_k$.

TABLE 3

CODING MODES FOR CODEBOOK NUMBERS $n_k$

| filter | quantization mode | $n_k$ mode |
|---|---|---|
| LPC4 | absolute | 0 |
| LPC0 | absolute | 0 |
| | relative LPC4 | 3 |
| LPC2 | absolute | 0 |
| | relative LPC4 | 3 |
| LPC1 | absolute | 0 |
| | relative (LPC0 + LPC2)/2 | 1 |
| | relative LPC2 | 2 |
| LPC3 | absolute | 0 |
| | relative (LPC2 + LPC4)/2 | 1 |
| | relative LPC2 | 2 |
| | relative LPC4 | 2 |

The details on the codes used for $n_k$ are given below.

$n_k$ modes 0 and 3:

The codebook number $n_k$ is encoded as a variable length code qnk, as follows:

$Q_2 \rightarrow$the code for $n_k$ is 00
$Q_3 \rightarrow$the code for $n_k$ is 01
$Q_4 \rightarrow$the code for $n_k$ is 10
Others: the code for $n_k$ is 11 followed by:
$Q_5 \rightarrow 0$
$Q_6 \rightarrow 10$
$Q_0 \rightarrow 110$
$Q_7 \rightarrow 1110$
$Q_8 \rightarrow 11110$
etc.

$n_k$ mode 1:

The codebook number $n_k$ is encoded as a unary code qnk, as follows:

$Q_0 \rightarrow$unary code for $n_k$ is 0
$Q_2 \rightarrow$unary code for $n_k$ is 10
$Q_3 \rightarrow$unary code for $n_k$ is 110
$Q_4 \rightarrow$unary code for $n_k$ is 1110
etc.

$n_k$ mode 2:

The codebook number $n_k$ is encoded as a variable length code qnk, as follows:

$Q_2 \rightarrow$the code for $n_k$ is 00
$Q_3 \rightarrow$the code for $n_k$ is 01
$Q_4 \rightarrow$the code for $n_k$ is 10
Others: the code for $n_k$ is 11 followed by:
$Q_0 \rightarrow 0$
$Q_5 \rightarrow 10$
$Q_6 \rightarrow 110$
etc.

8.1.7.3 Decoding of AVQ Indices

Decoding the LPC filters involves decoding the algebraic VQ parameters describing each quantized sub-vector $\hat{B}_k$ of the weighted residual LSF vectors. Recall that each block $B_k$ has dimension 8. For each block $\hat{B}_k$, three sets of binary indices are received by the decoder:

a) the codebook number $n_k$, transmitted using an entropy code "qnk" as described above;
b) the rank $I_k$ of a selected lattice point z in a so-called base codebook, which indicates what permutation has to be applied to a specific leader to obtain a lattice point z;
c) and, if the quantized block $\hat{B}_k$ (a lattice point) was not in the base codebook, the 8 indices of the Voronoi extension index vector k; from the Voronoi extension indices, an extension vector v can be computed. The number of bits in each component of index vector k is given by the extension order r, which can be obtained from the code value of index $n_k$. The scaling factor M of the Voronoi extension is given by $M=2^r$.

Then, from the scaling factor M, the Voronoi extension vector v (a lattice point in $RE_8$) and the lattice point z in the base codebook (also a lattice point in $RE_8$), each quantized scaled block $\hat{B}_k$ can be computed as:

$$\hat{B}_k = Mz + v.$$

When there is no Voronoi extension (i.e. $n_k<5$, M=1 and z=0), the base codebook is either codebook $Q_0$, $Q_2$, $Q_3$ or $Q_4$ from M. Xie and J.-P. Adoul, "Embedded algebraic vector quantization (EAVQ) with application to wideband audio coding, "IEEE International Conference on Acoustics, Speech, and Signal Processing (ICASSP), Atlanta, Ga., USA, vol. 1, pp. 240-243, 1996. No bits are then necessitated to transmit vector k. Otherwise, when Voronoi extension is used because $\hat{B}_k$ is large enough, then only $Q_3$ or $Q_4$ from the above reference is used as a base codebook. The selection of $Q_3$ or $Q_4$ is implicit in the codebook number value $n_k$.

8.1.7.4 Computation of the LSF Weights

At the encoder, the weights applied to the components of the residual LSF vector before AVQ quantization are:

$$w(i) = \frac{1}{W} * \frac{400}{\sqrt{d_i \cdot d_{i+1}}},\ i = 0 \ldots 15$$

with:

$d_0$=LSF1st[0]

$d_{16}$=SF/2−LSF1st[15]

$d_i$=LSF1st[$i$]−LSF1st[$i$−1],$i$=1 . . . 15 where LSF1st is the $1^{st}$ stage LSF approximation and W is a scaling factor which depends on the quantization mode (Table 4). Table 4 shows a table representation of a normalization vector W for AVQ quantization. The corresponding inverse weighting 1340 is applied at the decoder to retrieve the quantized residual LSF vector.

TABLE 4

NORMALIZATION FACTOR W FOR AVG QUANTIZATION

| filter | quantization mode | W |
|---|---|---|
| LPC4 | absolute | 60 |
| LPC0 | absolute | 60 |
| | relative LPC4 | 63 |
| LPC2 | absolute | 60 |
| | relative LPC4 | 63 |
| LPC1 | absolute | 60 |
| | relative (LPC0 + LPC2)/2 | 65 |
| | relative LPC2 | 64 |
| LPC3 | absolute | 60 |
| | relative (LPC2 + LPC4)/2 | 65 |
| | relative LPC2 | 64 |
| | relative LPC4 | 64 |

8.1.7.5 Reconstruction of the Inverse-Quantized LSF Vector

The inverse-quantized LSF vector is obtained by, first, concatenating the two AVQ refinement subvectors $\hat{B}_1$ and $\hat{B}_2$ decoded as explained in sections 8.1.7.2 and 8.1.7.3 to form one single weighted residual LSF vector, then, applying to this weighted residual LSF vector the inverse of the weights computed as explained in section 8.1.7.4 to form the residual LSF vector, and then again, adding this residual LSF vector to the first-stage approximation computed as in section 8.1.6.

8.1.8 Reordering of Quantized LSFs

Inverse-quantized LSFs are reordered and a minimum distance between adjacent LSFs of 50 Hz is introduced before they are used.

8.1.9 Conversion into LSP Parameters

The inverse quantization procedure described so far results in the set of LPC parameters in the LSF domain. The LSFs are then converted to the cosine domain (LSPs) using the relation $q_i=\cos(\omega_i)$, i=1, . . . , 16 with $\omega_i$ being the line spectral frequencies (LSF).

8.1.10 Interpolation of LSP Parameters

For each ACELP frame (or sub-frame), although only one LPC filter corresponding to the end of the frame is transmitted, linear interpolation is used to obtain a different filter in each sub-frame (or part of a sub-frame) (4 filters per ACELP frame or sub-frame). The interpolation is performed between the LPC filter corresponding to the end of the previous frame (or sub-frame) and the LPC filter corresponding to the end of the (current) ACELP frame. Let $LSP^{(new)}$ be the new available LSP vector and $LsP^{(old)}$ the previously available LSP vector. The interpolated LSP vectors for the $N_{sfr}$=4 sub-frames are given by $$LSP_i = \left(0.875 - \frac{i}{N_{sfr}}\right) LSP^{(old)} + \left(0.125 + \frac{i}{N_{sfr}}\right) LSP^{(new)}$$

for $i = 0, \ldots, N_{sfr} - 1$

The interpolated LSP vectors are used to compute a different LP filter at each sub-frame using the LSP to LP conversion method described in below.

8.1.11 LSP to LP Conversion

For each sub-frame, the interpolated LSP coefficients are converted into LP filter coefficients $a_k$, 950*a*, 990*a*, which are used for synthesizing the reconstructed signal in the sub-frame. By definition, the LSPs of a $16^{th}$ order LP filter are the roots of the two polynomials $$F_1'(z)=A(z)+z^{-17}A(z^{-1})$$

and $$F_2'(z)=A(z)-z^{-17}A(z^{-1})$$

which can be expressed as $$F_1'(z)=(1+z^{-1})F_1(z)$$

and $$F_2'(z)=(1-z^{-1})F_2(z)$$

with $$F_1(z) = \prod_{i=1,3,\ldots,15} (1 - 2q_i z^{-1} + z^{-2})$$

and $$F_2(z) = \prod_{i=2,4,\ldots,16} (1 - 2q_i z^{-1} + z^{-2})$$

where $q_i$, I=1, . . . , 16 are the LSFs in the cosine domain also called LSPs. The conversion to the LP domain is done as follows. The coefficients of $F_1(z)$ and $F_2(z)$ are found by expanding the equations above knowing the quantized and interpolated LSPs. The following recursive relation is used to compute $F_1(z)$:

```
for i = 1 to 8
        f1(i) = −2q2i−1f1(i − 1) + 2f1(i − 2)
        for j = i − 1 down to 1
            f1(j) = f1(j) − 2q2i−1f1(j − 1) + f1(j − 2)
        end
end
```

with initial values $f_1(0)=1$ and $f_1(-1)=0$. The coefficients of $F_2(z)$ are computed similarly by replacing $q_{2i-1}$ by $q_{2i}$.

Once the coefficients of $F_1(z)$ and $F_2(z)$ are found, $F_1(z)$ and $F_2(z)$ is multiplied by $1+z^{-1}$ and $1-z^{-1}$, respectively, to obtain $F'_1(z)$ and $F'_2(z)$; that is $$f_1'(i)=f_1(i)+f_1(i-1), i=1, \ldots, 8$$

$$f_2'(i)=f_2(i)-f_2(i-1), i=1, \ldots, 8$$

Finally, the LP coefficients are computed from $f'_1(i)$ and $f'_2(i)$ by $$a_i = \begin{cases} 0.5f_1'(i) + 0.5f_2'(i), & i = 1, \ldots, 8 \\ 0.5f_1'(17-i) - 0.5f_2'(17-i), & i = 9, \ldots, 16 \end{cases}$$

This is directly derived from the equation $A(z)=(F_1'(z)+F_2'(z))/2$, and considering the fact that $F_1'(z)$ and $F_2'(z)$ are symmetric and asymmetric polynomials, respectively.

8.2. ACELP

In the following, some details regarding the processing performed by the ACELP branch 980 of the audio signal decoder 900 will be explained to facilitate the understanding of the aliasing-cancellation mechanisms, which will subsequently be described.

8.2.1 Definitions

In the following, some definitions will be provided.

The bitstream element "mean_energy" describes the quantized mean excitation energy per frame. The bitstream element "acb_index[sfr]" indicates the adaptive codebook index for each sub-frame.

The bitstream element "Itp_filtering_flag[sfr]" is an adaptive codebook excitation filtering flag. The bitstream element "Icb_index[sfr]" indicates the innovation codebook index for each sub-frame. The bitstream element "gains[sfr]" describes quantized gains of the adaptive codebook and innovation codebook contribution to the excitation.

Moreover, for details regarding the encoding of the bitstream element "mean_energy", reference is made to table 5. Table 5 shows a table representation of mapping for a mean excitation energy $\overline{E}$.

8.2.2 Setting of the ACELP Excitation Buffer Using the Past FD Synthesis and LPC0

In the following, an optional initialization of the ACELP excitation buffer will be described, which may be performed by a block 990*b*.

TABLE 5

| MEAN EXCITATION ENERGY $\overline{E}$ | |
|---|---|
| mean_energy | decoded mean excitation energy $\overline{E}$ |
| 0 | 18 dB |
| 1 | 30 dB |
| 2 | 42 dB |
| 3 | 54 dB |

In case of a transition from FD to ACELP, the past excitation buffer u(n) and the buffer containing the past pre-emphasized synthesis $\hat{s}(n)$ are updated using the past FD synthesis (including FAC) and LPC0 (i.e. the LPC filter coefficients of the filter coefficient set LPC0) prior to the decoding of the ACELP excitation. For this the FD synthesis is pre-emphasized by applying the pre-emphasis filter $(1-0.68z^{-1})$, and the result is copied to $\hat{s}(n)$. The resulting pre-emphasized synthesis is then filtered by the analysis filter $\hat{A}(z)$ using LPC0 to obtain the excitation signal u(n).

8.2.3 Decoding of CELP Excitation

If the mode in a frame is a CELP mode, the excitation consists of the addition of scaled adaptive codebook and fixed codebook vectors. In each sub-frame, the excitation is constructed by repeating the following steps:

The information necessitated to decode the CELP information may be considered as the encoded ACELP excitation 982. It should also be noted that the decoding of the CELP excitation may be performed by the blocks 988, 989 of the ACELP branch 980.

8.2.3.1 Decoding of Adaptive Codebook Excitation, in Dependence on the Bitstream Element "acb_index[ ]"

The received pitch index (adaptive codebook index) is used to find the integer and fractional parts of the pitch lag.

The initial adaptive codebook excitation vector v'(n) is found by interpolating the past excitation u(n) at the pitch delay and phase (fraction) using an FIR interpolation filter.

The adaptive codebook excitation is computed for the sub-frame size of 64 samples. The received adaptive filter index (Itp_filtering_flag[ ]) is then used to decide whether the filtered adaptive codebook is v(n)=v'(n) or $v(n)=0.18v'(n)+0.64v'(n-1)+0.18v'(n-2)$.

8.2.3.2 Decoding of Innovation Codebook Excitation Using the Bitstream Element "icb_index[ ]"

The received algebraic codebook index is used to extract the positions and amplitudes (signs) of the excitation pulses and to find the algebraic codevector c(n). That is $$c(n) = \sum_{i=0}^{M-1} s_i \delta(n - m_i)$$

where $m_i$ and $s_i$ are the pulse positions and signs and M is the number of pulses.

Once the algebraic codevector c(n) is decoded, a pitch sharpening procedure is performed. First the c(n) is filtered by a pre-emphasis filter defined as follows:

$$F_{emph}(z)=1-0.3z^{-1}$$

The pre-emphasis filter has the role to reduce the excitation energy at low frequencies. Next, a periodicity enhancement is performed by means of an adaptive pre-filter with a transfer function defined as:

$$F_p(z) = \begin{cases} 1 & \text{if } n < \min(T, 64) \\ (1 + 0.85z^{-T}) & \text{if } T < 64 \text{ and } T \leqq n < \min(2T, 64) \\ 1/(1 - 0.85z^{-T}) & \text{if } 2T < 64 \text{ and } 2T \leqq n < 64 \end{cases}$$

where n is the sub-frame index (n=0, . . . , 63), and where T is a rounded version of the integer part $T_0$ and fractional part $T_{0,frac}$ of the pitch lag and is given by:

$$T = \begin{cases} T_0 + 1 & \text{if } T_{0,frac} > 2 \\ T_0 & \text{otherwise} \end{cases}.$$

The adaptive pre-filter $F_p(z)$ colors the spectrum by damping inter-harmonic frequencies, which are annoying to the human ear in case of voiced signals.

8.2.3.3 Decoding of Adaptive and Innovative Codebook Gains, Described by the Bitstream Element "gains[ ]"

The received 7-bit index per sub-frame directly provides the adaptive codebook gain $\hat{g}_p$ and the fixed-codebook gain correction factor $\hat{\gamma}$. The fixed codebook gain is then computed by multiplying the gain correction factor by an estimated fixed codebook gain. The estimated fixed-codebook gain $g'_c$ is found as follows. First, the average innovation energy is found by $$E_i = 10\log\left(\frac{1}{N}\sum_{i=0}^{N-1} c^2(i)\right)$$

Then the estimated gain $G'_c$ in dB is found by $$G'_c=\overline{E}-E_i$$

where $\overline{E}$ is the decoded mean excitation energy per frame. The mean innovative excitation energy in a frame, $\overline{E}$, is encoded with 2 bits per frame (18, 30, 42 or 54 dB) as "mean_energy".

The prediction gain in the linear domain is given by $$g'_c=10^{0.05G'_c}=10^{0.05(\overline{E}-E_i)}$$

The quantized fixed-codebook gain is given by $$\hat{g}_c=\hat{\gamma}\cdot g'_c$$

8.2.3.4 Computing the Reconstructed Excitation

The following steps are for n=0, . . . , 63. The total excitation is constructed by:

$$u'(n)=\hat{g}_p v(n)+\hat{g}_c c(n)$$

where c(n) is the codevector from the fixed-codebook after filtering it through the adaptive pre-filter F(z). The excitation signal u'(n) is used to update the content of the adaptive codebook. The excitation signal u'(n) is then post-processed as described in the next section to obtain the post-processed excitation signal u(n) used at the input of the synthesis filter $1/\hat{A}(z)$.

8.3 Excitation Post-processing 8.3.1 General

In the following, the excitation signal post-processing will be described, which may be performed at block 989. In other words, for signal synthesis a post-processing of excitation elements may be performed as follows.

8.3.2 Gain Smoothing for Noise Enhancement

A nonlinear gain smoothing technique is applied to the fixed-codebook gain $\hat{g}_c$ in order to enhance excitation in noise. Based on the stability and voicing of the speech segment, the gain of the fixed-codebook vector is smoothed in order to reduce fluctuation in the energy of the excitation in case of stationary signals. This improves the performance in case of stationary background noise. The voicing factor is given by $$\lambda=0.5(1-r_v)$$

with $$r_v=(E_v-E_c)/(E_v+E_c),$$

where Ev and Ec are the energies of the scaled pitch codevector and scaled innovation codevector, respectively ($r_v$ gives a measure of signal periodicity). Note that since the value of $r_v$ is between −1 and 1, the value of λ is between 0 and 1. Note that the factor λ is related to the amount of unvoicing with a value of 0 for purely voiced segments and a value of 1 for purely unvoiced segments.

A stability factor θ is computed based on a distance measure between the adjacent LP filters. Here, the factor θ is related to the ISF distance measure. The ISF distance is given by $$ISF_{dist} = \sum_{i=0}^{14} \left(f_i - f_i^{(p)}\right)^2$$

where $f_1$ are the ISFs in the present frame, and $f_1^{(p)}$ are the ISFs in the past frame. The stability factor θ is given by $$\theta=1.25-ISF_{dist}/400000 \text{ Constrained by } 0\leqq\theta\leqq1$$

The ISF distance measure is smaller in case of stable signals. As the value of θ is inversely related to the ISF distance measure, then larger values of θ correspond to more stable signals. The gain-smoothing factor $S_m$ is given by $$S_m=\lambda\theta$$

The value of $S_m$ approaches 1 for unvoiced and stable signals, which is the case of stationary background noise signals. For purely voiced signals, or for unstable signals, the value of $S_m$ approaches 0. An initial modified gain $g_0$ is computed by comparing the fixed-codebook gain $\hat{g}_c$ to a threshold given by the initial modified gain from the previous sub-frame, $g_{-1}$. If $\hat{g}_c$ is larger or equal to $g_{-1}$, then $g_0$ is computed by decrementing $\hat{g}_c$ by 1.5 dB bounded by $g_0\geqq g_{-1}$. If $\hat{g}_c$ is smaller than $g_{-1}$, then $g_0$ is computed by incrementing $\hat{g}_c$ by 1.5 dB constrained by $g_0\leqq g_{-1}$.

Finally, the gain is updated with the value of the smoothed gain as follows $$\hat{g}_{sc}=S_m g_0+(1-S_m)\hat{g}_c$$

8.3.3 Pitch Enhancer

A pitch enhancer scheme modifies the total excitation u'(n) by filtering the fixed-codebook excitation through an innovation filter whose frequency response emphasizes the higher frequencies and reduces the energy of the low frequency portion of the innovative codevector, and whose coefficients are related to the periodicity in the signal. A filter of the form $$F_{inno}(z)=-c_{pe}z+1-c_{pe}z^{-1}$$

is used where $c_{pe}=0.125(1+r_v)$, with $r_v$ being a periodicity factor given by $r_v=(E_v-E_c)/(E_v+E_c)$ as described above. The filtered fixed-codebook codevector is given by $$c'(n)=c(n)-c_{pe}(c(n+1)+c(n-1))$$

and the updated post-processed excitation is given by $$u(n)=\hat{g}_p v(n)+\hat{g}_x c'(n)$$

The above procedure can be done in one step by updating the excitation 989*a*, u(n) as follows $$u(n)=\hat{g}_p v(n)+\hat{g}_x c(n)-\hat{g}_{sc}c_{pe}(c(n+1)+c(n-1))$$

8.4 Synthesis and Post-Processing

In the following, the synthesis filtering 991 and the post-processing 992 will be described.

8.4.1 General

The LP synthesis is performed by filtering the post-processed excitation signal 989*a* u(n) through the LP synthesis filter $1/\hat{A}(z)$. The interpolated LP filter per sub-frame is used in the LP synthesis filtering the reconstructed signal in a sub-frame is given by $$\hat{s}(n) = u(n) - \sum_{i=1}^{16} \hat{a}_i \hat{s}(n-i),\ n = 0, \ldots, 63$$

The synthesized signal is then de-emphasized by filtering through the filter $1/(1-0.68z^{-1})$ (inverse of the pre-emphasis filter applied at the encoder input).

8.4.2 Post-Processing of the Synthesis Signal

After LP synthesis, the reconstructed signal is post-processed using low-frequency pitch enhancement. Two-band decomposition is used and adaptive filtering is applied only to the lower band. This results in a total post-processing, that is mostly targeted at frequencies near the first harmonics of the synthesized speech signal.

The signal is processed in two branches. In the higher branch the decoded signal is filtered by a high-pass filter to produce the higher band signal $s_H$. In the lower branch, the decoded signal is first processed through an adaptive pitch enhancer, and then filtered through a low-pass filter to obtain the lower band post-processed signal $s_{LEF}$. The post-processed decoded signal is obtained by adding the lower band post-processed signal and the higher band signal. The object of the pitch enhancer is to reduce the inter-harmonic noise in the decoded signal, which is achieved here by a time-varying linear filter with a transfer function $$H_E(z) = (1-\alpha) + \frac{\alpha}{2}z^T + \frac{\alpha}{2}z^{-T}$$

and described by the following equation:

$$s_{LE}(n) = (1-\alpha)\hat{s}(n) + \frac{\alpha}{2}\hat{s}(n-T) + \frac{\alpha}{2}\hat{s}(n+T)$$

where $\alpha$ is a coefficient that controls the inter-harmonic attenuation, T is the pitch period of the input signal $\hat{s}(n)$, and $s_{LE}(n)$ is the output signal of the pitch enhancer. Parameters T and a vary with time and are given by the pitch tracking module. With a value of $\alpha=0.5$, the gain of the filter is exactly 0 at frequencies 1/(2T), 3/(2T), 5/(2T), etc.; i.e. at the mid-point between the harmonic frequencies 1/T, 3/T, 5/T; etc. When $\alpha$ approaches 0, the attenuation between the harmonics produced by the filter decreases.

To confine the post-processing to the low frequency region, the enhanced signal $s_{LE}$ is low pass filtered to produce the signal $s_{LEF}$ which is added to the high-pass filtered signal $s_H$ to obtain the post-processed synthesis signal $s_E$.

An alternative procedure equivalent to that described above is used which eliminates the need to high-pass filtering. This is achieved by representing the post-processed signal $s_E(n)$ in the z-domain as $$S_E(z)=\hat{S}(z)-\alpha\hat{S}(z)P_{LT}(z)H_{LP}(z)$$

where $P_{LT}(z)$ is the transfer function of the long-term predictor filter given by $$P_{LT}(z)=1-0.5z^{T}-0.5z^{-T}$$

and $H_{LP}(z)$ is the transfer function of the low-pass filter.

Thus, the post-processing is equivalent to subtracting the scaled low-pass filtered long-term error signal from the synthesis signal $\hat{s}(n)$.

The value T is given by the received closed-loop pitch lag in each sub-frame (the fractional pitch lag rounded to the nearest integer). A simple tracking for checking pitch doubling is performed. If the normalized pitch correlation at delay T/2 is larger than 0.95 then the value T/2 is used as the new pitch lag for post-processing.

The factor $\alpha$ is given by $$\alpha=0.5\hat{g}_p \text{ constrained to } 0\leqq\alpha\leqq0.5$$

where $\hat{g}_p$ is the decoded pitch gain.

Note that in TCX mode and during frequency domain coding the value of $\alpha$ is set to zero. A linear phase FIR low-pass filter with 25 coefficients is used, with a cut-off frequency at 5 Fs/256 kHz (the filter delay is 12 samples).

8.5 MDCT Based TCX

In the following, the MDCT based TCX will be described in detail, which is performed by the main signal synthesis 940 of the TXC-LPD branch 930.

8.5.1 Tool Description

When the bitstream variable "core_mode" is equal to 1, which indicates that the encoding is made using linear-prediction-domain parameters, and when one or more of the three TCX modes is selected as the "linear prediction-domain" coding, i.e. one of the 4 array entries of mod [ ] is greater than 0, the MDCT based TCX tool is used. The MDCT based TCX receives the quantized spectral coefficients 941*a* from the arithmetic decoder 941. The quantized coefficients 941*a* (or an inversely quantized version 942*a* thereof) are first completed by a comfort noise (noise filling 943). LPC based frequency-domain noise shaping 945 is then applied to the resulting spectral coefficients 943*a* (or a spectrally de-shaped version 944*a* thereof) and an inverse MDCT transformation 946 is performed to get the time-domain synthesis signal 946*a*.

8.5.2 Definitions

In the following, some definitions will be provided. The variable "lg" describes a number of quantized spectral coefficients output by the arithmetic decoder. The bitstream element "noise_factor" describes a noise level quantization index. The variable "noise level" describes a level of noise injected in a reconstructed spectrum. The variable "noise[ ]" describes a vector of generated noise. The bitstream element "global_gain" describes a re-scaling gain quantization index. The variable "g" describes a re-scaling gain. The variable "rms" describes a root mean square of the synthesized time-domain signal, x[ ]. The variable "x[ ]" describes a synthesized time-domain signal.

8.5.3 Decoding Process

The MDCT-based TCX requests from the arithmetic decoder 941*a* number of quantized spectral coefficients, lg, which is determined by the mod [ ] value. This value (lg) also defines the window length and shape which will be applied in the inverse MDCT. The window, which may be applied during or after the inverse MDCT 946, is composed of three parts, a left side overlap of L samples, a middle part of ones of M samples and a right overlap part of R samples. To obtain an MDCT window of length 2*lg, ZL zeros are added on the left and ZR zeros on the right side. In case of a transition from or to a SHORT_WINDOW, the corresponding overlap region L or R may need to be reduced to 128 in order to adapt to the shorter window slope of the SHORT_WINDOW. Consequently the region M and the corresponding zero region ZL or ZR may need to be expanded by 64 samples each.

The MDCT window, which may be applied during the inverse MDCT 946 or following the inverse MDCT 946, is given by $$W(n) = \begin{cases} 0 & \text{for} \quad 0 \leqq n < ZL \\ W_{SIN_LEFT,L}(n-ZL) & \text{for} \quad ZL \leqq n < ZL+L \\ 1 & \text{for} \quad ZL+L \leqq n < ZL+L+M \\ W_{SIN_RIGHT,R}(n-ZL-L-M) & \text{for} \quad ZL+L+M \leqq n < ZL+L+M+R \\ 0 & \text{for} \quad ZL+L+M+R \leqq n < 21g \end{cases}$$

Table 6 shows a number of spectral coefficients as a function of mod [ ].

TABLE 6

NUMBER OF SPECTRAL COEFFICIENTS AS A FUNCTION OF MOD[ ]

| value of mod[x] | number lg of spectral coefficients | ZL | L | M | R | ZR |
|---|---|---|---|---|---|---|
| 1 | 256 | 0 | 256 | 0 | 256 | 0 |
| 2 | 512 | 128 | 256 | 256 | 256 | 128 |
| 3 | 1024 | 384 | 256 | 768 | 256 | 384 |

The quantized spectral coefficients, quant[ ] 941*a*, delivered by the arithmetic decoder 941, or the inversely quantized spectral coefficients 942*a*, are optionally completed by a comfort noise (noise filling 943). The level of the injected noise is determined by the decoded variable noise_factor as follows:

noise_level=0.0625*(8−noise_factor)

A noise vector, noise[ ], is then computed using a random function, random_sign( ), delivering randomly the value −1 or +1.

noise[*i*]=random_sign( )*noise_level;

The quant[ ] and noise[ ] vectors are combined to form the reconstructed spectral coefficients vector, r[ ] 942*a*, in a way that the runs of 8 consecutive zeros in quant[ ] are replaced by the components of noise[ ]. A run of 8 non-zeros are detected according to the formula:

$$\begin{cases} rl[i] = 1 \text{ for } i \in [0, 1g/6[ \\ rl[1g/6 + i] = \sum_{k=0}^{min(7,1g-8\cdot\lfloor i/8\rfloor-1)} |quant[1g/6 + 8\cdot\lfloor i/8\rfloor + k]|^2 \quad \text{for } i \in [0, 5.1g/6[ \end{cases}$$

One obtains the reconstructed spectrum 943*a* as follows:

$$r[i] = \begin{cases} \text{noise}[i] & \text{if } rl[i] = 0 \\ quant[i] & \text{otherwise} \end{cases}$$

A spectrum de-shaping 944 is optionally applied to the reconstructed spectrum 943*a* according to the following steps:

1. calculate the energy $E_m$ of the 8-dimensional block at index m for each 8-dimensional block of the first quarter of the spectrum
2. compute the ratio $R_m$=sqrt($E_m/E_I$), where I is the block index with the maximum value of all $E_m$
3. if $R_m$<0.1, then set $R_m$=0.1
4. if $R_m$<$R_{m-1}$, then set $R_m$=$R_{m-1}$ Each 8-dimensional block belonging to the first quarter of spectrum are then multiplied by the factor $R_m$. Accordingly, the spectrally de-shaped spectral coefficients 944*a* are obtained.

Prior to applying the inverse MDCT 946, the two quantized LPC filters LPC1, LPC2 (each of which may be described by filter coefficients $a_1$ to $a_{10}$) corresponding to both extremity of the MDCT block (i.e. the left and right folding points) are retrieved (block 950), their weighted versions are computed, and the corresponding decimated (64 points, whatever the transform length) spectrums 951*a* are computed (block 951).

These weighted LPC spectrums 951*a* are computed by applying an ODFT (odd discrete Fourier transform) to the LPC filter coefficients 950*a*. A complex modulation is applied to the LPC coefficients before computing the ODFT so that the ODFT frequency bins (used in the spectrum computation 951) are perfectly aligned with the MDCT frequency bins (of the inverse MDCT 946). For example, the weighted LPC synthesis spectrum 951*a* of a given LPC filter Â(z) (defined, for example, by time-domain filter coefficients $a_1$ to $a_{16}$) is computed as follows:

$$X_o[k] = \sum_{n=0}^{M-1} x_i[n] e^{-j\frac{2\pi k}{M}n}$$

with $$x_i[n] = \begin{cases} \hat{w}[n] e^{-j\frac{\pi}{M}n} & \text{if } 0 \leqq n < lpc_order + 1 \\ 0 & \text{if } lpc_order + 1 \leqq n < M \end{cases}$$

where ŵ[n], n=0 . . . lpc_order+1, are the (time-domain) coefficients of the weighted LPC filter given by:

$\hat{W}(z)=\hat{A}(z/\gamma_1)$ with $\gamma_1$=0.92

The gains g[k] 952*a* can be calculated from the spectral representation $X_0$[k], 951*a* of the LPC coefficients according to:

$$g[k] = \sqrt{\frac{1}{X_o[k] X_o^*[k]}} \quad \forall k \in \{0, \ldots, M-1\}$$

where M=64 is the number of bands in which the calculated gains are applied.

Let g1[k] and g2[k], k=0 . . . 63, be the decimated LPC spectrums corresponding respectively to the left and right folding points computed as explained above. The inverse FDNS operation 945 consists in filtering the reconstructed spectrum r[i], 944*a* using the recursive filter:

$$rr[i]=a[i]\cdot r[i]+b[i]\cdot rr[i-1], i=0 \ldots lg,$$

where a[i] and b[i], 945*b* are derived from the left and right gains g1[k], g2[k], 952*a* using the formulas:

$$a[i]=2\cdot g1[k]\cdot g2[k]/(g1[k]+g2[k]),$$

$$b[i]=(g2[k]-g1[k])/(g1[k]+g2[k]).$$

In the above, the variable k is equal to i/(lg/64) to take into consideration the fact that the LPC spectrums are decimated.

The reconstructed spectrum rr[ ], 945*a* is fed in an inverse MDCT 946. The non-windowed output signal, x[ ], 946*a*, is re-scaled by the gain, g, obtained by an inverse quantization of the decoded "global_gain" index:

$$g = \frac{10^{global_gain/28}}{2 \cdot rms},$$

where rms is calculated as:

$$rms = \sqrt{\frac{\sum_{i=1g/2}^{3*1g/2-1} x^2[i]}{L+M+R}}.$$

The rescaled synthesized time-domain signal 940*a* is then equal to:

$$x_w[i]=x[i]\cdot g$$

After resealing, the windowing and overlap add is applied, for example, in the block 978.

The reconstructed TCX synthesis x(n) 938 is then optionally filtered through the pre-emphasis filter $(1-0.681z^{-1})$. The resulting pre-emphasized synthesis is then filtered by the analysis filter $\hat{A}(z)$ in order to obtain the excitation signal. The calculated excitation updates the ACELP adaptive codebook and allows switching from TCX to ACELP in a subsequent frame. The signal is finally reconstructed by de-emphasizing the pre-emphasized synthesis by applying the filter $1(1-0.68z^{-1})$, Note that the analysis filter coefficients are interpolated in a sub-frame basis.

Note also that the length of the TCX synthesis is given by the TCX frame length (without the overlap): 256, 512 or 1024 samples for the mod [ ] of 1, 2 or 3 respectively.

8.6 Forward Aliasing-Cancellation (FAC) Tool 8.6.1 Forward Aliasing-Cancellation Tool Description The following describes forward-aliasing cancellation (FAC) operations which are performed during transitions between ACELP and transform coding (TC) (for example, in the frequency-domain mode or in the TCX-LPD mode) in order to get the final synthesis signal. The goal of FAC is to cancel the time-domain aliasing introduced by TC and which cannot be cancelled by the preceding or following ACELP frame. Here the notion of TC includes MDCT over long and short blocks (frequency-domain mode) as well as MDCT-based TCX (TCX-LPD mode).

Figure 10:
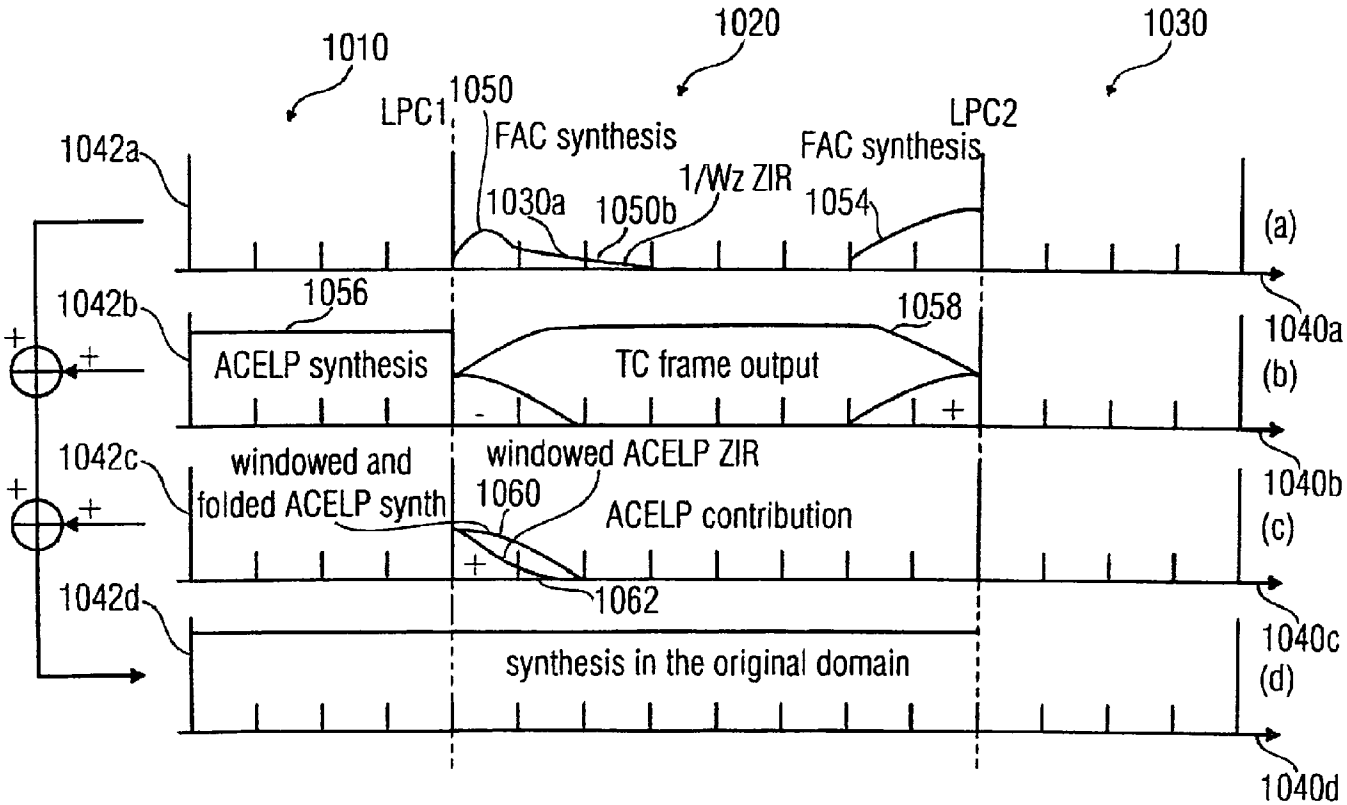
FIG. 10 shows a schematic representation of forward-aliasing-cancellation (FAC) decoding operations for transitions from and to ACELP.

FIG. 10 represents the different intermediate signals which are computed in order to obtain the final synthesis signal for the TC frame. In the example shown, the TC frame (for example, a frame 1020 encoded in the frequency-domain mode or in the TCX-LPD mode) is both preceded and followed by an ACELP frame (frames 1010 and 1030). In the other cases (an ACELP frame followed by more than one TC frame, or more than one TC frame followed by an ACELP frame) only the necessitated signals are computed.

Taking reference to FIG. 10 now, an overview over the forward-aliasing-cancellation will be provided, wherein it should be noted that the forward-aliasing-cancellation will be performed by the blocks 960, 961, 962, 963, 964, 965 and 970.

In the graphical representation of the forward-aliasing-cancellation decoding operations, which are shown in FIG. 10, abscissas 1040*a*, 1040*b*, 1040*c*, 1040*d* describe a time in terms of audio samples. An ordinate 1042*a* describes a forward-aliasing-cancellation synthesis signal, for example, in terms of an amplitude. An ordinate 1042*b* describes signals representing an encoded audio content, for example, an ACELP synthesis signal and a transform coding frame output signal. An ordinate 1042*c* describes ACELP contributions to an aliasing-cancellation such as, for example, a windowed ACELP zero-impulse response and a windowed and folded ACELP synthesis. An ordinate 1042*d* describes a synthesis signal in an original domain.

As can be seen, a forward-aliasing-cancellation synthesis signal 1050 is provided at a transition from the audio frame 1010 encoded in the ACELP mode to the audio frame 1020 encoded in the TCX-LPD mode. The forward-aliasing-to-cancellation synthesis signal 1050 is provided by applying the synthesis filtering 964 and an aliasing-cancellation stimulus signal 963*a*, which is provided by the inverse DCT of type IV 963. The synthesis filtering 964 is based on the synthesis filter coefficients 965*a*, which are derived from a set LPC1 of linear-prediction-domain parameters or LPC filter coefficients. As can be seen in FIG. 10, a first portion 1050*a* of the (first) forward-aliasing-cancellation synthesis signal 1050 may be a non-zero-input response provided by the synthesis filtering 964 for a non-zero aliasing-cancellation stimulus signal 963*a*. However, the forward-aliasing-cancellation synthesis signal 1050 also comprises a zero-input response portion 1050*b*, which may be provided by the synthesis filtering 964 for a zero-portion of the aliasing-cancellation stimulus signal 963*a*. Accordingly, the forward-aliasing-cancellation synthesis signal 1050 may comprise a non-zero-input response portion 1050*a* and a zero-input response portion 1050*b*. It should be noted that the forward-aliasing-cancellation synthesis signal 1050, may be provided on the basis of the set LPC1 of linear-prediction-domain parameters, which is related to the transition between the frame or sub-frame 1010, and the frame or sub-frame 1020. Moreover, another forward aliasing-cancellation synthesis signal 1054 is provided at a transition from the frame or sub-frame 1020 to the frame or sub-frame 1030. The forward-aliasing-cancellation synthesis signal 1054 may be provided by synthesis filtering 964 of an aliasing-cancellation stimulus signal 963*a*, which is provided by an inverse DCT IV, 963 on the basis of the aliasing-cancellation coefficients. It should be noted that the provision of the forward aliasing-cancellation synthesis signal 1054 may be based on a set of linear-prediction-domain parameters LPC2, which are associated to the transition between the frame or sub-frame 1020 and the subsequent frame or sub-frame 1030.

In addition, additional aliasing-cancellation synthesis signals 1060, 1062 will be provided at a transition from an ACELP frame or sub-frame 1010 to a TXC-LPD frame or sub-frame 1020. For example, a windowed and folded version 973*a*, 1060 of an ACELP synthesis signal 986, 1056 may be provided, for example, by the blocks 971, 972, 973. Further, a windowed ACELP zero-input-response 976*a*, 1062 will be provided, for example, by the blocks 975, 976. For example, the windowed and folded ACELP synthesis signal 973*a*, 1060 may be obtained by windowing the ACELP synthesis signal 986, 1056 and by applying a temporal folding 973 of the result of the windowing, as will be described in more detail below. The windowed ACELP zero-input-response 976*a*, 1062 may be obtained by providing a zero-input to a synthesis filter 975, which is equal to the synthesis filter 991, which is used to provide the ACELP synthesis signal 986, 1056, wherein an initial state of the synthesis filter 975 is equal to a state of the synthesis filter 981 at the end of the provision of the ACELP synthesis signal 986, 1056 of the frame or sub-frame 1010. Thus, the windowed and folded ACELP synthesis signal 1060 may be equivalent to the forward aliasing-cancellation synthesis signal 973*a*, and the windowed ACELP zero-input-response 1062 may be equivalent to the forward aliasing-cancellation synthesis signal 976*a*.

Finally, the transform coding frame output the signal 1050*a*, which may equal to a windowed version of the time-domain representation 940*a*, as combined with the forward aliasing-cancellation synthesis signals 1052, 1054, and the additional ACELP contributions 1060, 1062 to the aliasing-cancellation.

8.6.2 Definitions

In the following, some definitions will be provided. The bitstream element "fac_gain" describes a 7-bit gain index. The bitstream element "nq[i]" describes a codebook number. the syntax element "FAC[i]" describes forward aliasing-cancellation data. The variable "fac_length" describes a length of a forward aliasing-cancellation transform, which may be equal to 64 for transitions from and to a window of type "EIGHT_SHORT_SEQUENCES" and which may be 128 otherwise. The variable "use_gain" indicates the use of explicit gain information.

8.6.3 Decoding Process

In the following, the decoding process will be described. For this purpose, the different steps will briefly be summarized.

1. Decode AVQ parameters (block 960)
   - The FAC information is encoded using the same algebraic vector quantization (AVQ) tool as for the encoding of LPC filters (see section 8.1).
   - For i=0 . . . FAC transform length:
     - A codebook number nq[i] is encoded using a modified unary code
     - The corresponding FAC data FAC[i] is encoded with 4*nq[i] bits
   - A vector FAC[i] for i=0, . . . , fac_length is therefore extracted from the bitstream
2. Apply a gain factor g to the FAC data (block 961)
   - For transitions with MDCT-based TCX (wLPT), the gain of the corresponding "tcx_coding" element is used
   - For other transitions, a gain information "fac_gain" has been retrieved from the bitstream (encoded using a 7-bits scalar quantizer). The gain g is calculated as $g=10^{fac_gain/28}$ using that gain information.
3. In the case of transitions between MDCT based TCX and ACELP, a spectrum de-shaping 962 is applied to the first quarter of the FAC spectral data 961*a*. The de-shaping gains are those computed for the corresponding MDCT based TCX (for usage by the spectrum de-shaping 944) as explained in section 8.5.3 so that the quantization noise of FAC and MDCT-based TCX have the same shape.
4. Compute the inverse DCT-IV of the gain-scaled FAC data (block 963).
   - The FAC transform length, fac_length, is by default equal to 128
   - For transitions with short blocks, this length is reduced to 64.
5. Apply (block 964) the weighted synthesis filter $1/\hat{W}(z)$ (described, for example, by the synthesis filter coefficients 965*a*) to get the FAC synthesis signal 964*a*. The resulting signal is represented on line (a) in FIG. 10.
   - The weighted synthesis filter is based on the LPC filter which corresponds to the folding point (in FIG. 10 it is identified as LPC1 for transitions from ACELP to TCX-LPD and as LPC2 for transitions from wLPD TC (TCX-LPD) to ACELP or LPC0 for transitions from FD TC (frequency code transform coding) to ACELP)
   - The same LPC weighting factor is used as for ACELP operations:

$$\hat{W}(z)=A(z/\gamma_1),\text{ where }\gamma_1=0.92$$

- To compute the FAC synthesis signal 964*a*, the initial memory of the weighted synthesis filter 964 is set to 0
   - For transitions from ACELP, the FAC synthesis signal 1050 is further extended by appending the zero-input response (ZIR) 1050*b* of the weighted synthesis filter (128 samples)
6. In the case of transitions from ACELP, compute the windowed past ACELP synthesis 972*a*, fold it (for example, to obtain the signal 973*a* or to the signal 1060) and add to it the windowed ZIR signal (for example, the signal 976*a* or the signal 1062). The ZIR response is computed using LPC1. The window applied to the fac_length past ACELP synthesis samples is:

$$\text{sine}[n+\text{fac_length}]*\text{sine}[\text{fac_length}-1-n],n=-\text{fac_length}\ldots-1,$$

and the window applied to the ZIR is:

$$1-\text{sine}[n+\text{fac_length}]2,n=0\ldots\text{fac_length}-1,$$

where sine[n] is a quarter of a sine cycle:

$$\text{sine}[n]=\sin(n*\pi/(2*\text{fac_length})),n=0\ldots 2*\text{fac_length}-1.$$

- The resulting signal is represented on line (c) in FIG. 10 and denoted as the ACELP contribution (signal contributions 1060, 1062).
7. Add the FAC synthesis 964*a*, 1050 (and the ACELP contribution 973*a*, 976*a*, 1060, 1062 in the case of transitions from ACELP) to the TC frame (which is represented as line (b) in FIG. 10) (or to a windowed version of the time-domain representation 940*a*) in order to obtain the synthesis signal 998 (which is represented as line (d) in FIG. 10).

8.7 Forward Aliasing-Cancellation (FAC) Encoding Process

In the following, some details regarding the encoding of the information necessitated for the forward aliasing-cancellation will be described. In particular, the computation and encoding of the aliasing-cancellation coefficients 936 will be described.

Figure 11:
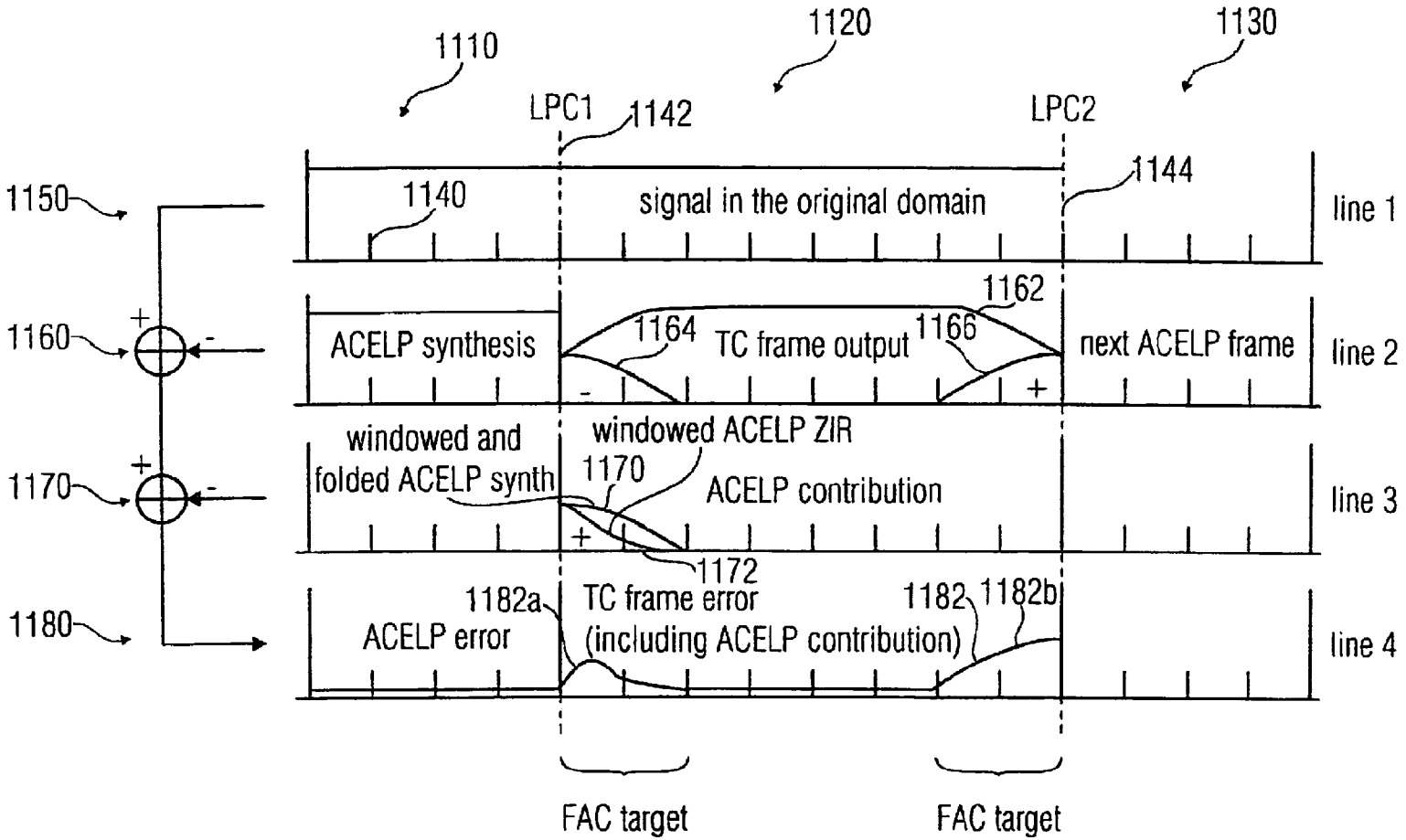
FIG. 11 shows a schematic representation of a computation of an FAC target at an encoder.

FIG. 11 shows the processing steps at the encoder when a frame 1120 encoded with Transform Coding (TC) is preceded and followed by a frame 1110, 1130 encoded with ACELP. Here the notion of TC includes MDCT over long and short blocks as in AAC, as well as MDCT-based TCX (TCX-LPD). FIG. 11 shows time-domain markers 1140 and frame boundaries 1142, 1144. The vertical dotted lines show the beginning 1142 and end 1144 of the frame 1120 encoded with TC. LPC1 and LPC2 indicate the centre of the analysis window to calculate two LPC filters: LPC1 calculated at the beginning 1142 of the frame 1120 encoded with TC, and LPC2 calculated at the end 1144 of the same frame 1120. The frame 1110 at the left of the "LPC1" marker is assumed to have been encoded with ACELP. The frame 1130 at the right of the marker "LPC2" is also assumed to have been encoded with ACELP.

There are four lines 1150, 1160, 1170, 1180 in FIG. 11. Each line represents a step in the calculation of the FAC target at the encoder. It is to be understood that each line is time aligned with the line above.

Line 1 (1150) of FIG. 11 represents the original audio signal, segmented in frames 1110, 1120, 1130 as stated above. The middle frame 1120 is assumed to be encoded in the MDCT domain, using FDNS, and will be called the TC frame. The signal in the previous frame 1110 is assumed to have been encoded in ACELP mode. This sequence of coding modes (ACELP, then TC, then ACELP) is chosen so as to illustrate all processing in FAC since FAC is concerned with both transitions (ACELP to TC and TC to ACELP).

Line 2 (1160) of FIG. 11 corresponds to the decoded (synthesis) signals in each frame (which may be determined by the encoder by using knowledge of the decoding algorithm). The upper curve 1162, which extends from beginning to end of the TC frame, shows the windowing effect (flat in the middle but not at the beginning and end). The folding effect is shown by the lower curves 1164, 1166 at the beginning and end of the segment (with "−" sign at the beginning of the segment and "+" sign at the end of the segment). FAC can then be used to correct these effects.

Line 3 (1170) of FIG. 11 represents the ACELP contribution, used at the beginning of the TC frame to reduce the coding burden of FAC. This ACELP contribution is formed of two parts: 1) the windowed, folded ACELP synthesis 877*f*, 1170 from the end of the previous frame, and 2) the windowed zero-input response 877*j*, 1172 of the LPC1 filter.

It should be noted here that the windowed and folded ACELP synthesis 1110 may be equivalent to the windowed and folded ACELP synthesis 1060, and that the windowed zero-input-response 1172 may be equivalent to the windowed ACELP zero-input-response 1062. In other words, the audio signal encoder may estimate (or calculate) the synthesis result 1162, 1164, 1166, 1170, 1172, which will be obtained at the side of an audio signal decoder (blocks 869*a* and 877).

The ACELP error which is shown in line 4 (1180) is then obtained by simply subtracting Line 2 (1160) and Line 3 (1170) from Line 1 (1150) (block 870). An approximate view of the expected envelope of the error signal 871, 1182 in the time domain is shown on Line 4 (1180) in FIG. 11. The error in the ACELP frame (1120) is expected to be approximately flat in amplitude in the time domain. Then the error in the TC frame (between markers LPC1 and LPC2) is expected to exhibit the general shape (time domain envelope) as shown in this segment 1182 of Line 4 (1180) in FIG. 11.

To efficiently compensate the windowing and time-domain aliasing effects at the beginning and end of the TC frame on Line 4 of FIG. 10, and assuming that the TC frame uses FDNS, FAC is applied according to FIG. 11. It should be noted that FIG. 11 describes this processing for both the left part (transition from ACELP to TC) and the right part (transition from TC to ACELP) of the TC frame.

To summarize, the transform coding frame error 871, 1182, which is represented by the encoded aliasing-cancellation coefficients 856, 936 is obtained by subtracting both, the transform coding frame output 1162, 1164, 1166 (described, for example, by signal 869*b*), and the ACELP contribution 1170, 1172 (described, for example, by signal 872) from the signal 1152 in the original domain (i.e. in the time-domain). Accordingly, the transform coding frame error signal 1182 is obtained.

In the following, the encoding of the transform coding frame error 871, 1182 will be described.

First, a weighting filter 874, 1210, $W_1(z)$ is computed from the LPC1 filter. The error signal 871, 1182 at the beginning of the TC frame 1120 on Line 4 (1180) of FIG. 11 (which is also called the FAC target in FIGS. 11 and 12) is then filtered through $W_1(z)$, which has as initial state, or filter memory, the ACELP error 871, 1182 in the ACELP frame 1120 on Line 4 of FIG. 11. The output of filter 874, 1210 $W_1(z)$ at the top of FIG. 12 then forms the input of a DCT-IV transform 875, 1220. The transform coefficients 875*a*, 1222 from the DCT-IV 875, 1220 are then quantized and encoded using the AVQ tool 876 (represented by Q, 1230). This AVQ tool is the same that is used for quantizing the LPC coefficients. These encoded coefficients are transmitted to the decoder. The output of AVQ 1230 is then the input of an inverse DCT-IV 963, 1240 to form a time-domain signal 963*a*, 1242. This time-domain signal is then filtered through the inverse filter 964, 1250, $1/W_1(z)$ which has zero-memory (zero initial state). Filtering through $1/W_1(z)$ is extended past the length of the FAC target using zero-input for the samples that extend after the FAC target. The output 964*a*, 1252 of filter 1250, $1/W_1(z)$ is the FAC synthesis, which is the correction signal (for example, signal 964*a*) that may now be applied at the beginning of the TC frame to compensate for the windowing and Time-Domain Aliasing effects.

Figure 12:
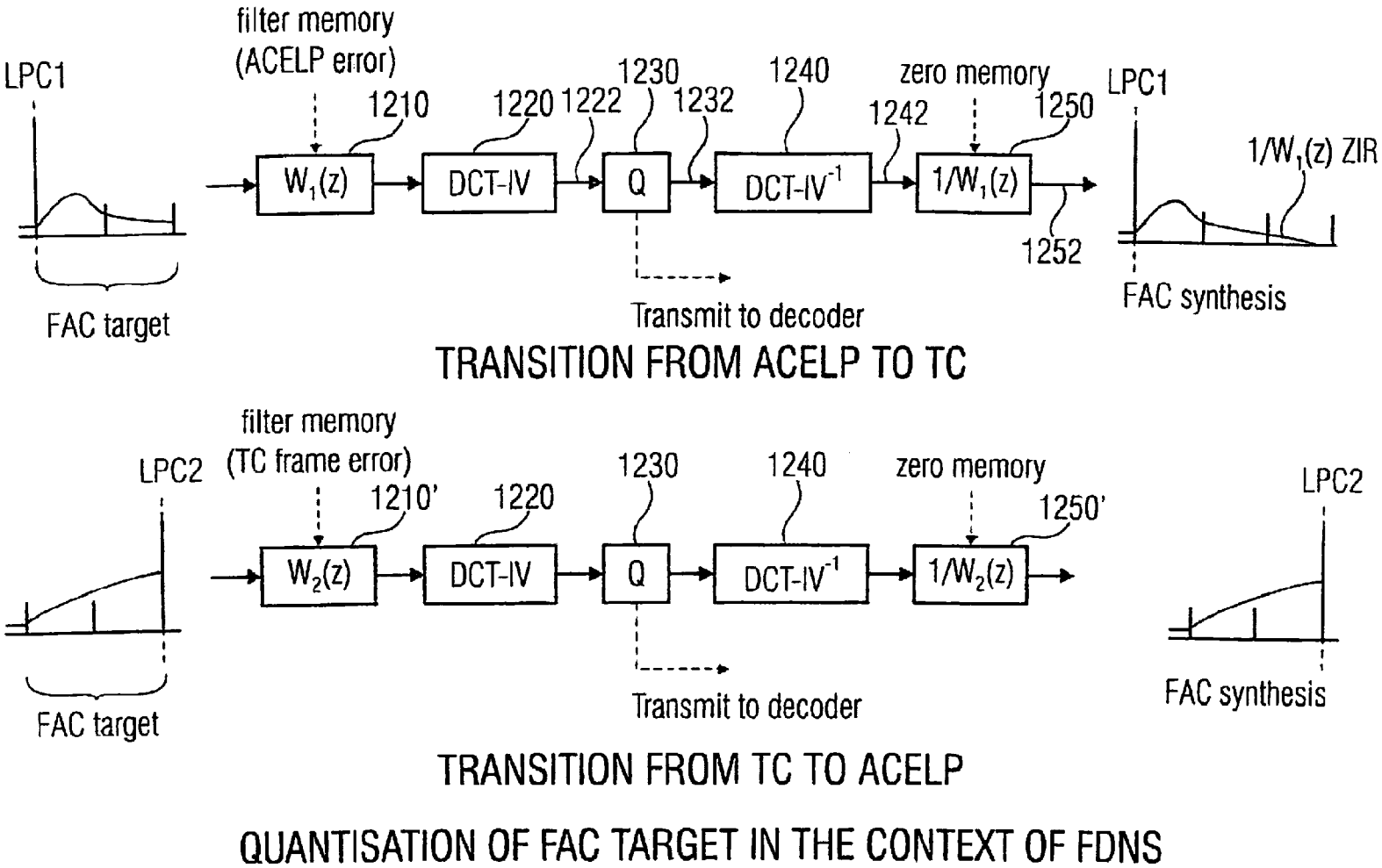
FIG. 12 shows a schematic representation of a quantization of an FAC target in the context of a frequency-domain-noise-shaping (FDNS)

Now, turning to the processing for the windowing and time-domain aliasing correction at the end of the TC frame, we consider the bottom part of FIG. 12. The error signal 871, 1182*b* at the end of the TC frame 1120 on Line 4 of FIG. 11 (FAC target) is filtered through filter 874, 1210; $W_2(z)$, which has as initial state, or filter memory, the error in the TC frame 1120 on Line 4 of FIG. 11. Then all further processing steps are the same as for the upper part of FIG. 12 which dealt with the processing of the FAC target at the beginning of the TC frame, with the exception of the ZIR extension in the FAC synthesis.

Note that the processing in FIG. 12 is performed completely (from left to right) when applied at the encoder (to obtain the local FAC synthesis), whereas at the decoder side the processing in FIG. 12 is only applied starting from the received decoded DCT-IV coefficients.

9. Bitstream

In the following, some details regarding the bitstream will be described in order to facilitate the understanding of the present invention. It should be noted here that a significant amount of configuration information may be included in the bitstream.

However, an audio content of a frame encoded on the frequency-domain mode is mainly represented by a bitstream element named "fd_channel_stream( )". This bitstream element "fd_channel_stream( )" comprises a global gain information "global_gain", encoded scale factor data "scale_factor_data( )", and arithmetically encoded spectral data "ac_spectral_data". In addition, the bitstream element "fd_channel_stream( )" selectively comprises forward aliasing-cancellation data including a gain information (also designated as "fac_data(1)"), if (and only if) a previous frame (also designated as "superframe" in some embodiments) has been encoded in the linear-prediction-domain mode and the last sub-frame of the previous frame was encoded in the ACELP mode. In other words, a forward-aliasing-cancellation data including a gain information is selectively provided for a frequency-domain mode audio frame, if the previous frame or sub-frame was encoded in the ACELP mode. This is advantageous, as an aliasing-cancellation can be effected by a mere overlap-and-add functionality between a previous audio frame or audio sub-frame encoded in the TCX-LPD mode and the current audio frame encoded in the frequency-domain mode, as has been explained above.

For details, reference is made to FIG. 14, which shows a syntax representation of the bitstream element "fd_channel_stream( )" which comprises the global gain information "global_gain", the scale factor data "scale_factor_data( )", the arithmetically coded spectral data "ac_spectral_data( )". The variable "core_mode_last" describes a last core mode and takes the value of zero for a scale factor based frequency-domain coding and takes the value of one for a coding based on linear-prediction-domain parameters (TCX-LPD or ACELP). The variable "last_lpd_mode" describes an LPD mode of a last frame or sub-frame and takes the value of zero for a frame or sub-frame encoded in the ACELP mode.

Taking reference now to FIG. 15, the syntax will be described for a bitstream element "lpd_channel_stream( )", which encodes the information of an audio frame (also designated as "superframe") encoded in the linear-prediction-domain mode. The audio frame ("superframe") encoded in the linear-prediction-domain mode may comprise a plurality of sub-frames (sometimes also designated as "frames", for example, in combination with the terminology "superframe"). The sub-frames (or "frames") may be of different types, such that some of the sub-frames may be encoded in the TCX-LPD mode, while other of the sub-frames may be encoded in the ACELP mode.

The bitstream variable "acelp_core_mode" describes the bit allocation scheme in case an ACELP is used. The bitstream element "lpd_mode" has been explained above. The variable "first_tcx_flag" is set to true at the beginning of each frame encoded in the LPD mode. The variable "first_lpd_flag" is a flag which indicates whether the current frame or superframe is the first of a sequence of frames or superframes which are encoded in the linear-prediction coding domain. The variable "last_lpd" is updated to describe the mode (ACELP; TCX256; TCX512; TCX1024) in which the last sub-frame (or frame) was encoded. As can be seen at reference numeral 1510, forward-aliasing-cancellation data without a gain information ("fac_data_(0)") are included for a sub-frame which is encoded in the TCX-LPD mode (mod [k]>0] if the last sub-frame was encoded in the ACELP mode (last_lpd_mode==0) and for a sub-frame encoded in the ACELP mode (mod [k]==0) if the previous sub-frame was encoded in the TCX-LPD mode (last_lpd_mode>0).

If, in contrast, the previous frame was encoded in the frequency-domain mode (core_mode_last=0) and the first sub-frame of the current frame is encoded in the ACELP mode (mod [0]==0), forward-aliasing-cancellation data including a gain information ("fac_data(1)") are contained in the bitstream element "lpd_channel_stream".

To summarize, forward-aliasing-cancellation data including a dedicated forward-aliasing-cancellation gain value are included in the bitstream, if there is a direct transition between a frame encoded in the frequency-domain and a frame or sub-frame encoded in the ACELP mode. In contrast, if there is a transition between a frame or sub-frame encoded in the TCX-LPD mode and a frame or sub-frame encoded in the ACELP mode, a forward-aliasing-cancellation information without a dedicated forward-aliasing-cancellation gain value is included in the bitstream.

Taking reference now to FIG. 16, the syntax of the forward-aliasing-cancellation data, which is described by the bitstream element "fac_data( )" will be described. The parameter "useGain" indicates whether there is a dedicated forward-aliasing-cancellation gain value bitstream element "fac_gain", as can be seen at reference numeral 1610. In addition, the bitstream element "fac_data" comprises a plurality of codebook number bitstream elements "nq[i]" and a number of "fac_data" bitstream elements "fac[i]".

The decoding of said codebook number and said forward-aliasing-cancellation data has been described above.

10. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

11. Conclusion

In the following, the present proposal for the unification of unified-speech-and-audio-coding (USAC) windowing and frame transitions will be summarized.

Firstly, an introduction will be given and some background information described. A current design (also designated as a reference design) of the USAC reference model consists of (or comprises) three different coding modules. For each given audio signal section (for example, a frame or sub-frame) one coding module (or coding mode) is chosen to encode/decode that section resulting in different coding modes. As these modules alternate in activity, special attention needs to be paid to the transitions from one mode to the other. In the past, various contributions have proposed modifications addressing these transitions between coding modes.

Embodiments according to the present invention create an envisioned overall windowing and transition scheme. The progress that has been achieved on the way towards completion of this scheme will be described, displaying very promising evidence for quality and systematic structural improvements.

The present document summarizes the proposed changes to the reference design (which is also designated as a working draft 4 design) in order to create a more flexible coding structure for USAC, to reduce overcoding and reduce the complexity of the transform coded sections of the codec.

In order to arrive at a windowing scheme which avoids costly non-critical sampling (overcoding), two components are introduced, which may be considered as being essential in some embodiments:

1) the forward-aliasing-cancellation (FAC) window; and
2) frequency-domain noise-shaping (FDNS) for the transform coding branch in the LPD core codec (TCX, also known as TCX-LPD or wLPT).

The combination of both technologies makes it possible to employ a windowing scheme which allows highly flexible switching of transform length at a minimum bit demand.

In the following the challenges of reference systems will be described to facilitate the understanding of the advantages provided by the embodiments according to the invention. A reference concept according to the working draft 4 of the USAC draft standard consists of a switched core codec working in conjunction with a pre-/post-processing stage consisting of (or comprising) MPEG surround and an enhanced SBR module. The switched core features a frequency-domain (FD) codec and a linear-predictive-domain (LPD) codec. The latter employs an ACELP module and a transform coder working in the weighted domain ("weighted Linear Prediction Transform" (wLPT), also known as transform-coded-excitation, (TCX)). It has been found that due to the fundamentally different coding principles, the transitions between the modes are especially challenging to handle. It has been found that care has to be taken that the modes intermingle efficiently.

In the following, the challenges which arise at the transitions from time-domain to frequency-domain (ACELP↔wLPT, ACELP↔FD) will be described. It has been found that transitions from time-domain coding to transform-domain coding are tricky, in particular, as the transform coder is based on the transform domain aliasing-cancellation (TDAC) property of neighboring blocks in the MDCT. It has been found that a frequency domain coded block cannot be decoded in its entirety without additional information from its adjacent overlapping blocks.

In the following, the challenges which appear at transitions from the signal domain to the linear-predictive-domain (FD↔ACELP, FD↔wLPT) will be described. It has been found that the transitions to and from the linear-predictive-domain imply a transition of different quantization noise-shaping paradigms. It has been found that the paradigms utilize a different way of conveying and applying psychoacoustically motivated noise-shaping information, which can cause discontinuities in the perceived quality at places where the coding mode changes.

In the following, details regarding a frame transition matrix of a reference concept according to the working draft 4 of the USAC draft standard will be described. Due to the hybrid nature of the reference USAC reference model, there are a multitude of conceivable window transitions. The 3-by-3 table in FIG. 4 displays an overview of these transitions as they are currently implemented according to the concept of the working draft 4 of the USAC draft standard.

The contributions listed above each address one or more of the transition displayed in the table of FIG. 4. It is worth noting that the non-homogenous transitions (the ones not on the main diagonal) each apply different specific processing steps, which are the result of a compromise between trying to achieve critical sampling, avoiding blocking artefacts, finding a common windowing scheme, and allowing for an encoder closed-loop mode decision. In some cases, this compromise comes at the cost of discarding coded and transmitted samples.

In following, some proposed system changes will be described. In other words, improvements of the reference concept according to the USAC working draft 4 will be described. In order to tackle the listed difficulties at the window transitions, embodiments according to the invention introduce two modifications to the existing system, when compared to the concepts according to the reference system according to the working draft 4 of the USAC draft standard. The first modification aims at universally improving the transition from time-domain to frequency-domain by adopting a supplemental forward-aliasing-cancellation window. The second modification assimilates the processing of signal- and linear-prediction domains by introducing a transmutation step for the LPC coefficients, which then can be applied in the frequency domain.

In the following, the concept of frequency-domain noise shaping (FDNS) will be described, which allows for the application of the LPC in the frequency-domain. The goal of this tool (FDNS) is to allow TDAC processing of the MDCT coders which work in different domains. While the MDCT of the frequency-domain part of the USAC acts in the signal domain, the wLPT (or TCX) of the reference concept operates in the weighted filtered domain. By replacing the weighted LPC synthesis filter, which is used in the reference concept, by an equivalent processing step in the frequency-domain, the MDCT of both transform coders operate in the same domain and TDAC can be accomplished without introducing discontinuities in quantization noise-shaping.

In other words, the weighted LPC synthesis filter 330*g* is replaced by the scaling/frequency-domain noise-shaping 380*e* in combination with the LPC to frequency-domain conversion 380*i*. Accordingly, the MDCT 320*g* of the frequency-domain path and the MDCT 380*h* of the TCX-LPD branch operate in the same domain, such that transform domain aliasing-cancellation (TDAC) is achieved.

In the following, some details regarding the forward-aliasing-cancellation window (FAC window) will be described. The forward-aliasing-cancellation (FAC) window has already been introduced and described. This supplemental window compensates the missing TDAC information which—in a continuously running transform code—is usually contributed by the following or preceding window. Since the ACELP time-domain coder exhibits no overlap to adjacent frames, the FAC can compensate for the lack of this missing overlap.

It has been found that by applying the LPC filter in the frequency-domain, the LPD coding path looses some of the smoothing impact of the interpolated LPC filtering between ACELP and wLPT (TCX-LPD) coded segments. However, it has been found that, since the FAC was designed to enable a favorable transition at exactly this place, it can also compensate for this effect.

As a consequence of introducing the FAC window and FDNS, all conceivable transitions can be accomplished without any inherent overcoding.

In the following, some details regarding the windowing scheme will be described.

How the FAC window can fuse the transitions between ACELP and wLPT has already been described. For further details, reference is made to the following document: ISO/IEC JTC1/SC29/WG11, MPEG2009/M16688, June-July 2009, London, United Kingdom, "Alternatives for windowing in USAC".

Since the FDNS shifts the wLPT into the signal domain, the FAC window can now be applied to both, the transitions from/to the ACELP to/from wLPT and also from/to ACELP to/from FD mode in exactly the same manner (or, at least, in a similar manner).

Similarly, the TDAC based transform coder transitions which were previously possible exclusively in-between FD windows or in-between wLPT windows (i.e. from/to FD to/from FD; or from/to wLPT to/from wLPT) can now also be applied when transgressing from the frequency-domain to wLPT, or vice-versa. Thus, both technologies combined allow for the shifting of the ACELP framing grid 64 samples to the right (towards "later" in the time axis). By doing so, the 64 sample overlap-add on one end and the extra-long frequency-domain transform window at the other end are no longer necessitated. In both cases, a 64 samples overcoding can be avoided in embodiments according to the invention when compared to the reference concepts. Most importantly, all other transitions stay as they are and no further modifications are necessitated.

In the following the new frame transition matrix will briefly be discussed. An example for a new transition matrix is provided in FIG. 5. The transitions on the main diagonal stay as they were in working draft 4 of the USAC draft standard. All other transitions can be dealt with by the FAC window or straightforward TDAC in the signal domain. In some embodiments only two overlap lengths between adjacent transform domain windows are needed for the above scheme, namely 1024 samples and 128 samples, though other overlap lengths are also conceivable.

12. Subjective Evaluation

It should be noted that two listening tests have been conducted to show that at the current state of implementation the proposed new technology does not compromise the quality. Eventually, embodiments according to the invention are expected to provide an increase in quality due to the bit savings at the places where samples were previously discarded. As another side effect, the classifier control at the encoder can be much more flexible since the mode transitions are no longer afflicted with non-critical sampling.

13. Further Remarks

To summarize the above, the present description describes an envisioned windowing and transition scheme for the USAC which has several virtues, compared to the existing scheme, used in working draft 4 of the USAC draft standard. The proposed windowing and transition scheme maintains critical sampling in all transform-coded frames, avoids the need for non-power-of-two transforms and properly aligns all transform-coded frames. The proposal is based on two new tools. The first tool, forward-aliasing-cancellation (FAC), is described in the reference [M16688]. The second tool, frequency-domain noise-shaping (FDNS), allows processing frequency-domain frames and wLPT frames in the same domain without introducing discontinuities in the quantization noise shaping. Thus, all mode transitions in USAC can be handled with these two basic tools, allowing harmonized windowing for all transform-coded modes. Subjective tests results were also provided in the present description, showing that the proposed tools provide equivalent or better quality compared to the reference concept according to the working draft 4 of the USAC draft standard.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[M16688] ISO/IEC JTC1/SC29/WG11, MPEG2009/M16688, June-July 2009, London, United Kingdom, "Alternatives for windowing in USAC"

The invention claimed is:

1. An audio signal decoding device for providing a decoded representation of an audio content on the basis of an encoded representation of the audio content, the audio signal decoder comprising:

a transform domain path configured to acquire a time domain representation of a portion of the audio content encoded in a transform domain mode on the basis of a first set of spectral coefficients, a representation of an aliasing-cancellation stimulus signal and a plurality of linear-prediction-domain parameters, wherein the transform domain path comprises a spectrum processor configured to apply a spectral shaping to the first set of spectral coefficients in dependence on at least a subset of the linear-prediction-domain parameters, to acquire a spectrally-shaped version of the first set of spectral coefficients, wherein the transform domain path comprises a first frequency-domain-to-time-domain converter configured to acquire a time-domain representation of the audio content on the basis of the spectrally-shaped version of the first set of spectral coefficients;

wherein the transform domain path comprises an aliasing-cancellation stimulus filter configured to filter an aliasing-cancellation stimulus signal in dependence on at least a subset of the linear-prediction-domain parameters, to derive an aliasing-cancellation synthesis signal from the aliasing-cancellation stimulus signal; and wherein the transform domain path also comprises a combiner configured to combine the time-domain representation of the audio content with the aliasing-cancellation synthesis signal, or a post-processed version thereof, to acquire an aliasing-reduced time-domain signal;

Wherein at least one of the spectrum processor, domain converter, aliasing cancellation stimulus filter, or combiner are executed by an apparatus.

2. The audio signal decoder according to claim 1, wherein the audio signal decoder is a multi-mode audio signal decoder configured to switch between a plurality of coding modes, and wherein the transform domain branch is configured to selectively acquire the aliasing-cancellation synthesis signal for a portion of the audio content following a previous portion of the audio content which does not allow for an aliasing-cancelling overlap-and-add operation or for a portion of the audio content followed by a subsequent portion of the audio content which does not allow for an aliasing-cancelling overlap-and-add operation.

3. The audio signal decoder according to claim 1, wherein the audio signal decoder is configured to switch between a transform-coded-excitation-linear-prediction-domain mode, which uses a transform-coded-excitation information and a linear-prediction-domain parameter information, and a frequency-domain mode, which uses a spectral coefficient information and a scale factor information;

wherein the transform-domain path is configured to acquire the first set of spectral coefficients on the basis of the transform-coded-excitation information, and to acquire the linear-prediction-domain-parameters on the basis of the linear-prediction-domain parameter information;

wherein the audio signal decoder comprises a frequency-domain path configured to acquire a time-domain representation of the audio content encoded on the frequency-domain mode on the basis of a frequency-domain mode set of spectral coefficients described by the spectral coefficient information and in dependence on a set of scale factors described by the scale factor information, wherein the frequency-domain path comprises a spectrum processor configured to apply a spectral shaping to the frequency-domain mode set of spectral coefficients, or to a pre-processed version thereof, in dependence on the set of scale factors, to acquire a spectrally-shaped frequency-domain mode set of spectral coefficients, and when the frequency-domain path comprises a frequency-domain-to-time-domain converter configured to acquire a time domain representation of the audio content on the basis of the spectrally shaped frequency-domain mode set of spectral coefficients;

wherein the audio signal decoder is configured such that time-domain representations of two subsequent portions of the audio content, one of which two subsequent portions of the audio content is encoded in the transform-coded-excitation-linear-prediction-domain mode and one of which two subsequent portions of the audio content is encoded in the frequency-domain mode, comprise a temporal overlap to cancel a time-domain-aliasing caused by the frequency-domain-to-time-domain conversion.

4. Audio signal decoder according to claim 1, wherein the audio signal decoder is configured to switch between a transform-coded-excitation-linear-prediction-domain mode, which uses a transform-coded-excitation information and a linear-prediction-domain parameter information, and an algebraic code-excited-linear-prediction (ACELP) mode, which uses an algebraic-code excitation information and a linear-prediction-domain parameter information;

wherein the transform-domain path is configured to acquire the first set of spectral coefficients on the basis of the transform-coded-excitation information, and to acquire the linear-prediction-domain parameters on the basis of the linear-prediction-domain parameter information;

wherein the audio signal decoder comprises an algebraic-code-excitation-linear-prediction path configured to acquire a time domain representation of the audio content encoded in the ACELP mode on the basis of the algebraic-code-excitation information and the linear-prediction-domain parameter information;

wherein the ACELP path comprises an ACELP excitation processor configured to provide a time-domain excitation signal on the basis of the algebraic-code excitation information and using a synthesis filter configured to perform a time-domain filtering of the time-domain excitation signal to provide a reconstructed signal on the basis of the time-domain excitation signal and in dependence on linear-prediction-domain filter coefficients acquired on the basis of the linear-prediction-domain parameter information;

wherein the transform domain path is configured to selectively provide the aliasing-cancellation synthesis signal for a portion of the audio content encoded in the transform-coded-excitation-linear-prediction-domain mode following a portion of the audio content encoded in the ACELP mode, and for a portion of the audio content encoded in the transform-coded-excitation-linear-prediction-domain mode preceding a portion of the audio content encoded in the ACELP mode.

5. The audio signal decoder according to claim 4, wherein the aliasing-cancellation stimulus filter is configured to filter the aliasing-cancellation stimulus signal in dependence on the linear-prediction-domain filter parameters which correspond to a left-sided aliasing folding point of the first frequency-domain-to-time-domain converter for a portion of the audio content encoded in the transform-coded-excitation-linear-prediction-domain mode following a portion of the audio content encoded on the ACELP mode, and wherein the aliasing-cancellation stimulus filter is configured to filter the aliasing-cancellation stimulus signals in dependence on the linear-prediction-domain filter parameters which correspond to a right-sided aliasing folding point of the first frequency-domain-to-time-domain converter for a portion of the audio content encoded in the transform-coded-excitation-linear-prediction-domain mode preceding a portion of the audio content encoded on the ACELP mode.

6. The audio signal decoder according to claim 4, wherein the audio signal decoder is configured to initialize memory values of the aliasing-cancellation stimulus filter to zero for providing the aliasing-cancellation synthesis signal, to feed M samples of the aliasing-cancellation stimulus signal into the aliasing-cancellation stimulus filter, to acquire corresponding non-zero-input response samples of the aliasing-cancellation synthesis signal, and to further acquire a plurality of zero-input response samples of the aliasing-cancellation synthesis signal; and wherein the combiner is configured to combine the time-domain representation of the audio content with the non-zero-input response samples and the subsequent zero-input response samples to acquire an aliasing-reduced time-domain signal at a transition from a portion of the audio content encoded in the ACELP mode to a subsequent portion of the audio content encoded in the transform-coded-excitation-linear-prediction-domain mode.

7. The audio signal decoder according to claim 4, wherein the audio signal decoder is configured to combine a windowed and folded version of at least a portion of the time-domain representation acquired using the ACELP mode with a time-domain representation of a subsequent portion of the audio content acquired using the transform-coded-excitation-linear-prediction-domain mode, to at least partially cancel an aliasing.

8. The audio signal decoder according to claim 4, wherein the audio signal decoder is configured to combine a windowed version of a zero-input response of the synthesis filter of the ACELP branch with a time-domain representation of a subsequent portion of the audio content acquired using the transform-coded-excitation-linear-prediction-domain mode, to at least partially cancel an aliasing.

9. The audio signal decoder according to claim 4, wherein the audio signal decoder is configured to switch between a transform-coded-excitation-linear-prediction-domain mode, in which a lapped frequency-domain-to-time-domain transform is used, a frequency-domain mode, in which a lapped frequency-domain-to-time-domain transform is used, and an algebraic-code-excitation-linear-prediction mode, wherein the audio signal decoder is configured to at least partially cancel an aliasing at a transition between a portion of the audio content encoded in the transform-coded-excitation-linear-prediction-domain mode and a portion of the audio content encoded in the frequency-domain mode by performing an overlap-and-add operation between time-domain samples of subsequent overlapping portions of the audio content; and wherein the audio signal decoder is configured to at least partially cancel an aliasing at a transition between a portion of the audio content encoded in the transform-coded-excitation-linear-prediction-domain mode and a portion of the audio content encoded in the algebraic-code-excited-linear-prediction-domain mode using the aliasing-cancellation synthesis signal.

10. The audio signal decoder according to claim 1, wherein the audio signal decoder is configured to apply a common gain value for a gain scaling of a time-domain representation provided by the first frequency-domain-to-time-domain converter of the transform domain path and for a gain scaling of the aliasing-cancellation stimulus signal or the aliasing-cancellation synthesis signal.

11. The audio signal decoder according to claim 1, wherein the audio signal decoder is configured to apply, in addition to the spectral shaping performed in dependence on at least the subset of linear-prediction-domain parameters, a spectrum deshaping to at least a subset of the first set of spectral coefficients, and wherein the audio signal decoder is configured to apply the spectrum deshaping to at least a subset of a set of aliasing-cancellation spectral coefficients from which the aliasing-cancellation stimulus signal is derived.

12. The audio signal decoder according to claim 1, wherein the audio signal decoder comprises a second frequency-domain-to-time-domain converter configured to acquire a time-domain representation of the aliasing-cancellation stimulus signal in dependence on a set of spectral coefficients representing the aliasing-cancellation stimulus signal, wherein the first frequency-domain-to-time-domain converter is configured to perform a lapped transform, which comprises a time-domain aliasing, and wherein the second frequency-domain-to-time-domain converter is configured to perform a non-lapped transform.

13. The audio signal decoder according to claim 1, wherein the audio signal decoder is configured to apply the spectral shaping to the first set of spectral coefficients in dependence on the same linear-prediction-domain parameters, which are used for adjusting the filtering of the aliasing-cancellation stimulus signal.

14. An audio signal encoding device for providing an encoded representation of an audio content comprising a first set of spectral coefficients, a representation of an aliasing-cancellation stimulus signal and a plurality of linear-prediction-domain parameters on the basis of an input representation of the audio content, the audio signal encoder comprising:

a time-domain-to-frequency-domain converter configured to process the input representation of the audio content, to acquire a frequency-domain representation of the audio content;

a spectral processor configured to apply a spectral shaping to the frequency-domain representation of the audio content, or to a pre-processed version thereof, in dependence on a set of linear-prediction-domain parameters for a portion of the audio content to be encoded in the linear-prediction-domain, to acquire a spectrally-shaped frequency-domain representation of the audio content; and an aliasing-cancellation information provider configured to provide a representation of an aliasing-cancellation stimulus signal, such that a filtering of the aliasing-cancellation stimulus signal in dependence on at least a subset of the linear-prediction-domain parameters results in an aliasing-cancellation synthesis signal for cancelling aliasing artifacts in an audio signal decoder;

Wherein at least one of the spectral processor, domain converter, or aliasing cancellation information provider are executed by an apparatus.

15. A method for providing a decoded representation of an audio content on the basis of an encoded representation of the audio content, the method comprising:

acquiring a time-domain representation of a portion of the audio content encoded in a transform domain mode on the basis of a first set of spectral coefficients, a representation of an aliasing-cancellation stimulus signal and the plurality of linear-prediction-domain parameters, wherein a spectral shaping is supplied to the first set of spectral coefficients in dependence on at least a subset of the linear-prediction-domain parameters, to acquire a spectrally shaped version of the first set of spectral coefficients, and wherein a frequency-domain-to-time-domain conversion is applied to acquire a time-domain representation of the audio content on the basis of the spectrally-shaped version of the first set of spectral coefficients, and wherein the aliasing-cancellation stimulus signal is filtered in dependence of at least a subset of the linear-prediction-domain parameters, to derive an aliasing-cancellation synthesis signal from the aliasing-cancellation stimulus signal, and wherein the time-domain representation of the audio content is combined with the aliasing-cancellation synthesis signal, or a post-processed version thereof, to acquire an aliasing-reduced-time-domain signal;

wherein the method is executed by an apparatus.

16. A method for providing an encoded representation of an audio content comprising a first set of spectral coefficients, a representation of an aliasing-cancellation stimulus signal, and a plurality of linear-prediction-domain parameters on the basis of an input representation of the audio content, the method comprising:

performing a time-domain-to-frequency-domain conversion to process the input representation of the audio content, to acquire a frequency-domain representation of the audio content;

applying a spectral shaping to the frequency-domain representation of the audio content, or to a pre-processed version thereof, in dependence of a set of linear-prediction-domain parameters for a portion of the audio content to be encoded in the linear-prediction-domain, to acquire a spectrally-shaped frequency-domain representation of the audio content; and providing a representation of an aliasing-cancellation stimulus signal, such that a filtering of the aliasing-cancellation stimulus signal in dependence on at least a subset of the linear-prediction-domain parameters results in an aliasing-cancellation synthesis signal for cancelling aliasing artifacts in an audio signal decoder;

wherein the method is executed by an apparatus.

17. A computer program embodied on a non-transitory computer-readable medium for performing the method for providing a decoded representation of an audio content on the basis of an encoded representation of the audio content, the method comprising:

acquiring a time-domain representation of a portion of the audio content encoded in a transform domain mode on the basis of a first set of spectral coefficients, a representation of an aliasing-cancellation stimulus signal and the plurality of linear-prediction-domain parameters, wherein a spectral shaping is supplied to the first set of spectral coefficients in dependence on at least a subset of the linear-prediction-domain parameters, to acquire a spectrally shaped version of the first set of spectral coefficients, and wherein a frequency-domain-to-time-domain conversion is applied to acquire a time-domain representation of the audio content on the basis of the spectrally-shaped version of the first set of spectral coefficients, and wherein the aliasing-cancellation stimulus signal is filtered in dependence of at least a subset of the linear-prediction-domain parameters, to derive an aliasing-cancellation synthesis signal from the aliasing-cancellation stimulus signal, and wherein the time-domain representation of the audio content is combined with the aliasing-cancellation synthesis signal, or a post-processed version thereof, to acquire an aliasing-reduced-time-domain signal, when the computer program runs on a computer.

18. A computer program embodied on a non-transitory computer-machine readable medium for performing the method for providing an encoded representation of an audio content comprising a first set of spectral coefficients, a representation of an aliasing-cancellation stimulus signal, and a plurality of linear-prediction-domain parameters on the basis of an input representation of the audio content, the method comprising:

performing a time-domain-to-frequency-domain conversion to process the input representation of the audio content, to acquire a frequency-domain representation of the audio content;

applying a spectral shaping to the frequency-domain representation of the audio content, or to a pre-processed version thereof, in dependence of a set of linear-prediction-domain parameters for a portion of the audio content to be encoded in the linear-prediction-domain, to acquire a spectrally-shaped frequency-domain representation of the audio content; and providing a representation of an aliasing-cancellation stimulus signal, such that a filtering of the aliasing-cancellation stimulus signal in dependence on at least a subset of the linear-prediction-domain parameters results in an aliasing-cancellation synthesis signal for cancelling aliasing artifacts in an audio signal decoder, when the computer program runs on a computer.

* * * * *

UNITED STATES PATENT AND TRADEMARK OFFICE

CERTIFICATE OF CORRECTION

PATENT NO. : 8,484,038 B2
APPLICATION NO. : 13/449949
DATED : July 9, 2013
INVENTOR(S) : Bruno Bessette et al.

It is certified that error appears in the above-identified patent and that said Letters Patent is hereby corrected as shown below:

In the Claims:

Column 60, line 29, Claim 18, “computer-machine readable” should be --computer-readable--.

Signed and Sealed this
First Day of July, 2014

Michelle K. Lee

Michelle K. Lee
*Deputy Director of the United States Patent and Trademark Office*